US007233342B1

(12) United States Patent
Yamazaki et al.

(10) Patent No.: US 7,233,342 B1
(45) Date of Patent: Jun. 19, 2007

(54) TIME AND VOLTAGE GRADATION DRIVEN DISPLAY DEVICE

(75) Inventors: Shunpei Yamazaki, Tokyo (JP); Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 09/507,825

(22) Filed: Feb. 22, 2000

(30) Foreign Application Priority Data

Feb. 24, 1999 (JP) ..... 11-045776

(51) Int. Cl.
*G06G 3/36* (2006.01)
*G06G 5/10* (2006.01)

(52) U.S. Cl. ..... 345/692; 345/690; 345/89

(58) Field of Classification Search ..... 345/87–100, 345/47, 690–692, 108, 147, 204, 600
See application file for complete search history.

(56) References Cited

U.S. PATENT DOCUMENTS

| | | | | |
|---|---|---|---|---|
| 3,675,232 | A | 7/1972 | Strout | 340/324 |
| 4,042,854 | A | 8/1977 | Luo et al. | 313/505 |
| 4,090,219 | A | 5/1978 | Ernstoff et al. | 348/742 |
| 4,750,813 | A | 6/1988 | Ohwada et al. | 345/87 |
| 4,864,390 | A | 9/1989 | McKechnie et al. | 348/751 |
| 4,907,862 | A | 3/1990 | Suntola | 349/61 |
| 4,910,687 | A * | 3/1990 | Butler et al. | 345/559 |
| 5,122,784 | A | 6/1992 | Canova | 345/605 |
| 5,122,792 | A | 6/1992 | Stewart | 345/692 |
| 5,247,190 | A | 9/1993 | Friend et al. | 257/40 |
| 5,272,471 | A | 12/1993 | Asada et al. | 345/694 |
| 5,327,229 | A | 7/1994 | Konno et al. | 348/742 |
| 5,337,171 | A | 8/1994 | Mase et al. | 349/74 |
| 5,349,366 | A | 9/1994 | Yamazaki et al. | 345/92 |
| 5,363,118 | A | 11/1994 | Okumura | 345/95 |
| 5,399,502 | A | 3/1995 | Friend et al. | 437/1 |
| 5,414,442 | A | 5/1995 | Yamazaki et al. | 345/89 |
| 5,428,366 | A | 6/1995 | Eichenlaub et al. | 345/102 |
| 5,528,262 | A | 6/1996 | McDowall et al. | 345/664 |
| 5,583,530 | A | 12/1996 | Mano et al. | 345/89 |
| 5,594,569 | A | 1/1997 | Konuma et al. | 349/122 |

(Continued)

FOREIGN PATENT DOCUMENTS

EP 0 433 054 6/1991

(Continued)

OTHER PUBLICATIONS

Schenk, H. et al, "Polymers for Light Emitting Diodes," *EuroDisplay '99, Proceedings of the 19th International Display Research Conference*, Sep. 6-9, 1999, Berlin, Germany, pp. 33-37.

(Continued)

*Primary Examiner*—Bipin Shalwala
*Assistant Examiner*—David L. Lewis
(74) *Attorney, Agent, or Firm*—Cook, Alex, McFarron, Manzo, Cummings & Mehler, Ltd.

(57) ABSTRACT

To provide a display device which is capable of multi-gradation display without complicating the structure of a D/A converter circuit. Of m bit digital video data inputted from the external, upper n bit data is used as voltage gradation information and lower (m−n) bit data is used as time gradation information.

24 Claims, 31 Drawing Sheets

U.S. PATENT DOCUMENTS

| | | | | |
|---|---|---|---|---|
| 5,642,129 | A | 6/1997 | Zavracky et al. | 345/100 |
| 5,643,826 | A | 7/1997 | Ohtani et al. | 437/88 |
| 5,648,277 | A | 7/1997 | Zhang et al. | 437/21 |
| 5,677,704 | A * | 10/1997 | Kusano et al. | 345/89 |
| 5,712,651 | A * | 1/1998 | Tomiyasu | 345/89 |
| 5,724,058 | A | 3/1998 | Choi et al. | 345/89 |
| 5,784,040 | A * | 7/1998 | Kobayashi et al. | 345/89 |
| 5,784,073 | A | 7/1998 | Yamazaki et al. | 345/537 |
| 5,874,933 | A | 2/1999 | Hirai et al. | 345/89 |
| 5,892,496 | A | 4/1999 | Wakeland | 345/694 |
| 5,917,471 | A | 6/1999 | Choi | 345/690 |
| 5,923,962 | A | 7/1999 | Ohtani et al. | 438/150 |
| 5,953,002 | A * | 9/1999 | Hirai et al. | 345/204 |
| 5,956,105 | A | 9/1999 | Yamazaki et al. | 349/43 |
| 5,959,603 | A | 9/1999 | Ito et al. | 345/100 |
| 5,990,629 | A | 11/1999 | Yamada et al. | 315/169.3 |
| 6,020,869 | A | 2/2000 | Sasaki et al. | |
| 6,028,588 | A * | 2/2000 | Yoon | 345/89 |
| 6,049,367 | A | 4/2000 | Sharp et al. | 349/117 |
| 6,067,066 | A * | 5/2000 | Kubota et al. | 345/98 |
| 6,069,609 | A | 5/2000 | Ishida et al. | 345/596 |
| 6,072,454 | A | 6/2000 | Nakai et al. | 345/97 |
| 6,078,304 | A | 6/2000 | Miyazawa | 345/88 |
| 6,108,058 | A | 8/2000 | Uchida | 349/61 |
| 6,127,991 | A * | 10/2000 | Uchara et al. | 345/89 |
| 6,160,533 | A * | 12/2000 | Tamai et al. | 345/89 |
| 6,165,824 | A * | 12/2000 | Takano et al. | 438/160 |
| 6,184,874 | B1 | 2/2001 | Smith et al. | 345/204 |
| 6,188,379 | B1 | 2/2001 | Kaneko | 345/102 |
| 6,215,466 | B1 | 4/2001 | Yamazaki et al. | 345/89 |
| 6,229,583 | B1 * | 5/2001 | Yasunishi | 345/89 |
| 6,232,941 | B1 * | 5/2001 | Ode et al. | 345/95 |
| 6,239,781 | B1 * | 5/2001 | Fujisawa | 345/147 |
| 6,292,168 | B1 | 9/2001 | Venable et al. | 345/605 |
| 6,297,813 | B1 | 10/2001 | Okada et al. | 345/204 |
| 6,300,927 | B1 | 10/2001 | Kubota et al. | 345/92 |
| 6,320,565 | B1 * | 11/2001 | Albu et al. | 345/98 |
| 6,320,568 | B1 | 11/2001 | Zavracky | 345/101 |
| 6,323,871 | B1 * | 11/2001 | Fujiyoshi et al. | 345/88 |
| 6,326,941 | B1 | 12/2001 | Yamazaki et al. | 345/95 |
| 6,331,844 | B1 | 12/2001 | Okumura et al. | 345/87 |
| 6,335,717 | B2 * | 1/2002 | Hasegawa et al. | 345/97 |
| 6,353,435 | B2 * | 3/2002 | Kudo et al. | 345/89 |
| 6,369,785 | B1 | 4/2002 | Imai | 345/76 |
| 6,380,917 | B2 | 4/2002 | Matsueda et al. | 345/89 |
| 6,452,583 | B1 * | 9/2002 | Takeuchi et al. | 345/108 |
| 6,459,416 | B1 * | 10/2002 | Sasaki et al. | 345/89 |
| 6,462,728 | B1 * | 10/2002 | Janssen et al. | 345/100 |
| 6,590,581 | B1 * | 7/2003 | Koyama et al. | 345/690 |
| 6,753,854 | B1 * | 6/2004 | Koyama et al. | 345/204 |
| 2002/0047852 | A1 | 4/2002 | Inukai et al. | 345/629 |
| 2003/0058210 | A1 | 3/2003 | Yamazaki et al. | 345/89 |

FOREIGN PATENT DOCUMENTS

| | | |
|---|---|---|
| EP | 0 484 159 | 5/1992 |
| EP | 0 655 726 | 5/1995 |
| EP | 0 853 254 | 7/1998 |
| EP | 0 875 881 | 11/1998 |
| JP | 7-130652 | 5/1995 |
| JP | 7-135318 | 5/1995 |
| JP | 8-078329 | 3/1996 |
| JP | 10-092576 | 4/1998 |
| JP | 10-214060 | 8/1998 |
| JP | 10-232649 | 9/1998 |
| JP | 10-312173 | 11/1998 |
| WO | WO 90/13148 | 11/1990 |

OTHER PUBLICATIONS

Yoshida, T. et al, "A Full-Color Thresholdless Antiferroelectric LCD Exhibiting Wide Viewing Angle with Fast Response Time," *SID 97 Digest*, pp. 841-844, 1997.

Furue, H. et al, "Characteristics and Driving Scheme of Polymer-Stabilized Monostable FLCD Exhibiting Fast Response Time and High Contrast Ratio with Gray-Scale Capability," *SID 98 Digest*, pp. 782-785, 1998.

English abstract re Japanese patent application No. 7-130652, published May 19, 1995.

English abstract re Japanesse patent application No. 7-135318, published May 23, 1995.

English abstract re Japanese patent application No. 8-078329, published Mar. 22, 1996.

English abstract re Japanese patent application No. 10-092576, published Apr. 10, 1998.

European Search Report re application No. EP 00 10 5500, dated Dec. 5, 2000.

Inui, S. et al, "Thresholdless Antiferroelectricity in Liquid Crystals and its Application to Displays," *J. Mater. Chem.*, vol. 6, No. 4, pp. 671-673, 1996.

Pending U.S. Appl. No. 09/522,428 to Yamazaki et al, filed Mar. 9, 2000, including specification, claims, drawings, preliminary amendment A.

Pending U.S. Appl. No. 09/534,812 to Yamazaki et al, filed Mar. 24, 2000, including specification, claims, drawings.

Pending U.S. Appl. No. 09/536,782 to , filed Mar. 28, 2000, including specification, claims, drawings.

Final rejection re U.S. Appl. No. 09/522,428, dated Oct. 18, 2004.

Amendment F re U.S. Appl. No. 09/522,428, dated Apr. 18, 2005.

Miyashita, T. et al, "Properties of the OCB Mode for Active-Matrix LCDs with Wide Viewing Angle," SID 95 Digest, pp. 797-800 (1995).

* cited by examiner

TIME AND VOLTAGE GRADATION DRIVEN DISPLAY DEVICE

BACKGROUND OF THE INVENTION

1. Field of the Invention

The present invention relates to a display device, particularly, to an active matrix type display device in which gradation display is carried out by gradation voltage as well as time gradation.

2. Description of the Related Art

The technique that has recently accomplished rapid development is one for manufacturing a semiconductor device in which semiconductor thin films are formed on an inexpensive glass substrate, for example, a thin film transistor (TFT). This is because of growing demand for an active matrix type display device.

For example, in an active matrix type display device, a pixel TFT is put in each of pixel regions as many as several hundred thousands to several millions is arranged in matrix, and electric charge that flows into and out of a pixel electrode connected to each pixel TFT is controlled by switching function of the pixel TFT.

As images acquire higher definition and higher resolution in recent years, demand for multi-gradation display which, desirably, is capable of full color display has been established.

Accompanying the movement regarding display devices towards higher definition and higher resolution, the active matrix type display device that has drawn attention most is a digital driven active matrix type display device which can be driven at a high speed.

The digital driven active matrix type display device needs a D/A converter circuit (DAC) for converting digital video data inputted from the external into analogue data (gradation voltage). There are various kinds of D/A converter circuits.

The multi-gradation display capability of the active matrix type display device is dependent on the capacity of the D/A converter circuit, namely, how many bits of digital video data the D/A converter circuit is capable of converting into analogue data. For instance, in general, a display device having a D/A converter circuit that processes 2 bit digital video data is capable of $2^2=4$ gradation display. If the circuit processes 8 bit data, the device is capable of $2^8=256$ gradation display, if n bit, $2^n$ gradation display.

However, enhancement of the capacity of the D/A converter circuit costs complicated circuit structure and enlarged layout area for the D/A converter circuit. According to a lately reported display device, a D/A converter circuit is formed on the same substrate where a pixel region is formed, using a poly silicon TFT. In this case, however, the structure of the D/A converter circuit is complicated to lower the yield of the D/A converter circuit, resulting in yield decrease of the display device. In addition, increased layout area of the D/A converter circuit makes it difficult to downsize the display device.

SUMMARY OF THE INVENTION

The present invention has been made in view of the problems above and, therefore, an object of the present invention is to provide a display device capable of realizing a multi-gradation display.

According to the present invention, there is provided a display device comprising:

a pixel region with a plurality of pixel TFTs arranged in matrix; and at least one source driver and at least one gate driver for driving the pixel region, characterized in that, when m bit digital video data are inputted from the external, upper n bit data and lower (m−n) bit data are used as gradation voltage information and time gradation information, respectively, where m and n are both positive integers equal to or larger than 2 and satisfy m>n.

According to the present invention, there is provided a display device comprising:

a pixel region with a plurality of pixel TFTs arranged in matrix;

at least one source driver and at least one gate driver for driving the pixel region; and a circuit for converting m bit digital video data inputted from the external into n bit digital video data for gradation voltage, and for supplying the source driver with the n bit digital video data (m and n are both positive integers equal to or larger than 2, m>n), characterized in that one frame of image consists of $2^{m-n}$ sub-frames to perform time gradation display.

According to the present invention, there is provided a display device comprising:

a pixel region with a plurality of pixel TFTs arranged in matrix;

at least one source driver and at least one gate driver for driving the pixel region; and a circuit for converting m bit digital video data inputted from the external into n bit digital video data for gradation voltage, and for supplying the source driver with the n bit digital video data (m and n are both positive integers equal to or larger than 2, m>n), characterized in that one frame of image consists of $2^{m-n}$ sub-frames to perform time gradation display, thereby obtaining $(2^m-(2^{m-n}-1))$ patterns of gradation display.

According to the present invention, there is provided a display device comprising a pixel region with a plurality of pixel TFTs arranged in matrix and at least one source driver and at least one gate driver for driving the pixel region, characterized in that, when m bit digital video data are inputted from the external, upper n bit data and lower (m−n) bit data are used as gradation voltage information and time gradation information, respectively (m and n are both positive integers equal to or larger than 2, m>n), and in that the source driver has D/A converter circuits for converting the n bit digital video data into analog gradation voltage.

According to the present invention, there is provided a display device comprising:

a pixel region with a plurality of pixel TFTs arranged in matrix;

at least one source driver and at least one gate driver for driving the pixel region; and a circuit for converting m bit digital video data inputted from the external into n bit digital video data for gradation voltage, and for supplying the source driver with the n bit digital video data (m and n are both positive integers equal to or larger than 2, m>n), characterized in that the source driver has a D/A converter circuit for converting the n bit digital video data into analog gradation voltage, and in that one frame of image consists of $2^{m-n}$ sub-frames to perform time gradation display.

According to the present invention, there is provided a display device comprising:

a pixel region with a plurality of pixel TFTs arranged in matrix;

at least one source driver and at least one gate driver for driving the pixel region; and a circuit for converting m bit digital video data inputted from the external into n bit digital video data for gradation voltage, and for supplying the source driver with the n bit digital video data (m and n are both positive integers equal to or larger than 2, m>n), characterized in that the source driver has a D/A converter circuit for converting the n bit digital video data into analog gradation voltage, and in that one frame of image consists of $2^{m-n}$ sub-frames to perform time gradation display, thereby obtaining $(2^m-(2^{m-n}-1))$ patterns of gradation display.

According to the present invention, there is provided a display device comprising:

a pixel region with a plurality of pixel TFTs arranged in matrix;

at least one source driver and at least one gate driver for driving the pixel region;

a circuit for converting m bit digital video data inputted from the external into n bit digital video data for gradation voltage (m and n are both positive integers equal to or larger than 2, m>n); and a D/A converter circuit for converting the n bit digital video data into analog video data to input the converted data to the source driver, characterized in that one frame of image consists of $2^{m-n}$ sub-frames to perform time gradation display.

According to the present invention, there is provided a display device comprising:

a pixel region with a plurality of pixel TFTs arranged in matrix;

at least one source driver and at least one gate driver for driving the pixel region;

a circuit for converting m bit digital video data inputted from the external into n bit digital video data for gradation voltage (m and n are both positive integers equal to or larger than 2, m>n); and a D/A converter circuit for converting the n bit digital video data into analog video data to input the converted data to the source driver, characterized in that one frame of image consists of $2^{m-n}$ sub-frames to perform time gradation display, thereby obtaining $(2^m-(2^{m-n}-1))$ patterns of gradation display.

The above-mentioned m and n may be 8 and 2, respectively.

The above-mentioned m and n may be 12 and 4, respectively.

The above-mentioned display device may use thresholdless antiferroelectric mixed liquid crystal material.

The above-mentioned display device may use electroluminescence material.

BRIEF DESCRIPTION OF THE DRAWINGS

FIGS. 35A and 35B shows the structure of a pixel region in an EL display device according to Embodiment 19 of the invention, in which FIG. 35A is a top view thereof and FIG. 35B is a circuit diagram thereof;

DETAILED DESCRIPTION OF THE PREFERRED EMBODIMENT

A description will be made in the following on a display device of the present invention with preferred embodiments. However, the display device of the present invention is not limited to the embodiments below.

Figure 1:
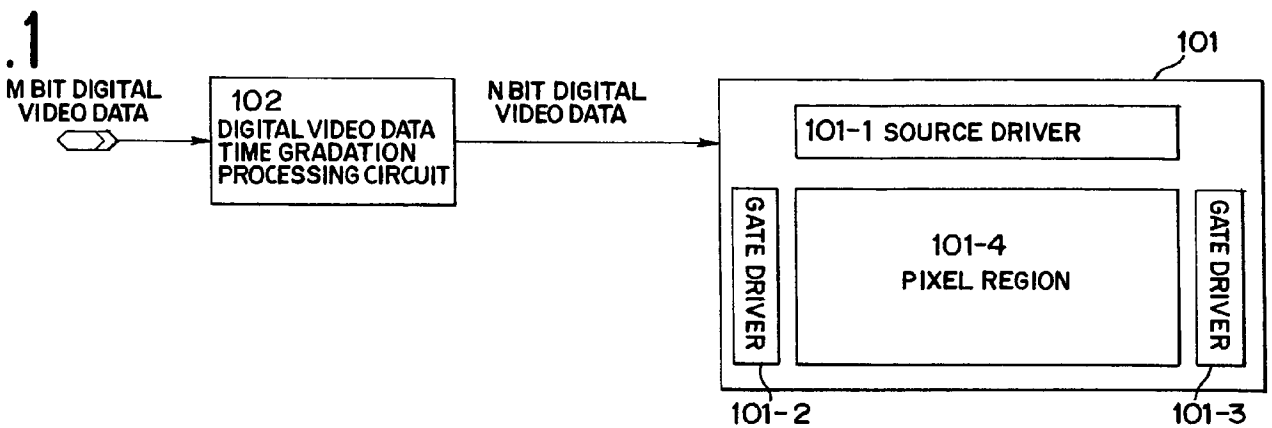
FIG. 1 is a structural diagram schematically showing a display device of the present invention.

First, see FIG. 1 which is a structural diagram schematically showing a display device of the present invention. Reference numeral 101 denotes a display panel comprising digital drivers. Denoted by 101-1 is a source driver, 101-2 and 101-3 denote gate drivers, and 101-4 designates a pixel region with a plurality of pixel TFTs arranged in matrix. The source driver 101-1 and the gate drivers 101-2, 101-3 drive the pixel region. Reference numeral 102 denotes a digital video data time gradation processing circuit.

The digital video data time gradation processing circuit 102 converts, of m bit digital video data inputted from the external, n bit digital video data into n bit digital video data for gradation voltage. Gradation information of lower (m−n) bit data of the m bit digital video data is expressed in time gradation.

The n bit digital video data converted by the digital video data time gradation processing circuit 102 is inputted to the display panel 101. The n bit digital video data inputted to the display panel 101 is then inputted to the source driver and converted into analogue gradation data by the D/A converter circuit within the source driver so as to be sent to each source signal line.

Figure 2:
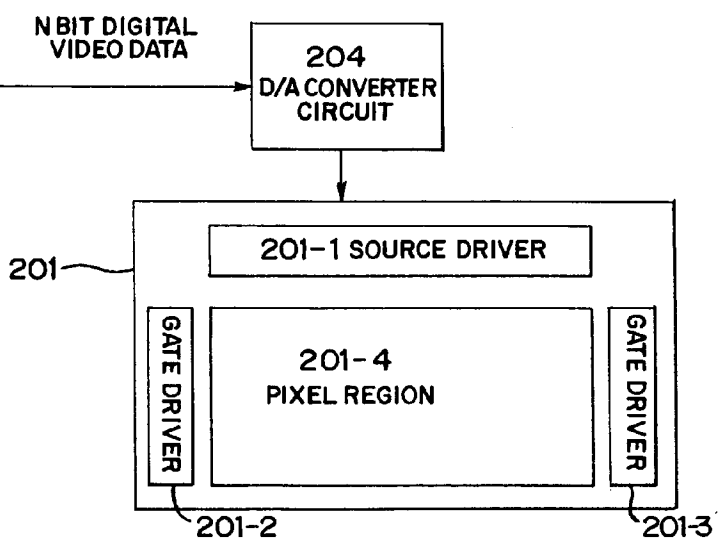
FIG. 2 is a structural diagram schematically showing another display device of the present invention.

Shown next in FIG. 2 is another example of the display device of the present invention. In FIG. 2, reference numeral 201 denotes a display panel having analogue drivers. Reference numeral 201-1 denotes a source driver, 201-2, 201-3, gate drivers, and 201-4, a pixel region with a plurality of pixel TFTs arranged in matrix. The source driver 201-1 and the gate drivers 201-2, 201-3 drive the pixel region. Denoted by 202 is an A/D converter circuit that converts analogue video data sent from the external into m bit digital video data. Reference numeral 203 denotes a digital video data time gradation processing circuit. The digital video data time gradation processing circuit 203 converts, of inputted m bit digital video data, n bit digital video data into n bit digital video data for gradation voltage. Gradation information of lower (m−n) bit data of the inputted m bit digital video data is expressed in time gradation. The n bit digital video data converted by the digital video data time gradation processing circuit 203 is inputted to a D/A converter circuit 204 to be converted into analogue video data. The analogue video data converted by the D/A converter circuit 204 is inputted to the display panel 201. The analogue video data inputted to the display panel 201 is then inputted to the source driver and sampled by a sampling circuit within the source driver so as to be sent to each source signal line.

Embodiment 1

Figure 3:
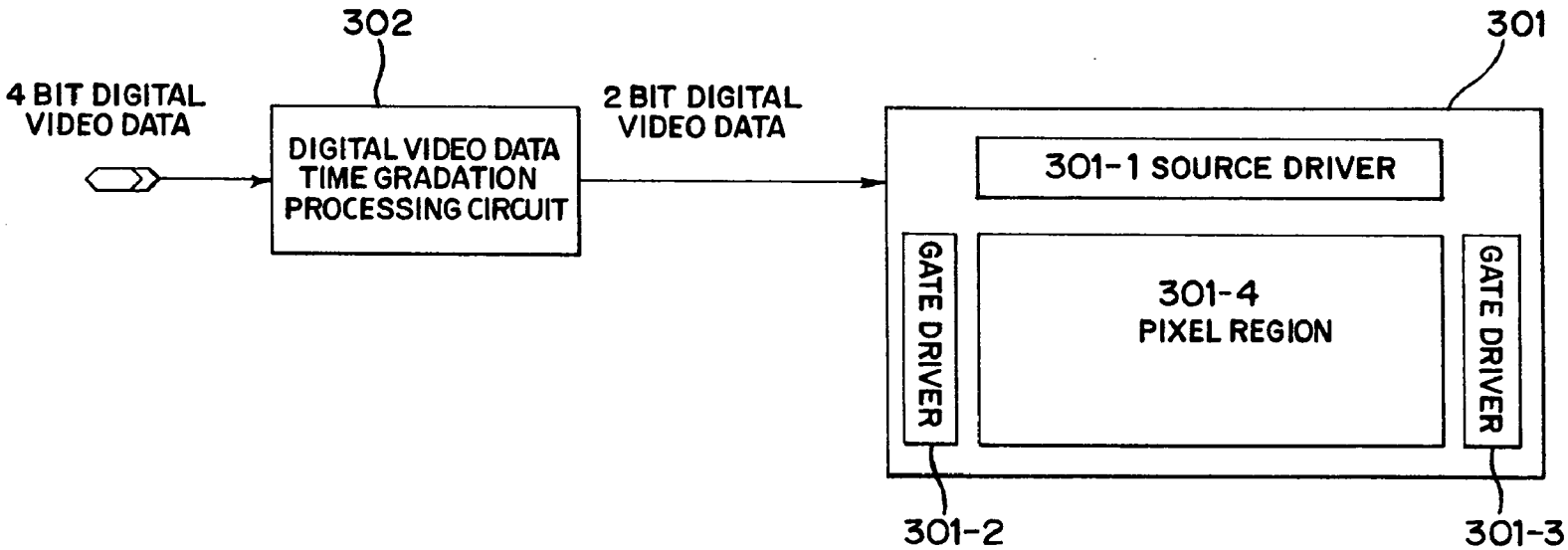
FIG. 3 is a structural diagram schematically showing a display device according to Embodiment 1 of the invention.

FIG. 3 schematically shows a structural diagram of a display device of this embodiment. In this embodiment, a display device to which 4 bit digital video data is sent from the external is taken as an example with the intention of simplifying the explanation.

Reference numeral 301 denotes a display panel having digital drivers.

Denoted by 301-1 is a source driver, 301-2, 301-3, gate drivers, 301-4, a pixel region with a plurality of pixel TFTs arranged in matrix.

A digital video data time gradation processing circuit 302 converts, of 4 bit digital video data inputted from the external, upper 2 bit digital video data into 2 bit digital video data for gradation voltage. Of the 4 bit digital video data, gradation information of lower 2 bit digital video data is expressed in time gradation.

The upper 2 bit digital video data converted by the digital video data time gradation processing circuit 302 is inputted to the display panel 301. The 2 bit digital video data inputted to the display panel 301 is then inputted to the source driver and converted into analogue gradation data by a D/A converter circuit (not shown) within the source driver so as to be sent to each source signal line. The D/A converter circuit incorporated in the display panel according to this embodiment converts 2 bit digital video data into analogue gradation voltage.

Figure 4:
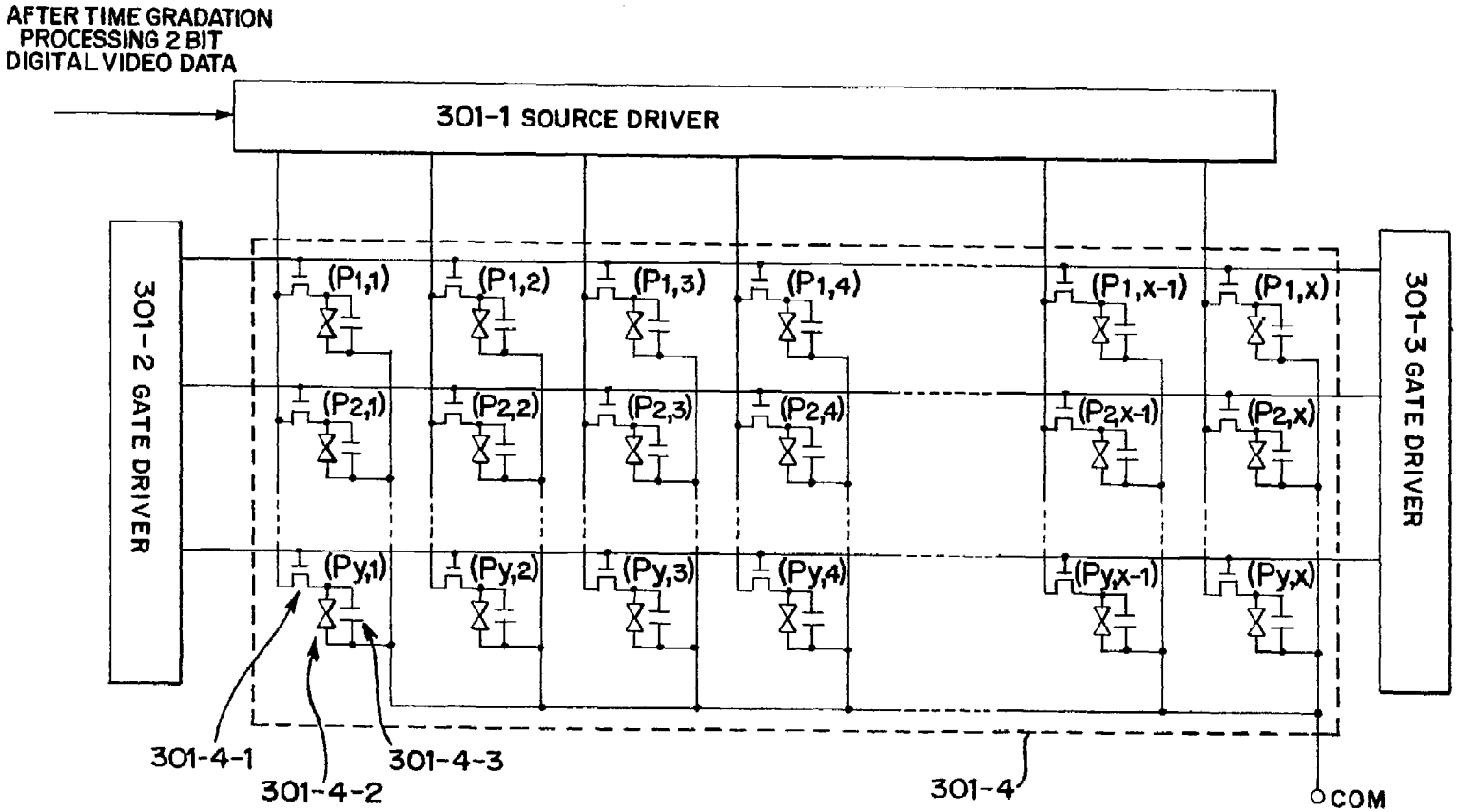
FIG. 4 is a diagram showing a circuit structure of a liquid crystal display device according to Embodiment 1.

When the display device according to this embodiment is an liquid crystal display device, a description is given with reference to FIG. 4 of the circuit structure for the display panel 301 (liquid crystal panel), in particular, the pixel region 301-4.

The pixel region 301-4 has (x×y) pieces of pixels. For convenience's sake in explanation, each pixel is designated by a symbol such as P1,1, P2,1, . . . , and Py,x. Also, each pixel has a pixel TFT 301-4-1 and a storage capacitor 301-4-3. Liquid crystal is held between an active matrix substrate, on which the source driver 301-1, the gate drivers 301-2, 301-3 and the pixel region 301-4 are formed, and an opposite substrate. Liquid crystal 3006 schematically shows the liquid crystal for each of the pixel.

The digital driver display panel of this embodiment drives pixels on one line (e.g., P1,1, P1,2, . . . , P1,x) simultaneously: so-called line sequential driving. In other words, analogue gradation voltage is written in one line of pixels at once. A time required to write analogue gradation voltage in all pixels (P1,1 to Py,x) is named here one frame period (Tf). One frame period (Tf) is divided into four periods, which are referred to as sub-frame periods (Tsf). Further, a time required to write analogue gradation voltage in one line of pixels (e.g., P1,1, P2,1, . . . , Py,x) is called one line period (Tsfl).

Figure 5:
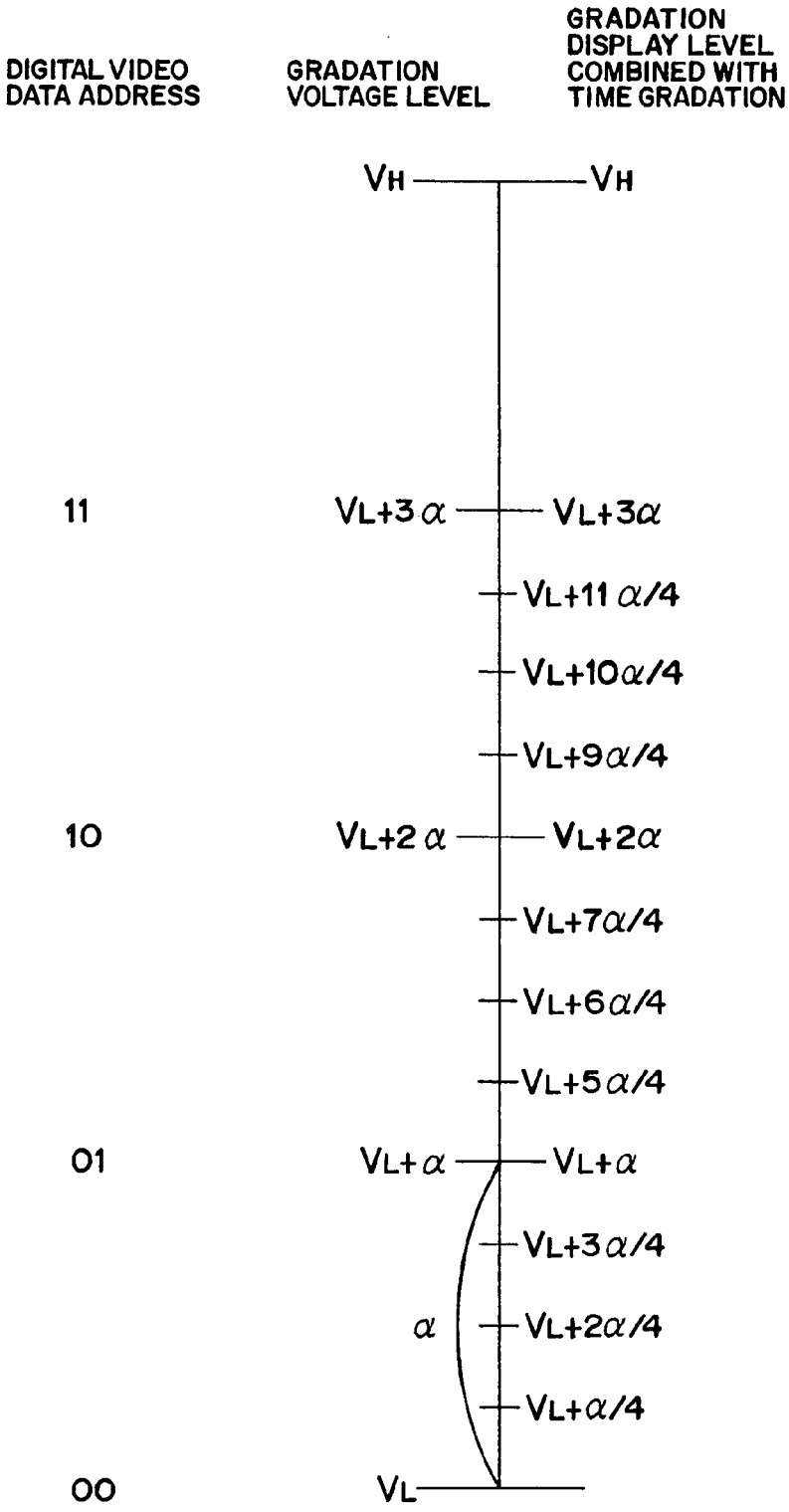
FIG. 5 is a diagram showing a gradation display level of a display device according to Embodiment 1.

Gradation display with the display device of this embodiment will now be described. The digital video data sent from the external to the display device of this embodiment is 4 bit and contains information of 16 gradation. FIG. 5 shows gradation display level for the display device of this embodiment. The voltage level VL is the lowest voltage level of voltages inputted to the D/A converter circuit. The voltage level VH is the highest voltage level of voltages inputted to the D/A converter circuit.

In this embodiment, level between the voltage level VH and the voltage level VL is divided equally into four to obtain voltage level of 4 gradation. With each ascent in the gradation voltage level, the voltage level is increased by $\alpha$ (that is, $\alpha=(VH-VL)/4$). Therefore, the gradation voltage level outputted from the D/A converter circuit of this embodiment takes VL when the address of the digital video data is (00), VL+$\alpha$ when the address of the digital video data is (01), VL+2$\alpha$ when the address of the is digital video data is (10), and VL+3$\alpha$ when the address of the digital video data is (11).

The D/A converter circuit of this embodiment can output four patterns of gradation voltage levels, namely VL, VL+$\alpha$, VL+2$\alpha$ and VL+3$\alpha$, as described above. Then combining them with the time gradation display, the present invention may increase the number of gradation display levels for the display device. In this embodiment, information contained in 2 bit digital video data of the 4 bit digital video data is used for the time gradation display to obtain more finely divided, or increased gradation display levels where one gradation voltage level $\alpha$ is further divided equally into four levels. That is, the display device of this embodiment may acquire gradation display levels corresponding to gradation voltage levels of VL, VL+$\alpha$/4, VL+2$\alpha$/4, VL+3$\alpha$/4, VL+$\alpha$, VL+5$\alpha$/4, VL+6$\alpha$/4, VL+7$\alpha$/4, VL+2$\alpha$, VL+9$\alpha$/4, VL+10$\alpha$/4, VL+11$\alpha$/4 and VL+3$\alpha$.

The 4 bit digital video data address inputted from the external; time-gradation-processed digital video data address and corresponding gradation voltage level; and gradation display level combined with the time gradation are related in Table 1 below.

TABLE 1

| Digital Video Data Address | | Time-gradation-processed Digital Video Data Address (Gradation Voltage Level) | | | | Gradation Display Level Combined with |
|---|---|---|---|---|---|---|
| Upper | Lower | 1st Tsfl | 2nd Tsfl | 3rd Tsfl | 4th Tsfl | Time Gradation |
| 00 | 00 | 00 (VL) | 00 (VL) | 00 (VL) | 00 (VL) | VL |
| | 01 | 00 (VL) | 00 (VL) | 00 (VL) | 01 (VL + $\alpha$) | VL + $\alpha$/4 |
| | 10 | 00 (VL) | 00 (VL) | 01 (VL + $\alpha$) | 01 (VL + $\alpha$) | VL + 2$\alpha$/4 |
| | 11 | 00 (VL) | 01 (VL + $\alpha$) | 01 (VL + $\alpha$) | 01 (VL + $\alpha$) | VL + 3$\alpha$/4 |
| 01 | 00 | 01 (VL + $\alpha$) | 01 (VL + $\alpha$) | 01 (VL + $\alpha$) | 01 (VL + $\alpha$) | VL + $\alpha$ |
| | 01 | 01 (VL + $\alpha$) | 01 (VL + $\alpha$) | 01 (VL + $\alpha$) | 10 (VL + 2$\alpha$) | VL + 5$\alpha$/4 |
| | 10 | 01 (VL + $\alpha$) | 01 (VL + $\alpha$) | 10 (VL + 2$\alpha$) | 10 (VL + 2$\alpha$) | VL + 6$\alpha$/4 |
| | 11 | 01 (VL + $\alpha$) | 10 (VL + 2$\alpha$) | 10 (VL + 2$\alpha$) | 10 (VL + 2$\alpha$) | VL + 7$\alpha$/4 |
| 10 | 00 | 10 (VL + 2$\alpha$) | 10 (VL + 2$\alpha$) | 10 (VL + 2$\alpha$) | 10 (VL + 2$\alpha$) | VL + 2$\alpha$ |
| | 01 | 10 (VL + 2$\alpha$) | 10 (VL + 2$\alpha$) | 10 (VL + 2$\alpha$) | 11 (VL + 3$\alpha$) | VL + 9$\alpha$/4 |
| | 10 | 10 (VL + 2$\alpha$) | 10 (VL + 2$\alpha$) | 11 (VL + 3$\alpha$) | 11 (VL + 3$\alpha$) | VL + 10$\alpha$/4 |
| | 11 | 10 (VL + 2$\alpha$) | 11 (VL + 3$\alpha$) | 11 (VL + 3$\alpha$) | 11 (VL + 3$\alpha$) | VL + 11$\alpha$/4 |
| 11 | 00 | 11 (VL + 3$\alpha$) | 11 (VL + 3$\alpha$) | 11 (VL + 3$\alpha$) | 11 (VL + 3$\alpha$) | VL + 3$\alpha$ |
| | 01 | 11 (VL + 3$\alpha$) | 11 (VL + 3$\alpha$) | 11 (VL + 3$\alpha$) | 11 (VL + 3$\alpha$) | VL + 3$\alpha$ |
| | 10 | 11 (VL + 3$\alpha$) | 11 (VL + 3$\alpha$) | 11 (VL + 3$\alpha$) | 11 (VL + 3$\alpha$) | VL + 3$\alpha$ |
| | 11 | 11 (VL + 3$\alpha$) | 11 (VL + 3$\alpha$) | 11 (VL + 3$\alpha$) | 11 (VL + 3$\alpha$) | VL + 3$\alpha$ |

The display device of this embodiment carries out display by dividing one frame period Tf into four sub-frame periods (1st Tsf, 2nd Tsf, 3rd Tsf and 4th Tsf). As the line sequential driving is conducted in the display device of this embodiment, gradation voltage is written in each pixel during the one line period (Tsfl). Therefore, during sub-frame line periods (1st Tsfl, 2nd Tsfl, 3rd Tsfl and 4th Tsfl) corresponding to the sub-frame periods (1st Tsf, 2nd Tsf, 3rd Tsf and 4th Tsf), the address of time-gradation-processed 2 bit digital video data is inputted to the D/A converter circuit, which outputs gradation voltage. With the gradation voltage written during four sub-frame line periods (1st Tsfl, 2nd Tsfl, 3rd Tsfl and 4th Tsfl), four sub-frames are displayed at a high speed. As a result, one frame of gradation display corresponds to a value obtained by totaling the gradation voltage levels in the sub-frame line periods and then time-averaging the total.

As shown in Table 1, in this embodiment, same gradation voltage level (VL+3$\alpha$) is outputted when the address of the 4 bit digital video data is (1100) to Thus the display of $2_{4-3=13}$ gradation levels can be performed in the display device of this embodiment also when the D/A converter circuit for handling 2 bit digital video data is used.

Figure 6:
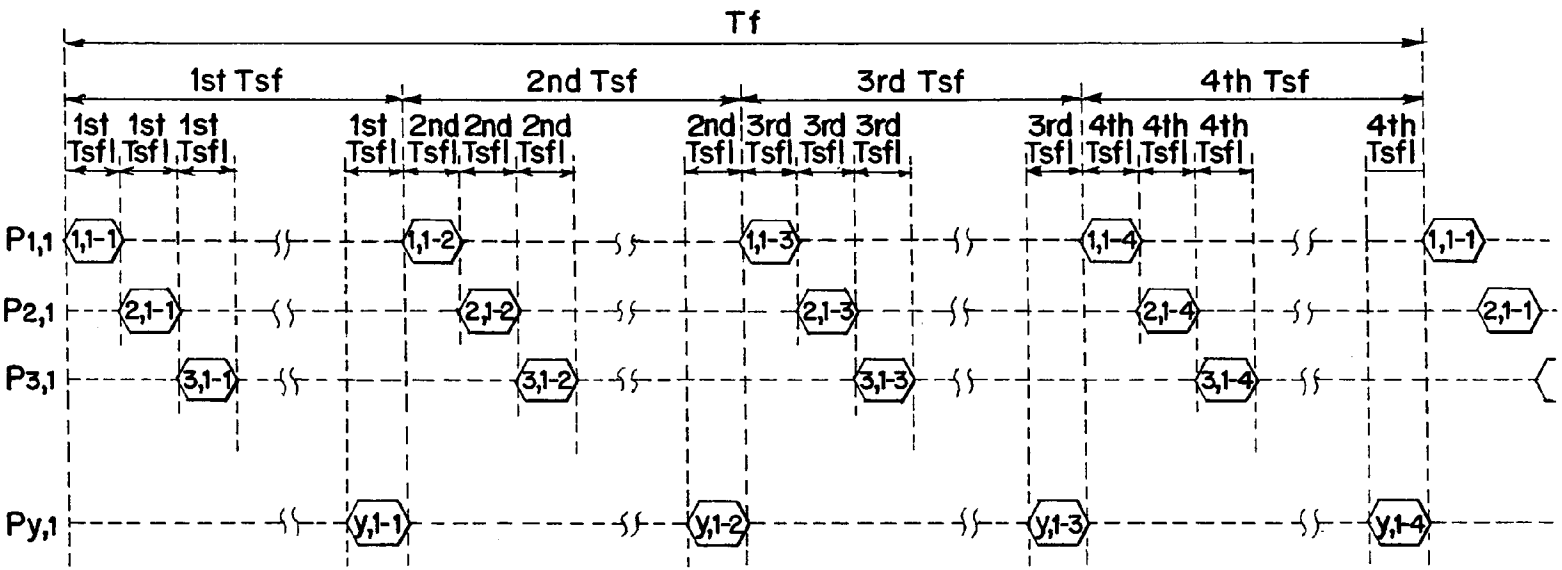
FIG. 6 is a diagram showing a drive timing chart of a display device according to Embodiment 1.

FIG. 6 shows a drive timing chart for the display device of this embodiment. The pixels P1,1 to Py,1 are taken as an example in FIG. 6.

Look at the pixel P1,1. During the sub-frame line periods (1st Tsfl, 2nd Tsfl, 3rd Tsfl and 4th Tsfl), digital video data 1,1-1, 1,1-2, 1,1-3 and 1,1-4 are respectively written in the pixel P1,1. The digital video data 1,1-1, 1,1-2, 1,1-3 and 1,1-4 are 2 bit digital video data obtained by time-gradation-processing the 4 bit digital video data 1,1.

Such operation is performed on all the pixels.

Figure 7:
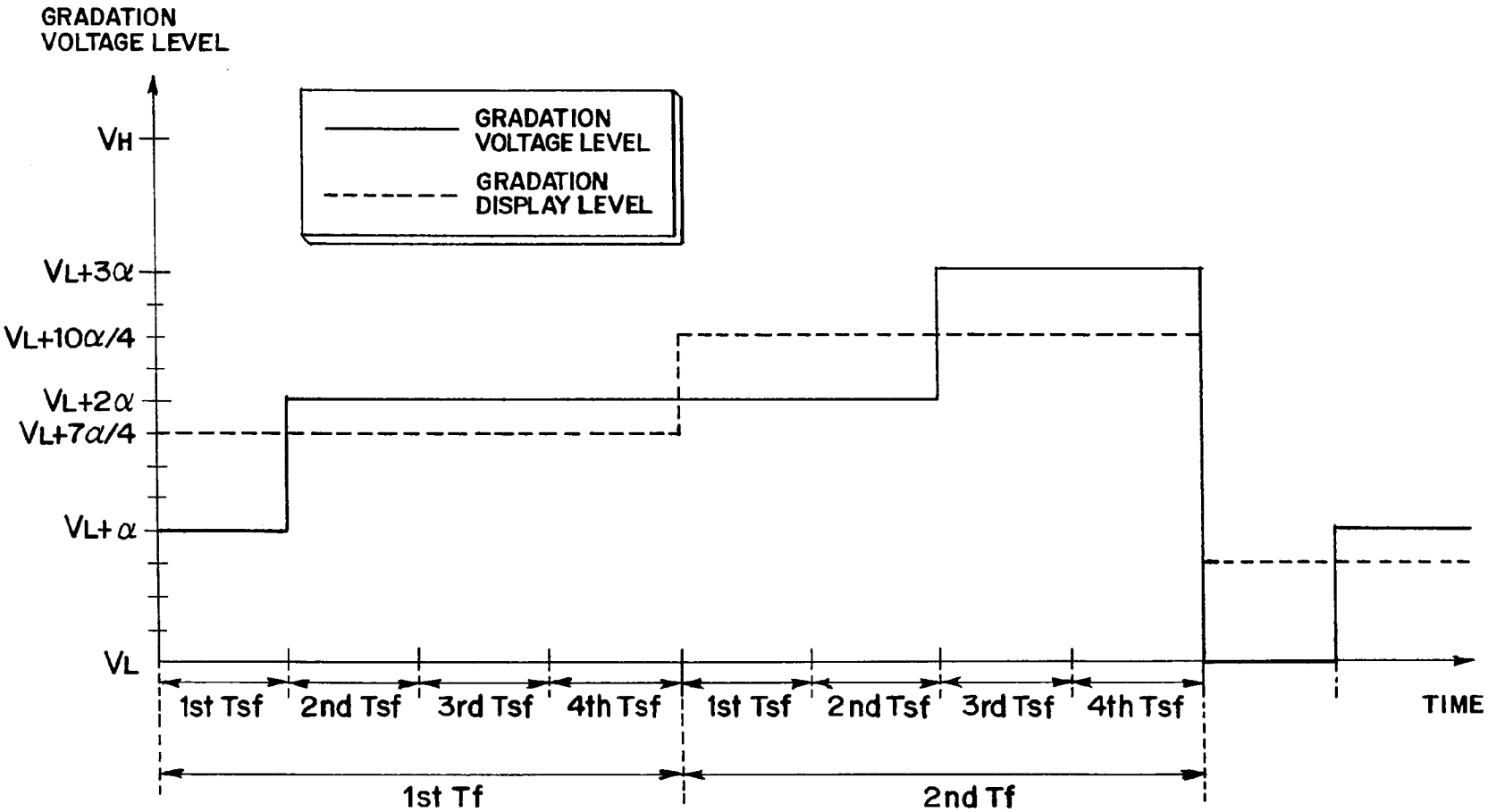
FIG. 7 is a diagram showing a drive timing chart of a display device according to Embodiment 1.

Here, reference is made to FIG. 7, which shows the relationship between the gradation voltage level to be written in a certain pixel (pixel P1,1, for example) and the sub-frame periods and the frame periods.

Taking notice of the former-half of the frame periods in the drawing, a gradation voltage of VL+$\alpha$ is written during the first sub-frame line period (1st Tsfl) and an image corresponding to the gradation voltage of VL+$\alpha$ is displayed during the first sub-frame period (1st Tsf). Then, a gradation voltage of VL+2$\alpha$ is written during the second sub-frame line period (2nd Tsfl) and an image corresponding to the gradation voltage of VL+2$\alpha$ is displayed during the second sub-frame period (2nd Tsf). Subsequently, a gradation voltage of VL+2α is written during the third sub-frame line period (3rd Tsfl) and an image corresponding to the gradation voltage of VL+2α is displayed during the third sub-frame period (3rd Tsf). Thereafter, a gradation voltage of VL+2α is written during the fourth sub-frame line period (4th Tsfl) and an image corresponding to the gradation voltage of VL+2α is displayed during the fourth sub-frame period (4th Tsf). The gradation display level in the former-half of the frames, therefore, corresponds to the gradation voltage level of VL+7α/4.

Turning next to the latter-half of the 2ndS frame periods, a gradation voltage of VL+2α is written during the first sub-frame line period (1st Tsfl) and an image corresponding to the gradation voltage of VL+2α is displayed during the first sub-frame period (1st Tsf). Then, a gradation voltage of VL+2α is written during the second sub-frame line period (2nd Tsfl) and an image corresponding to the gradation voltage of VL+2α is displayed during the second sub-frame period (2nd Tsf). Subsequently, a gradation voltage of VL+3α is written during the third sub-frame line period (3rd Tsfl) and an image corresponding to the gradation voltage of VL+3α is displayed during the third sub-frame period (3rd Tsf). Thereafter, a gradation voltage of VL+3α is written during the fourth sub-frame line period (4th Tsfl) and an image corresponding to the gradation voltage of VL+3α is displayed during the fourth sub-frame period (4th Tsf). The gradation display level in the latter-half of the frames, therefore, corresponds to the gradation voltage level of VL+10α/4.

Thus, it is understood that thirteen patterns of gradation display can be performed.

In this embodiment, in order to obtain the voltage level of four gradation, the level between the voltage level VH and the voltage level VL are divided equally into four each having the value α. However, the present invention is still effective if the level between the voltage level VH and the voltage level VL is not divided equally but irregularly.

Though the gradation voltage level written during the sub-frame line periods is set as shown in Table 1 in this embodiment, it may be set as shown in Table 2.

TABLE 2

| Digital Video Data Address | | Time-gradation-processed Digital Video Data Address (Gradation Voltage Level) | | | | Gradation Display Level Combined with |
|---|---|---|---|---|---|---|
| Upper | Lower | 1st Tsfl | 2nd Tsfl | 3rd Tsfl | 4th Tsfl | Time Gradation |
| 00 | 00 | 00 (VL) | 00 (VL) | 00 (VL) | 00 (VL) | VL |
| | 01 | 01 (VL + α) | 00 (VL) | 00 (VL) | 00 (VL) | VL + α/4 |
| | 10 | 01 (VL + α) | 01 (VL + α) | 00 (VL) | 00 (VL) | VL + 2α/4 |
| | 11 | 01 (VL + α) | 01 (VL + α) | 01 (VL + α) | 00 (VL) | VL + 3α/4 |
| 01 | 00 | 01 (VL + α) | 01 (VL + α) | 01 (VL + α) | 01 (VL + α) | VL + α |
| | 01 | 10 (VL + 2α) | 01 (VL + α) | 01 (VL + α) | 01 (VL + α) | VL + 5α/4 |
| | 10 | 10 (VL + 2α) | 10 (VL + 2α) | 01 (VL + α) | 01 (VL + α) | VL + 6α/4 |
| | 11 | 10 (VL + 2α) | 10 (VL + 2α) | 10 (VL + 2α) | 01 (VL + α) | VL + 7α/4 |
| 10 | 00 | 10 (VL + 2α) | 10 (VL + 2α) | 10 (VL + 2α) | 10 (VL + 2α) | VL + 2α |
| | 01 | 11 (VL + 3α) | 10 (VL + 2α) | 10 (VL + 2α) | 10 (VL + 2α) | VL + 9α/4 |
| | 10 | 11 (VL + 3α) | 11 (VL + 3α) | 10 (VL + 2α) | 10 (VL + 2α) | VL + 10α/4 |
| | 11 | 11 (VL + 3α) | 11 (VL + 3α) | 11 (VL + 3α) | 10 (VL + 2α) | VL + 11α/4 |
| 11 | 00 | 11 (VL + 3α) | 11 (VL + 3α) | 11 (VL + 3α) | 11 (VL + 3α) | VL + 3α |
| | 01 | 11 (VL + 3α) | 11 (VL + 3α) | 11 (VL + 3α) | 11 (VL + 3α) | VL + 3α |
| | 10 | 11 (VL + 3α) | 11 (VL + 3α) | 11 (VL + 3α) | 11 (VL + 3α) | VL + 3α |
| | 11 | 11 (VL + 3α) | 11 (VL + 3α) | 11 (VL + 3α) | 11 (VL + 3α) | VL + 3α |

The address (or gradation voltage level) of the digital video data written during the sub-frame line periods (1st Tsfl, 2nd Tsfl, 3rd Tsfl and 4th Tsfl) may be set using a combination other than the combinations shown in Tables 1 and 2.

In this embodiment, of the 4 bit digital video data inputted from the external, upper 2 bit digital video data is converted into 2 bit digital video data for gradation voltage and gradation information of lower 2 bit digital video data of the 4 bit digital video data is expressed in time gradation. Now, consider a general example where upper n bit digital video data of m bit digital video data from the external is converted into digital video data for gradation voltage by a time gradation processing circuit while gradation information of lower (m−n) bit data thereof is expressed in time gradation. The symbol m and n are both integer equal to or larger than 2 and satisfy m>n.

In this case, the relationship between frame period (Tf) and sub-frame period (Tsf) is expressed as follows:

$$Tf=2^{m-n}\cdot Tsf$$

Therefore, $(2^m-(2^{m-n}-1))$ patterns of gradation display is obtained.

The symbol m and n may take 12 and 4, respectively.

Embodiment 2

Figure 8:
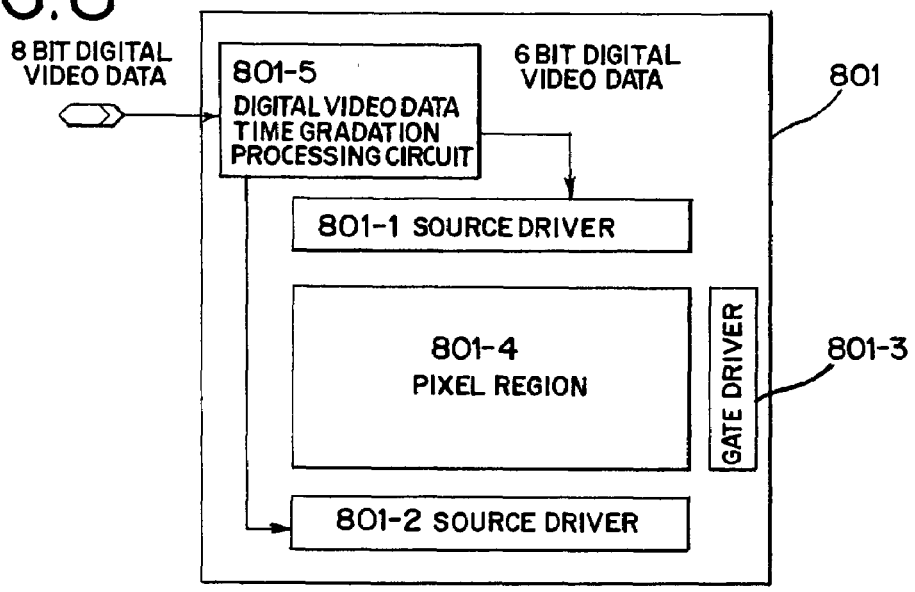
FIG. 8 is a structural diagram schematically showing a display device according to Embodiment 2 of the invention.

A description given in this embodiment is about a display device to which 8 bit digital video data is inputted. Reference is made to FIG. 8 which schematically shows the structure of the display device of this embodiment. Reference numeral 801 denotes a display device having digital drivers. Denoted by 801-1, 801-2 are source drivers; 801-3, a gate driver; 801-4, a pixel region with a plurality of pixel TFTs arranged in matrix; and 801-5, a digital video data time gradation processing circuit.

The digital video data time gradation processing circuit 801-5 converts, of 8 bit digital video data inputted from the external, 6 bit digital video data into 6 bit digital video data for gradation voltage. Gradation information of 2 bit digital video data of the 8 bit digital video data is expressed in time gradation.

The 6 bit digital video data converted by the digital video data time gradation processing circuit 801-5 is inputted to the source drivers 801-1, 801-2, converted into analogue gradation voltage by D/A converter circuits (not shown) within the source drivers, and sent to each source signal line. The D/A converter circuits incorporated in the display device of this embodiment converts 6 bit digital video data into analogue gradation voltage.

In the display device of this embodiment, the source drivers 801-1, 801-2, the gate driver 801-3, the pixel region 801-4 and the digital video data time gradation processing circuit 801-5 are formed and integrated on the same substrate.

Figure 9:
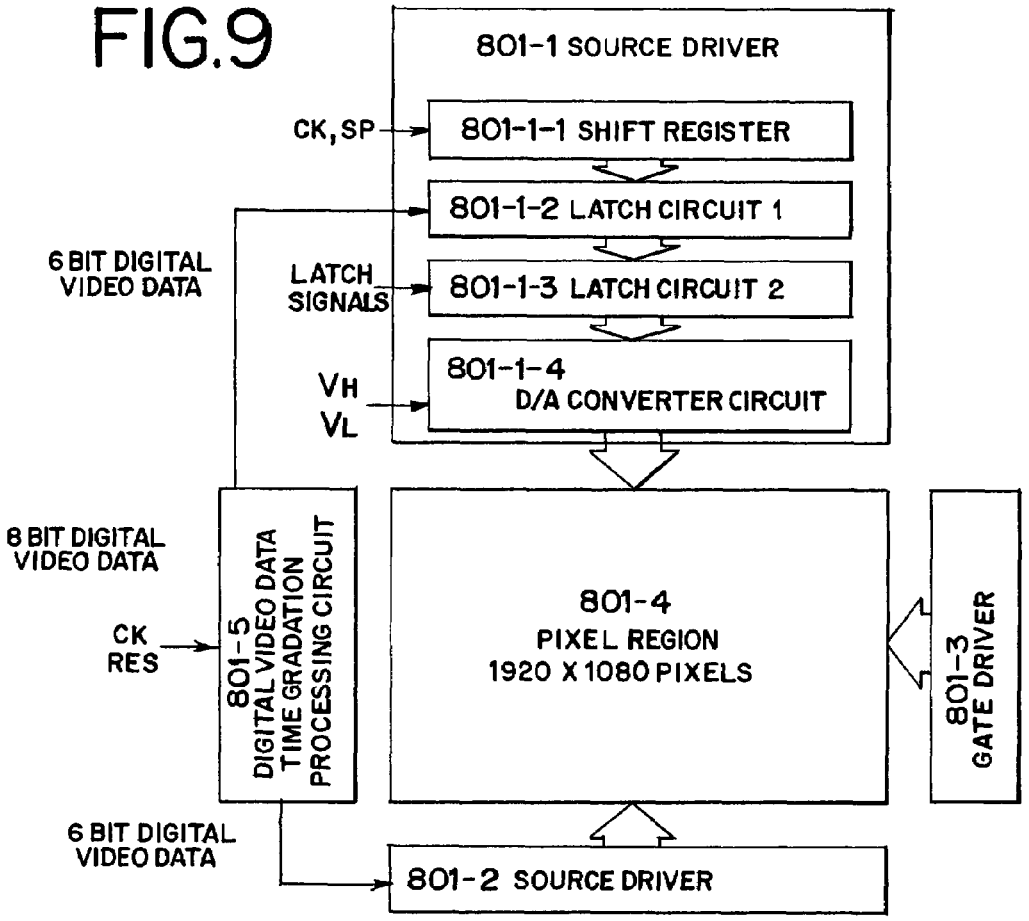
FIG. 9 is a structural diagram schematically showing a display device according to Embodiment 2.

Now take a look at FIG. 9. FIG. 9 shows more detailed circuit structure of the display device of this embodiment. The source driver 801-1 includes a shift register circuit 801-1-1, a latch circuit 1 (801-1-2), a latch circuit 2 (801-1-3), and a D/A converter circuit (801-1-4). Other than those, the source driver includes a buffer circuit and a level shifter circuit (neither is shown). For the convenience in explanation, the D/A converter circuit 801-1-4 assumedly includes a level shifter circuit.

The source driver 801-2 has the same structure as that of the source driver 801-1. The source driver 801-1 sends a video signal (gradation voltage) to odd-numbered source signal lines and the source driver 801-2 sends a video signal to even-numbered source signal lines.

In the active matrix type display device of this embodiment, to suit the convenience of the circuit layout, two source drivers 801-1, 801-2 are arranged sandwiching vertically the pixel region. However, only one source driver may be used if that is possible in view of the circuit layout.

The gate driver 801-3 includes a shift register circuit, a buffer circuit, a level shifter circuit, etc (all of which are not shown).

The pixel region 801-4 contains 1920 (in width)×1080 (in length) pixels. Each pixel has the structure similar to the one described in the above Embodiment 1.

The display device of this embodiment has the D/A converter circuit 801-1-4 that processes 6 bit digital video data. Information contained in lower 2 bit data of 8 bit digital video data inputted from the external is used for time gradation. The time gradation is the same as in the above Embodiment 1.

Therefore, the display device of this embodiment can perform $2^8-3=253$ patterns of gradation display.

Embodiment 3

Figure 10:
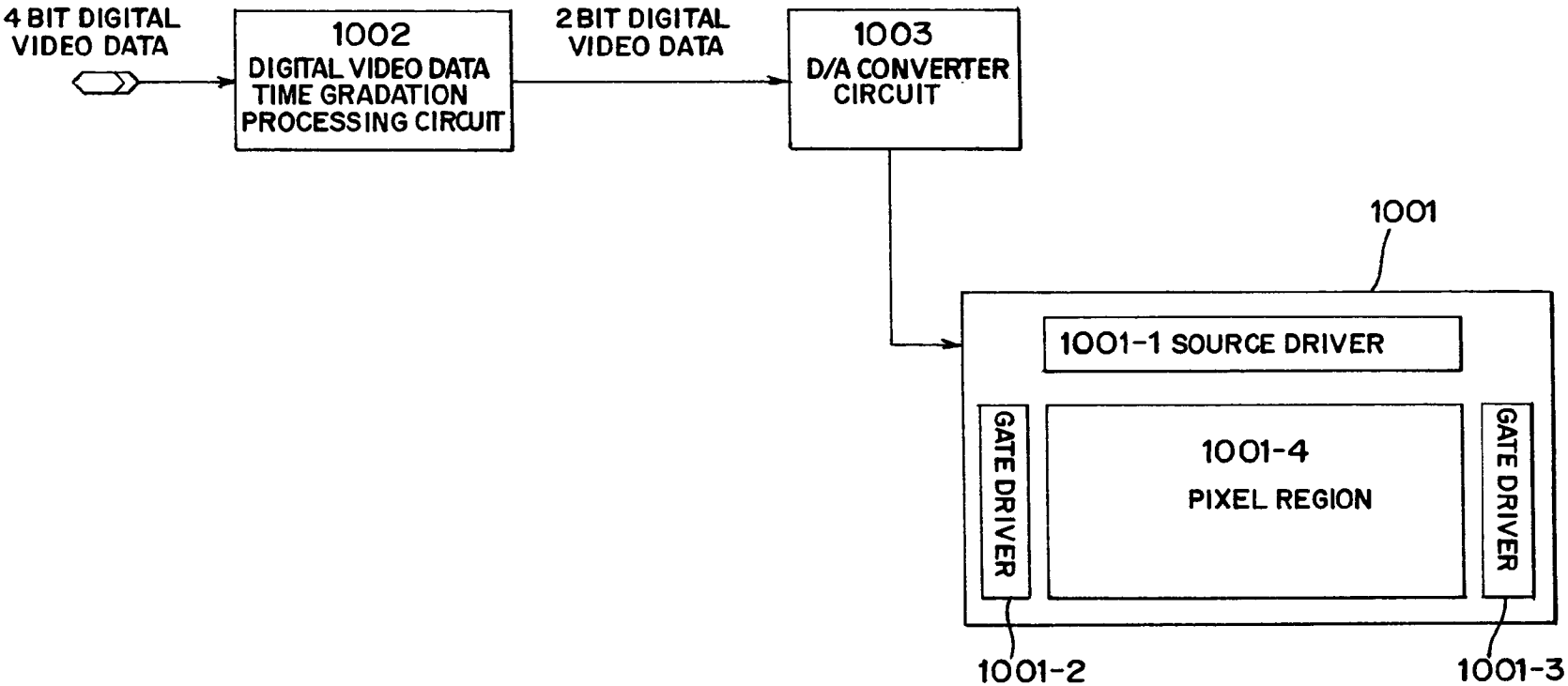
FIG. 10 is a structural diagram schematically showing a display device according to Embodiment 3 of the invention.

In FIG. 10, reference numeral 1001 denotes a display panel having analogue drivers. Denoted by 1001-1 is a source driver, 1001-2, 1001-3, gate drivers, 1001-4, a pixel region with a plurality of pixel TFTs arranged in matrix.

A digital video data time gradation processing circuit 1002 converts, of 4 bit digital video data inputted from the external, upper 2 bit digital video data into 2 bit digital video data for gradation voltage. The gradation information of lower 2 bit data of the 4 bit digital video data is expressed in time gradation.

The upper 2 bit digital video data converted by the digital video data time gradation processing circuit 1002 is inputted to a D/A converter circuit 1003 and converted into analogue video data. Then the analogue video data is inputted to the display panel 1001.

Figure 11:
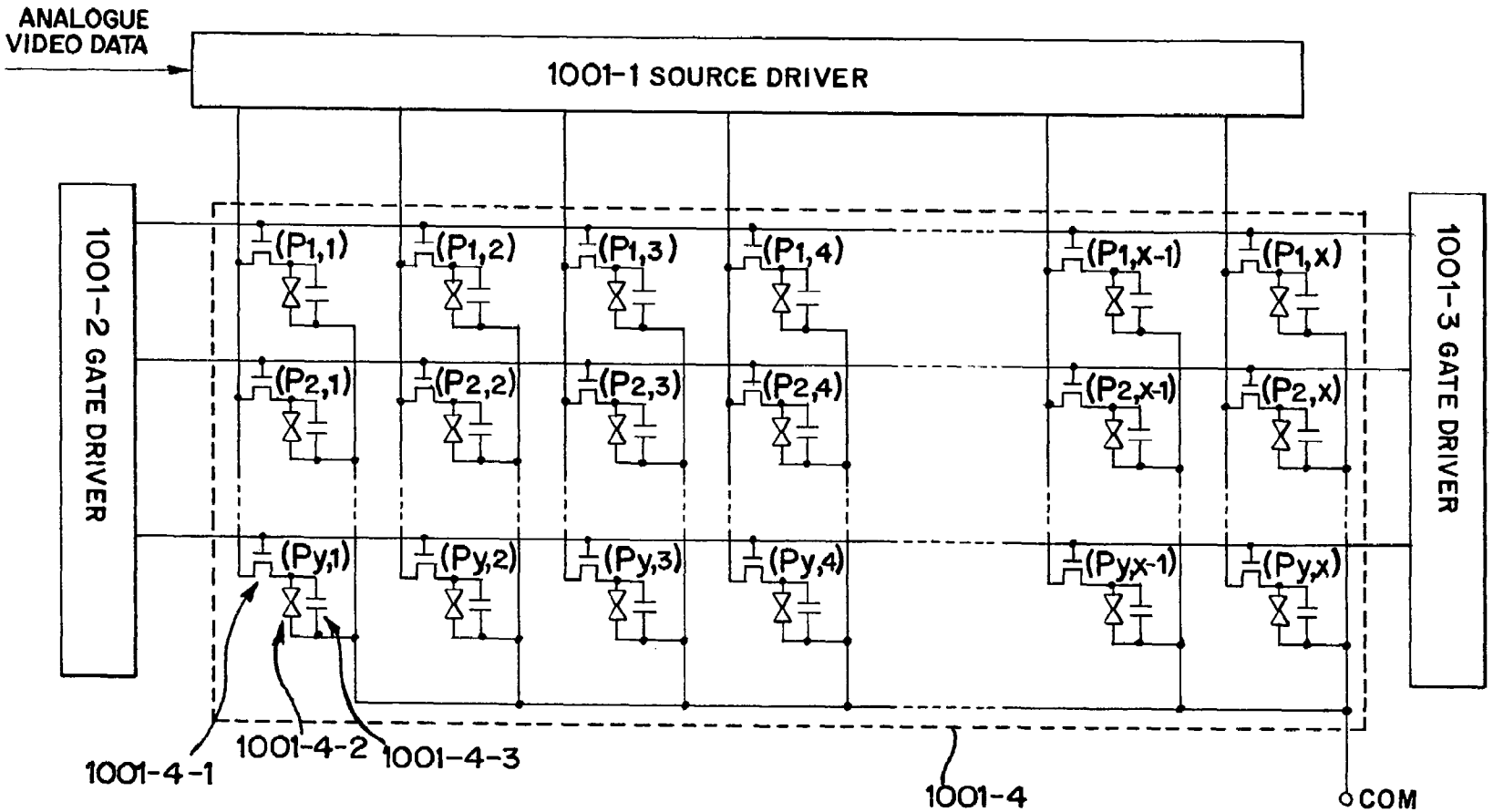
FIG. 11 is a diagram showing the circuit structure of a liquid crystal display device according to Embodiment 3.

Here, when the display device of this embodiment is a liquid crystal display device, a description is given with reference to FIG. 11 on the circuit structure of the display panel (liquid crystal panel) 1001, in particular, the pixel region 1001-4.

The pixel region 1001-4 has (x×y) pieces of pixels. For convenience's sake in explanation, each pixel is designated by a symbol such as P1,1, P2,1, . . . , and Py,x. Also, each pixel has a pixel TFT 1001-4-1 and a storage capacitor 1001-4-3. Liquid crystal is held between an active matrix substrate, on which the source driver 1001-1, the gate drivers 1001-2, 1001-3 and the pixel region 1001-4 are formed, and an opposite substrate. Liquid crystal 1001-4-2 schematically shows the liquid crystal for each of the pixel.

The analogue driver display panel of this embodiment drives one pixel after another, namely, performs dot sequential driving. A time required to write analogue gradation voltage in all pixels (P1,1 to Py,x) is named here one frame period (Tf). One frame period (Tf) is divided into four periods, which are referred to as sub-frame periods (Tsf). Further, a time required to write analogue gradation voltage in one pixel (e.g., P1,1, P1,2, . . . , P1,x) is called one sub-frame dot periods (Tsfd).

Gradation display with the display device of this embodiment will be described. The digital video data sent from the external to the display device of this embodiment is 4 bit and contains information of 16 gradation. The gradation display level for the display device of this embodiment is similar to the one shown in FIG. 5, so see FIG. 5.

Figure 12:
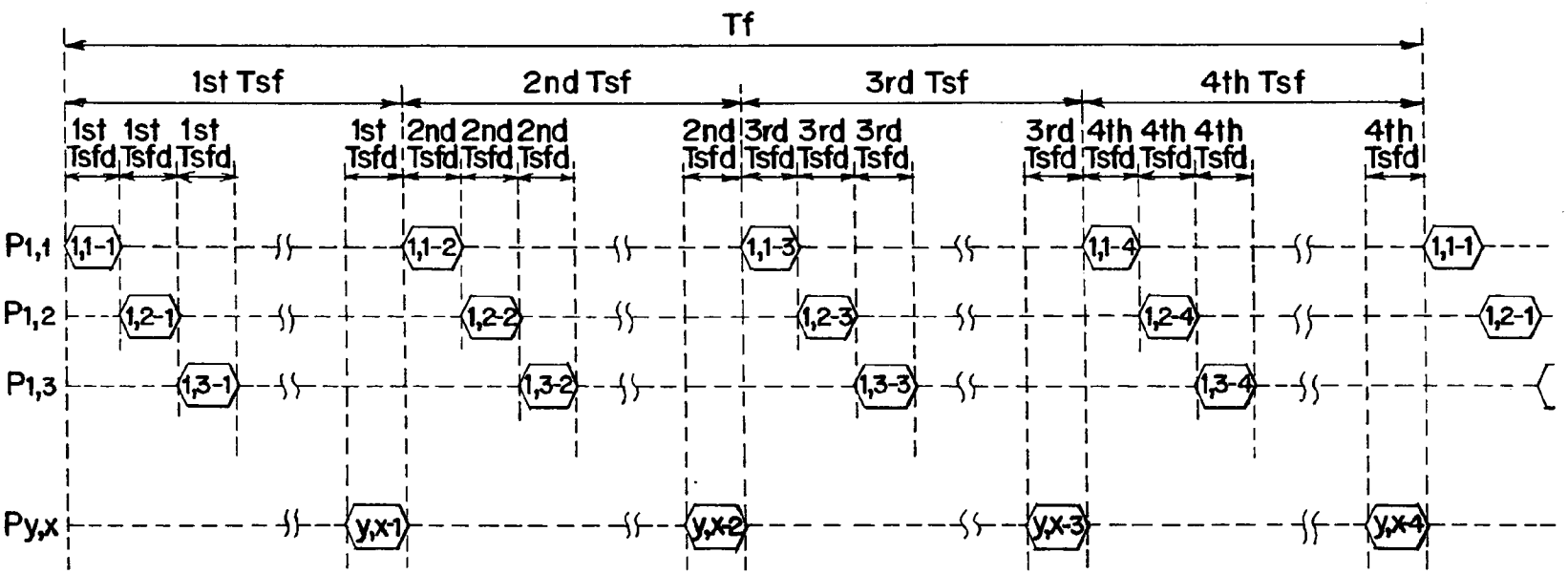
FIG. 12 is a diagram showing a drive timing chart of a display device according to Embodiment 3.

FIG. 12 shows a drive timing chart for the display device of this embodiment. The pixels P11,1, P1,2, P1,3 and Py,x are taken as an example in FIG. 12.

Look at the pixel P1,1. During the sub-frame dot periods (1st Tsfd, 2nd Tsfd, 3rd Tsfd and 4th Tsfd), digital video data 1,1-1, 1,1-2, 1,1-3 and 1,1-4 are written in the pixel P1,1. The digital video data 1,1-1, 1,1-2, 1,1-3 and 1,1-4 are analogue video data obtained by analogue-converting 2 bit digital video data which has been obtained by time-gradation-processing the 4 bit digital video data 1,1.

Such operation is performed on all the pixels.

Therefore, also the display device of this embodiment is capable of thirteen patterns of gradation display as in the above Embodiment 1.

When analogue video data is inputted from the external to the display device of this embodiment, analogue video data to be inputted is converted into digital video data and the converted data is inputted to the digital video data time gradation processing circuit 1002.

Again here in this embodiment a general example is considered in which, of m bit digital video data sent from the external, upper n bit digital video data is converted into digital video data for gradation voltage by a time gradation processing circuit, and gradation information of lower (m−n) bit data is expressed in time gradation. The symbols m and n are both integer equal to or larger than 2 and satisfy m>n.

In this case, the relationship between frame period (Tf) and sub-frame period (Tsf) is expressed as follows:

$$Tf=2^{m-n}\cdot Tsf$$

Therefore, $(2^m-(2^{m-n}-1))$ patterns of gradation display is obtained.

Embodiment 4

This embodiment will give an explanation on an example of a manufacturing process for the liquid crystal display device (or liquid crystal panel) of the present invention described in the above Embodiments 1 to 3. Shown in this embodiment with reference to FIGS. 13A to 16C is an example where a plurality of TFTs are formed on a substrate having an insulating surface, and a pixel region, and a source driver, a gate driver and other peripheral circuits are formed on the same substrate. In the example below, how to form a pixel TFT that is a part of the pixel region simultaneously with the formation of a CMOS circuit that is a basic circuit of other circuits (including the source driver, the gate driver and the other peripheral circuits) is shown. The description of the example below deals with the manufacturing process for the case where a P channel type TFT and an N channel type TFT in the CMOS circuit each have one gate electrode. However, another CMOS circuit consisting of TFTs which have a plurality of gate electrodes, e.g., a double gate type TFT and a triple gate type TFT, may be manufactured in the same manner. Although a pixel TFT in the example below is a double gate N channel type TFT, it may be replaced by a single gate TFT or a triple gate TFT. A digital video data time gradation processing circuit may be formed simultaneously as in the liquid crystal display device of the above Embodiment 2.

Figure 13A:
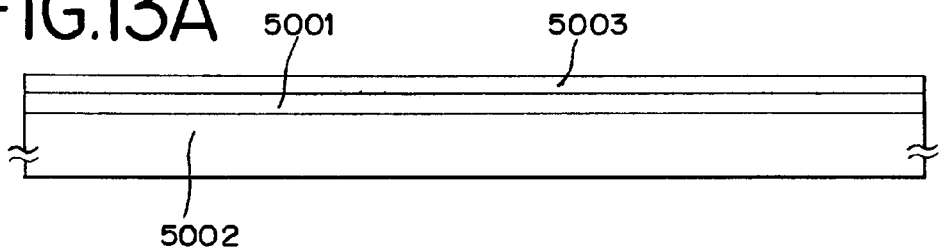
FIGS. 13A to 13E are diagrams showing an example of a manufacturing process of a liquid crystal display device according to Embodiment 4 of the invention.

Reference is made to FIG. 13A. First, a quartz substrate 5000 is prepared as the substrate having an insulating surface. A silicon substrate on which a thermal oxide film is formed may be used instead of the quartz substrate. An alternative way may be taken in which an amorphous silicon film is once formed on the quartz substrate to thermally and completely oxidize the film, forming an insulating film. Also, a quartz substrate, a ceramic substrate or a silicon substrate on which a silicon nitride film is formed as an insulating film may be used. A base film 5001 is next formed. This embodiment uses silicon oxide ($SiO_2$) for the base film 5001. Then an amorphous silicon film 5003 is formed. The amorphous silicon film 5003 is adjusted to have a final film thickness (a thickness determined by taking into consideration the thinning of the film after the thermal oxidation) of 10 to 75 nm (preferably 15 to 45 nm).

It is important to throughly control the impurity concentration in the film when depositing the amorphous silicon film 5003. In this embodiment, the concentration of impurities C (carbon), N (nitrogen) and O (oxygen), which inhibit later crystallization, in the amorphous silicon film 5003 is controlled so that the concentration of C and the concentration of N are both less than $5\times10^{18}$ atoms/cm$^3$ (typically $5\times10^{17}$ atoms/cm$^3$ or less, preferably $2\times10^{17}$ atoms/cm$^3$ or less) and the concentration of O is less than $1.5\times10^{19}$ atoms/cm$^3$ (typically $1\times10^{18}$ atoms/cm$^3$ or less, preferably $5\times10^{17}$ atoms/cm$^3$ or less). This is because a larger concentration of impurities than above affect later crystallization, causing decrease in the film quality after the crystallization. The above impurity element concentration in the film is defined by the minimal value in the measurement result of SIMS (secondary ion mass spectroscopy) in this specification.

To meet the condition above, it is desirable to periodically conduct dry cleaning on a low pressure thermal CVD furnace used in this embodiment to purify a film formation chamber. The dry cleaning of the film formation chamber is made such that 100 to 300 sccm of $ClF_3$ (chlorine fluoride) gas is introduced into the furnace heated up to about 200 to 400° C. and fluorine produced by thermal decomposition cleans the chamber.

Incidentally, according to the knowledge of the present applicant, deposit (mainly containing silicon) of about 2 μm in thickness can be completely removed in four hours when the temperature within the furnace is 300° C. and the flow rate of the $ClF_3$ gas is 300 sccm.

The hydrogen concentration in the amorphous silicon film 5003 is also a very important parameter, and it seems that lower hydrogen content leads to obtainment of a film with better crystallinity. Therefore, film formation of the amorphous silicon film 5003 is preferably carried out by low pressure thermal CVD. If optimizing the film formation conditions, plasma CVD may also be used.

Carried out next is a step of crystallizing the amorphous silicon film 5003.

As measures for crystallization, a technique disclosed in Japanese Patent Application Laid-open No. Hei 7-130652 is used. U.S. Pat. No. 5,643,826 corresponds to this Japanese Patent Application. An entire disclosure of U.S. Pat. No. 5,643,826 is incorporated herein by reference. Both Embodiment 1 or Embodiment 2 in the publication may be referred to for the technique. However, preferred one in this embodiment is the technical content (detailed in Japanese Patent Application Laid-Open No. Hei 8-78329) in Embodiment 2 of the publication. U.S. Pat. No. 5,648,277 corresponds to this Japanese Patent Application. An entire disclosure of U.S. Pat. No. 5,648,277 is incorporated herein by reference.

Figure 13B:
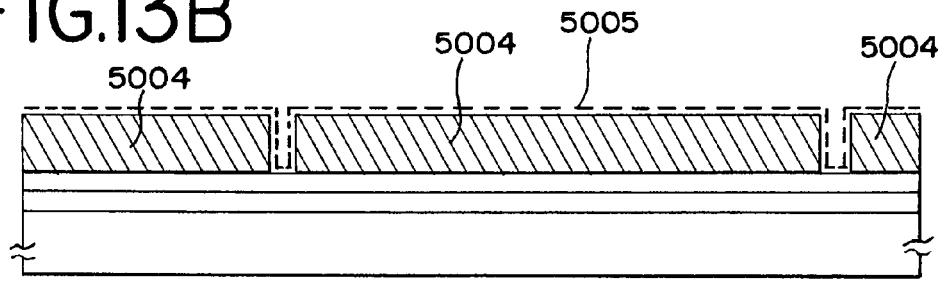

According to the technique disclosed in Japanese Patent Application Laid-Open No. Hei 8-78329, a mask insulating film 5004 for selecting a region to be added with a catalytic element is formed to have a thickness of 150 nm. The mask insulating film 5004 has openings for adding the catalytic element formed at plural positions. The position of a crystal region can be determined depending on the positions of these openings (FIG. 13B).

A solution (Ni ethanol acetate solution) 5005 containing nickel (Ni) as a catalytic element for facilitating the crystallization of the amorphous silicon film 5003 is applied by spin coating. Usable element as the catalytic element includes cobalt (Co), iron (Fe), palladium (Pd), germanium (Ge), platinum (Pt), copper (Cu), and gold (Au), other than nickel (FIG. 13B).

In the step of adding the catalytic element, ion implantation utilizing a resist mask or plasma doping may also be used. In this case, the area occupied by the added region is reduced and controlling the growth length of a lateral growth region to be described later is facilitated, making the technique effective for construction of minute circuits.

Figure 13C:
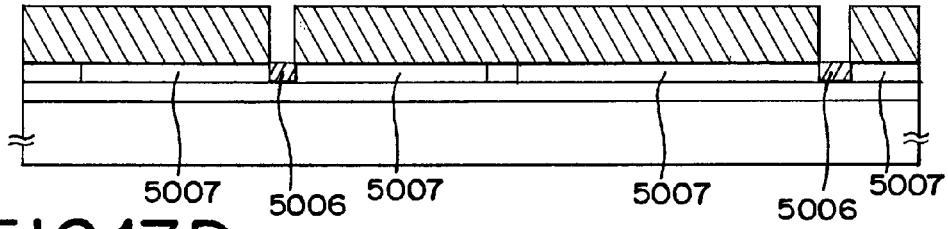

After completing the step of adding catalytic element, dehydrogenation is next conducted at 450° C. for about an hour. Then heat treatment is carried out in an inert atmosphere, hydrogen atmosphere or oxygen atmosphere at a temperature of 500 to 960° C. (typically 550 to 650° C.) for 4 to 24 hours to crystallize the amorphous silicon film 5003. The heat treatment in this embodiment is conducted in a nitrogen atmosphere at 570° C. for 14 hours (FIG. 13C).

At this point, the crystallization of the amorphous silicon film 5003 progresses preferentially from the nucleus generated in a nickel added region 5006, forming a crystal region 5007 which is a polycrystalline silicon film grown in parallel with the substrate surface of the substrate 5000. This crystal region 5007 is referred to as a lateral growth region. The lateral growth region, having crystal grains congregated in a relatively well aligned condition, has an advantage in that its crystallinity is excellent as a whole.

Alternatively, crystallization may be performed by applying the Ni acetate solution to the entire surface of the amorphous silicon film without using the mask insulating film 5004.

Figure 13D:
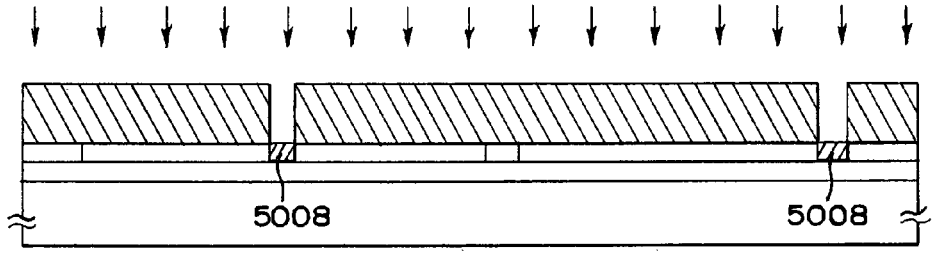

Referring to FIG. 13D, gettering process of the catalytic element is next carried out. First, phosphorus ion doping is selectively performed. The area is doped with phosphorus while covered with the mask insulating film 5004. Then only portions of the polycrystalline silicon film which are not covered with the mask insulating film 5004 and are denoted by 5008 are doped with phosphorus (these regions are called phosphorus doped regions). At this point, the acceleration voltage in the doping and the thickness of the mask comprising an oxide film are optimized to prevent phosphorus from breaking through the mask insulating film 5004. This mask insulating film 5004 is not necessarily made of an oxide film but the oxide film is convenient, for it does not cause contamination upon direct contact with an active layer.

The dose of phosphorus is preferably about $1\times10^{14}$ to $1\times10^{15}$ ions/cm$^2$. In this embodiment, the area is doped in a dose of $5\times10^{14}$ ions/cm$^2$ using an ion doping device.

The acceleration voltage in the ion doping is set to 10 keV. With 10 keV acceleration voltage, phosphorus hardly break through the mask insulating film of 150 nm thickness.

Figure 13E:
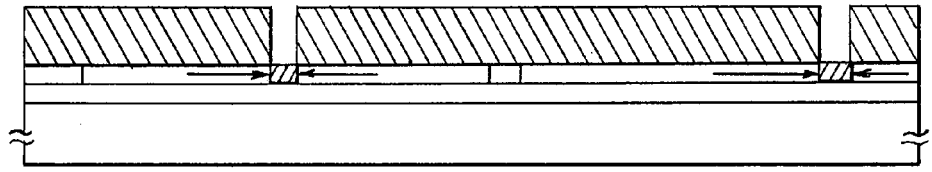

Turning to FIG. 13E, thermal annealing is carried out next in a nitrogen atmosphere at 600° C. for 1 to 12 hours (12 hours in this embodiment) to getter the nickel element. This makes nickel drawn to phosphorus, as indicated by the arrows in FIG. 13E. Phosphorus atoms barely move in the film at a temperature of 600° C. while nickel atoms can move along a distance of about several hundreds μm or more. It can be understood from this that phosphorus is one of the most suitable elements for gettering of nickel.

Figure 14A:
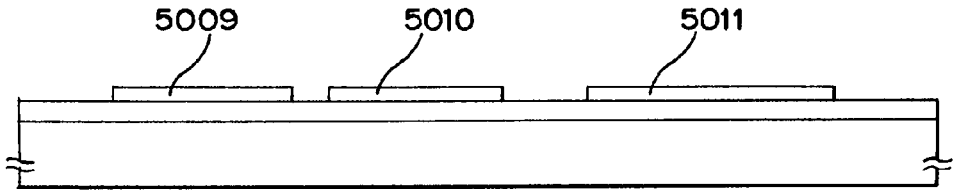
FIGS. 14A to 14C are diagrams showing an example of a manufacturing process of a liquid crystal display device according to Embodiment 4.

Referring next to FIG. 14A, a step of patterning the polycrystalline silicon film is described. The patterning is conducted caring not to leave the phosphorus added region 5008, namely, the region where nickel is gettered. Active layers 5009 to 5011 of the polycrystalline silicon film which scarcely contain the nickel element are thus obtained. The obtained active layers 5009 to 5011 of the polycrystalline silicon film later become active layers of the TFT.

Figure 14B:
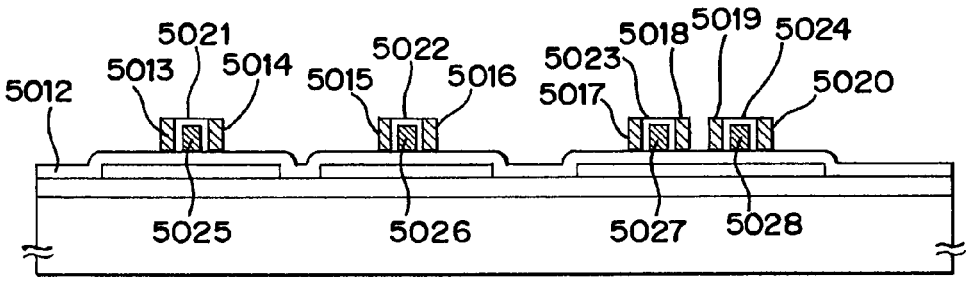
Figure 14C:
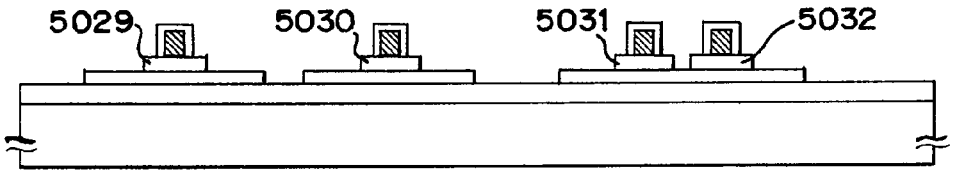

See FIG. 14B. After forming the active layers 5009 to 5011, a gate insulating film 5012 made of an insulating film containing silicon is formed thereon to have a thickness of 70 nm. In an oxygen atmosphere, heat treatment is carried out at a temperature of 800 to 1100° C. (preferably 950 to 1050° C.) to form thermal oxide films (not shown) at the interfaces between the gate insulating film 5012 and the respective active layers 5009 to 5011.

The heat treatment for gettering a catalytic element (gettering process for catalytic element) may be carried out at this stage. In that case, the halogen element is put in the treatment atmosphere of the heat treatment, utilizing the effect of gettering a catalytic element which the halogen element possesses. The heat treatment is preferably conducted at a temperature over 700° C. in order to make most of the gettering effect by the halogen element. At a temperature equal to or lower than 700° C., a halogen compound in the treatment atmosphere is difficult to decompose, accompanied by a fear of failing to obtain the gettering effect. A typical example of a halogen-containing gas usable in the heat treatment is one or plural kinds of halogen-containing compound selected from HCl, HF, $NF_3$, HBr, $Cl_2$, $ClF_3$, $BCl_2$, $F_2$, $Br_2$, etc. When HCl, for example, is used in this step, it is presumed that nickel in the active layers is gettered by the action of chlorine and transformed into volatile nickel chloride to be released into the air and removed from the layer. Alternatively, the gettering process for a catalytic element which employs the halogen element may be carried out after the removal of the mask insulating film 5004 and before the patterning of the active layers. The gettering process for a catalytic element may be instead put after patterning the active layers. The gettering processes may be conducted in combination.

Next, a not-shown metal film mainly containing aluminum is formed and patterned to form the model of a gate electrode to be formed later. In this embodiment, an aluminum film containing a 2 wt % of scandium is used.

The gate electrode may alternatively formed using a polycrystalline silicon film doped with an impurity for imparting conductivity.

Subsequently formed with the use of the technique described in Japanese Patent Application Laid-Open No. Hei 7-135318 are porous anodic oxide films 5013 to 5020, non-porous anodic oxide films 5021 to 5024 and gate electrodes 5025 to 5028 (FIG. 14B).

After thus obtaining the state shown in FIG. 14B, the gate insulating film 5012 is etched using as masks the gate electrodes 5025 to 5028 and the porous anodic oxide films 5013 to 5020. The porous anodic oxide films 5013 to 5020 are then removed, reaching the state shown in FIG. 14C. Incidentally, denoted in FIG. 14C by 5029 to 5031 are gate insulating films underwent the etching.

Figure 15A:
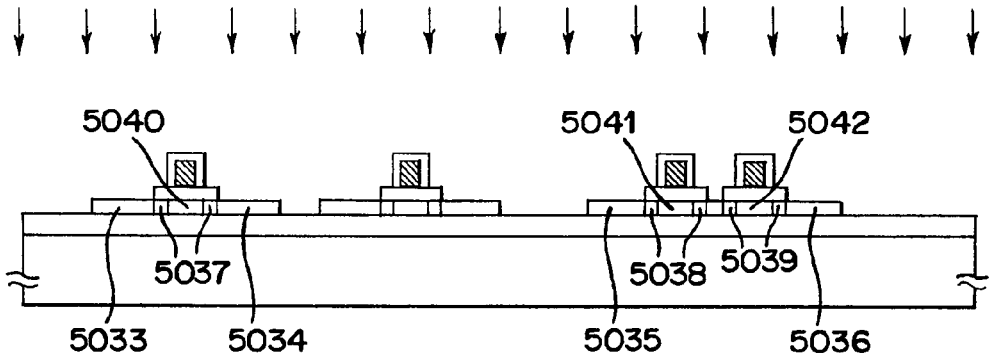
FIGS. 15A to 15C are diagrams showing an example of a manufacturing process of a liquid crystal display device according to Embodiment 4.

Referring to FIG. 15A, a doping step with an impurity element for imparting one of the conductivities will next be carried out. As the impurity element, P (phosphorus) or As (arsenic) may be used for an N channel type TFT and B (boron) or Ga (gallium) for P channel type.

In this embodiment, doping for forming the N channel type TFT and doping for forming the P channel type TFT are each divided into two steps.

Doping for forming the N channel type TFT is first carried out. The first half of the doping is conducted (using phosphorus in this embodiment) at a high acceleration voltage of about 80 keV to form an $n^-$ region. This $n^-$ region is adjusted to have a P ion concentration of $1\times10^{18}$ atoms/cm$^3$ to $1\times10^{19}$ atoms/cm$^3$.

The second half of the doping is conducted at a low acceleration voltage of about 10 keV to form an $n^+$ region. The acceleration voltage is low this time, so that the gate insulating film functions as a mask. This $n^+$ region is adjusted to have a sheet resistance of 500Ω or less (preferably 300Ω or less).

Formed through the above steps are a source region 5033, a drain region 5034, lightly doped regions 5037, a channel forming region 5040 of the N channel type TFT that constitutes the CMOS circuit. Also, a source region 5035, a drain region 5036, lightly doped regions 5038, 5039, channel forming regions 5041, 5042 of the N type channel type TFT constituting the pixel TFT are defined (FIG. 15A).

In the state shown in FIG. 15A, the active layer of the P channel type TFT constituting the CMOS circuit has the same structure as the active layer of the N channel type TFT.

Figure 15B:
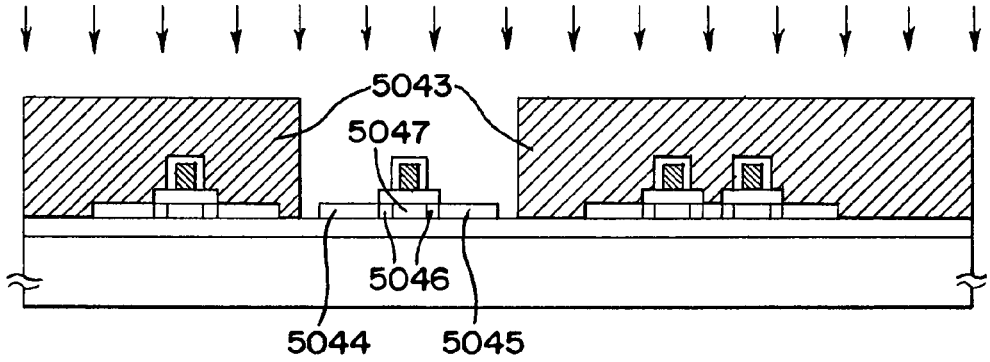

Next, as shown in FIG. 15B, resist masks 5043 are formed to cover the N channel type TFTs and doping with an impurity ion for imparting P type (boron in this embodiment) is carried out.

This doping is also divided into two steps as in the previously described doping. In this doping, however, it is required to invert the conductivity from N channel type to P channel type, demanding B (boron) ion doping in a concentration about several times the concentration of P ion used for the previous doping.

A drain region 5044, a source region 5045, lightly doped regions 5046 and a channel forming region 5047 of the P channel type TFT constituting the CMOS circuit are thus formed (FIG. 15B).

In the case where the gate electrode is formed using a polycrystalline silicon film doped with an impurity for imparting conductivity, a known side wall structure may be adopted to form the lightly doped region.

The impurity ions are then activated using combination of furnace annealing, laser annealing, lamp annealing, etc. Simultaneously, the damage done on the active layers in the doping step is repaired.

Figure 15C:
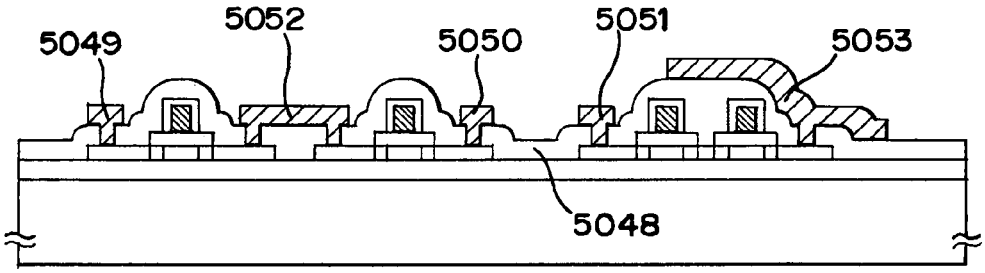

Turning to FIG. 15C, a lamination film in which a silicon oxide film and a silicon nitride film are layered is formed as a first interlayer insulating film 5048. After forming contact holes, source electrodes and drain electrodes 5049 to 5053 are formed. An organic resin film may also be used for the first interlayer insulating film 5048.

Figure 16A:
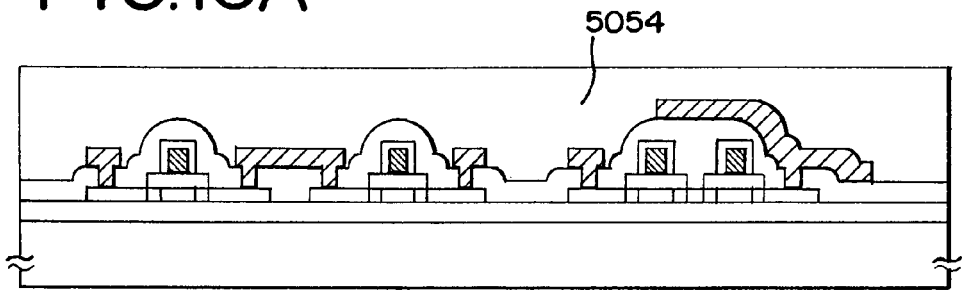
FIGS. 16A to 16C are diagrams showing an example of a manufacturing process of a liquid crystal display device according to the Embodiment 4.
Figure 16B:
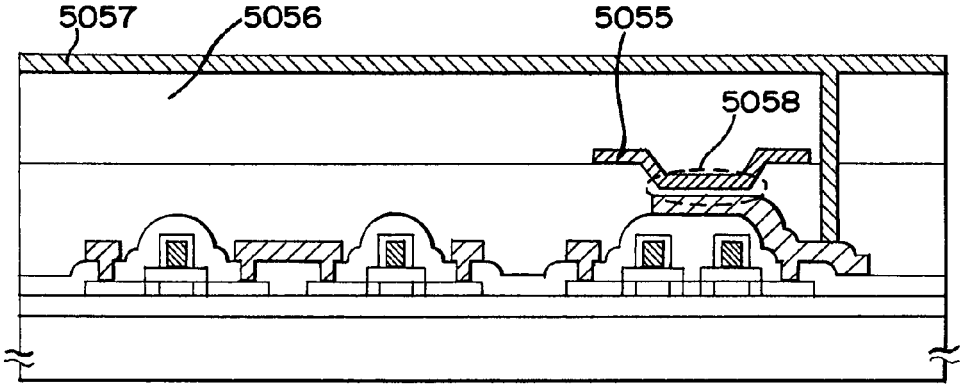
Figure 16C:
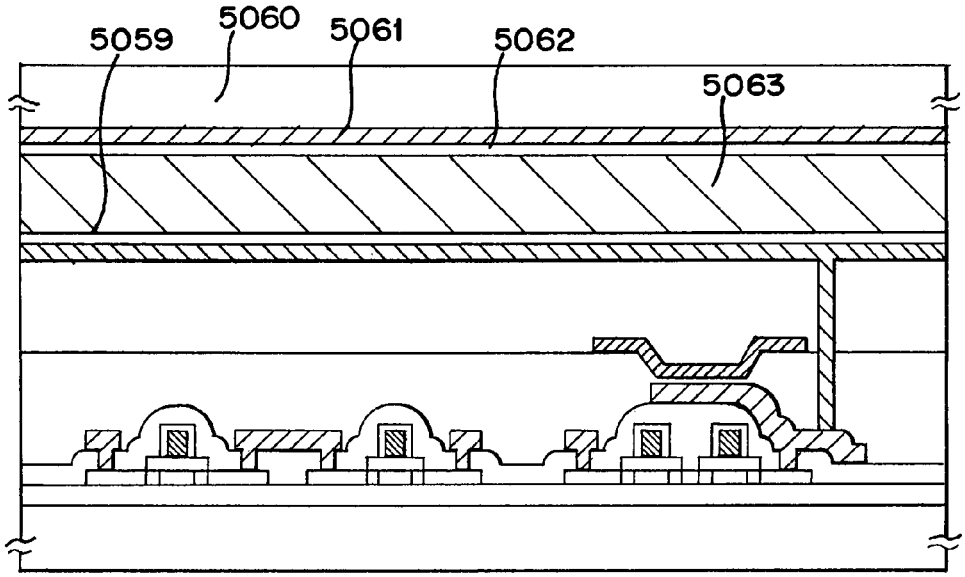

Next reference is made to FIGS. 16A to 16C. A second interlayer insulating film 5054 is formed using a silicon nitride film (FIG. 16A). A third interlayer insulating film 5056 comprising an organic resin film is subsequently formed in a thickness of 0.5 to 3 μm. For the organic resin film, polyimide, acryl, polyimide amide or the like is used. The advantages of the organic resin film include simple film formation, readiness in thickening the film, reduced parasitic capacitance owing to low specific dielectric constant, excellent flatness, etc. Other organic resin films than the ones listed above may be used.

Then a part of the third interlayer insulating film 5056 is etched and a black matrix 5055 is formed above the drain electrode 5053 of the pixel TFT in such a manner that the second interlayer insulating film is sandwiched between the drain electrode and the black matrix. In this embodiment, Ti (titanium) is used for the black matrix 5055. A storage capacitor is formed between the pixel TFT and the black matrix in this embodiment.

Subsequently, a contact hole is formed through the second interlayer insulating film 5054 and the third interlayer insulating film 5056 to form a pixel electrode 5057 with a thickness of 120 nm. Incidentally, a transparent conductive film such as ITO is used as a conductive film for forming the pixel electrode 5057, for this embodiment deals with an example of a transmission type active matrix liquid crystal display device.

Then the whole substrate is heated in a hydrogen atmosphere at 350° C. for 1 to 2 hours to hydrogenate the whole element, thereby compensating dangling bonds (unpaired bonds) in the film (active layer, in particular). This hydrogenating treatment may be carried out using hydrogen produced by ionization.

Through the above steps, an active matrix substrate with a CMOS circuit and a pixel region formed on the same substrate is completed (FIG. 16B).

Next, a description will be given on a process of manufacturing an active matrix type liquid crystal display device using as the base the active matrix substrate fabricated through the above steps.

An orientated film 5059 is formed on the active matrix substrate in the state shown in FIG. 16C. In this embodiment, polyimide is used for the orientated film 5059. An opposite substrate is then prepared. The opposite substrate consists of a glass substrate 5060, an opposite electrode 5061 made of a transparent conductive film and an orientated film 5062.

A polyimide film is again used for the orientated film 5062 in this embodiment. After forming the orientated film, rubbing treatment is performed. The polyimide used in this embodiment is one that has a relatively large pretilt angle.

The active matrix substrate and the opposite substrate which have undergone the above steps are then adhered to each other by a known cell assembling process through a sealing material or a spacer (neither is shown). After that, liquid crystal 5063 is injected between the substrates and a sealant (not shown) is used to completely seal the substrates. In this embodiment, nematic liquid crystal is used for the liquid crystal 5063.

A transmission type active matrix type liquid crystal display device as shown in FIG. 16C is thus completed.

Incidentally, the amorphous silicon film may be crystallized by laser light (typically excimer laser light) instead of the crystallization method for type amorphous silicon film described in this embodiment.

Additionally, the polycrystalline silicon film may be replaced by the use of an SOI structure (SOI substrate) such as SmartCut™, a SIMOX, ELTRAN™, etc. to perform other processes.

Embodiment 5

This embodiment describes another manufacturing method of a liquid crystal display device of the present invention. Explained here is a method in which TFTs for a pixel region and TFTs for a driver circuit arranged in the periphery of the pixel region are formed at the same time.

Figures 17A, 17B, 17C:
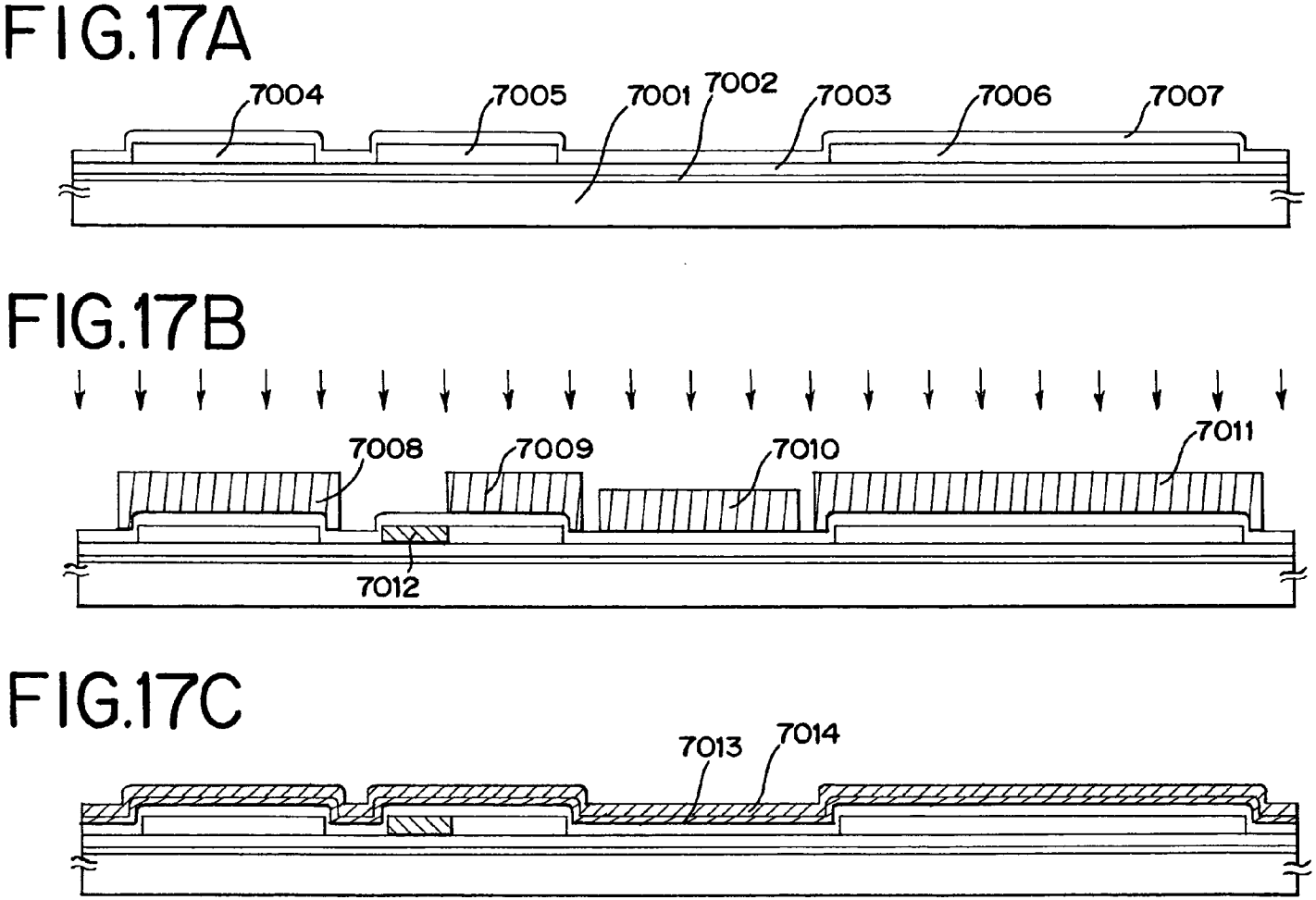
FIGS. 17A to 17C are diagrams showing an example of a manufacturing process of a liquid crystal display device according to Embodiment 5 of the invention.

(Step of Forming Island-Like Semiconductor Layer and Gate Insulating Film: FIG. 17A)

In FIG. 17A, non-alkaline glass substrate or a quartz substrate is preferably used for a substrate 7001. Other usable substrate than that is a silicon substrate or a metal substrate on the surface of which an insulating film is formed.

On one surface of the substrate 7001 on which the TFT is to be formed, a base film 7002 comprising a silicon oxide film, a silicon nitride film, or a silicon nitride oxide film is formed by plasma CVD or sputtering to have a thickness of 100 to 400 nm. For instance, a preferable film for the base film 7002 is one with a two-layer structure in which a silicon nitride film 7002 having a thickness of 25 to 100 nm, in here 50 nm, and a silicon oxide film 7003 having a thickness of 50 to 300 nm, in here 150 nm, are layered. The base film 7002 is provided for preventing impurity contamination from the substrate, and is not always necessary if a quartz substrate is employed.

Next, an amorphous silicon film with a thickness of 20 to 100 nm is formed on the base film 7002 by a known film formation method. Though depending on its hydrogen content, the amorphous silicon film is preferably heated at 400 to 550° C. for several hours for dehydrogenation, reducing the hydrogen content to 5 atom % or less to carry out crystallization step. The amorphous silicon film may be formed by other formation methods such as sputtering or evaporation if impurity elements such as oxygen and nitrogen contained in the film are sufficiently reduced. The base film and the amorphous silicon film can be formed by the same film formation method here, so that the films may be formed continuously. In that case, the device is not exposed to the air after forming the base film, which makes it possible to prevent contamination of the surface reducing fluctuation in characteristics of the TFT to be manufactured.

A known laser crystallization technique or thermal crystallization technique may be used for a step of forming a crystalline silicon film from the amorphous silicon film. The crystalline silicon film may be formed by thermal crystallization using a catalytic element for promoting the crystallization of silicon. Other options include the use of a microcrystal silicon film and direct deposition of a crystalline silicon film. Further, the crystalline silicon film may be formed by employing a known technique of SOI (Silicon On Insulators) with which a monocrystal silicon is adhered to a substrate.

An unnecessary portion of the thus formed crystalline silicon film is etched and removed to form island-like semiconductor layers 7004 to 7006. A region in the crystalline silicon film where an N channel type TFT is to be formed may be doped in advance with boron (B) in a concentration of about $1\times10^{15}$ to $5\times10^{17}$ $cm^{-3}$ in order to control the threshold voltage.

Then the island-like semiconductor layers 7004 to 7006 are covered to form a gate insulating film 7007 containing mainly silicon oxide or silicon nitride. The thickness of the gate insulating film 7007 is 10 to 200 nm, preferably 50 to 150 m. For example, a silicon nitride oxide film raw materials of which are $N_2O$ and $SiH_4$ is formed by plasma CVD to have a thickness of 75 nm, and then thermally oxidized in an oxygen atmosphere or a mixed atmosphere of oxygen and chlorine at 800 to 1000° C. to form the gate insulating film with a thickness of 115 nm (FIG. 17A).

(Formation of $N^-$ Region: FIG. 17B)

Resist masks 7008 to 7011 are formed on the entire surfaces of the island-like semiconductor layers 7004, 7006 and a region where a wiring is to be formed, and on a part of the island-like semiconductor layer 7005 (including a region to be a channel forming region). An area that is exposed is doped with an impurity element for imparting n type to form a lightly doped region 7012. This lightly doped region 7012 is an impurity region for forming later an LDD region (called an Lov region in this specification, where 'ov' stands for 'overlap') that overlaps with a gate electrode through the gate insulating film in the N channel type TFT of a CMOS circuit. The concentration of the impurity element for imparting n type in the lightly doped region formed here is referred to as ($n^-$). Accordingly, the lightly doped region 7012 may be called $n^-$ region herein.

Phosphorus doping is conducted by ion doping with the use of plasma-excited phosphine ($PH_3$) without performing mass-separation on it. Needless to say, the ion implantation involving mass-separation may be employed instead. In this step, a semiconductor layer beneath the gate insulating film 7007 is doped with phosphorus through the film 7007. The concentration of phosphorus to be used in the doping preferably ranges from $5\times10^{17}$ atoms/$cm^3$ to $5\times10^{18}$ atoms/$cm^3$, and the concentration here in this embodiment is set to $1\times10^{18}$ atoms/$cm^3$.

Thereafter, the resist masks 7008 to 7011 are removed and heat treatment is conducted in a nitrogen atmosphere at 400 to 900° C., preferably 550 to 800° C. for 1 to 12 hours, activating phosphorus added in this step.

(Formation of Conductive Films for Gate Electrode and for Wiring: FIG. 17C)

A first conductive film 7013 with a thickness of 10 to 100 nm is formed from an element selected from tantalum (Ta), titanium (Ti), molybdenum (Mo) and tungsten (W) or from a conductive material containing one of those elements as its main materials. Tantalum nitride (TaN) or tungsten nitride (WN), for example, is desirably used for the first conductive film 7013. A second conductive film 7014 with a thickness of 100 to 400 nm is further formed on the first conductive film 7013 from an element selected from Ta, Ti, Mo and W or from a conductive material containing one of those elements as its main material. For instance, A Ta film is formed in a thickness of 200 nm. Though not shown, it is effective to form a silicon film with a thickness of about 2 to 20 nm under the first conductive film 7013 for the purpose of preventing oxidation of the conductive films 7013,7014 (especially the conductive film 7014).

Figure 18A:
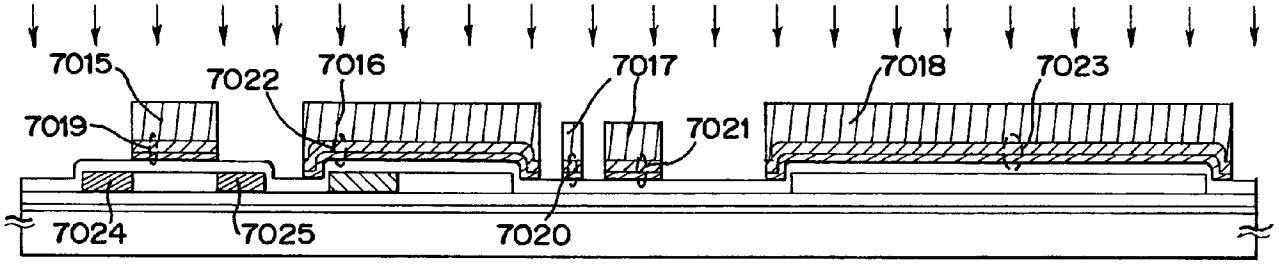
FIGS. 18A to 18C are diagrams showing an example of a manufacturing process of a liquid crystal display device according to Embodiment 5.

(Formation of P-Ch Gate Electrode and Wiring Electrode, and Formation of $P^+$ Region: FIG. 18A)

Resist masks 7015 to 7018 are formed and the first conductive film and the second conductive film (which are hereinafter treated as a lamination film) are etched to form a gate electrode 7019 and gate wirings 7020, 7021 of a P channel type TFT. As a result of the etching of the first and second conductive films (or the lamination film), conductive films 7022, 7023 are left to cover the entire surface of the regions to be N channel type TFTs.

Proceeding to the next step, the resist masks 7015 to 7018 are remained as they are to serve as masks, and a part of the semiconductor layer 7004 where the P channel type TFT is to be formed is doped with an impurity element for imparting p type. Boron is selected here in this embodiment as the impurity element and the ion doping (of course ion implantation also will do) is conducted using dibolane ($B_2H_6$). The concentration of boron used in the doping here is $5\times10^{20}$ to $3\times10^{21}$ atoms/$cm^3$. The concentration of the impurity element for imparting p type contained in the impurity regions formed here is expressed as ($p^{++}$). Accordingly, impurity regions 7024, 7025 may be referred to as $p^{++}$ regions in this specification.

This step has the alternative in which the resist masks 7015 to 7018 are used to etch and remove the gate insulating film 7007 exposing a part of the island-like semiconductor layer 7004, so that the part is doped with an impurity element for imparting p type. In this case, a low acceleration voltage is sufficient for the doping, causing less damage on the island-like semiconductor film and improving the throughput.

Figure 18B:
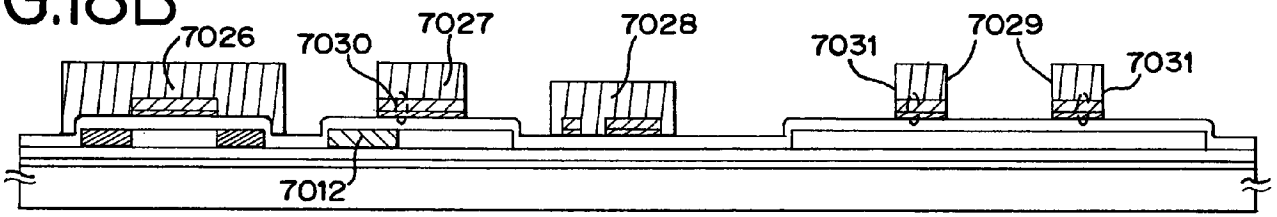

(Formation of N-Ch Gate Electrode: FIG. 18B)

Then the resist masks 7015 to 7018 are removed and resist masks 7026 to 7029 are newly formed to form gate electrodes 7030, 7031 of the N channel type TFT. At this point, the gate electrode 7030 is formed so as to overlap with the $n^-$ region 7012 through the gate insulating film.

Figure 18C:
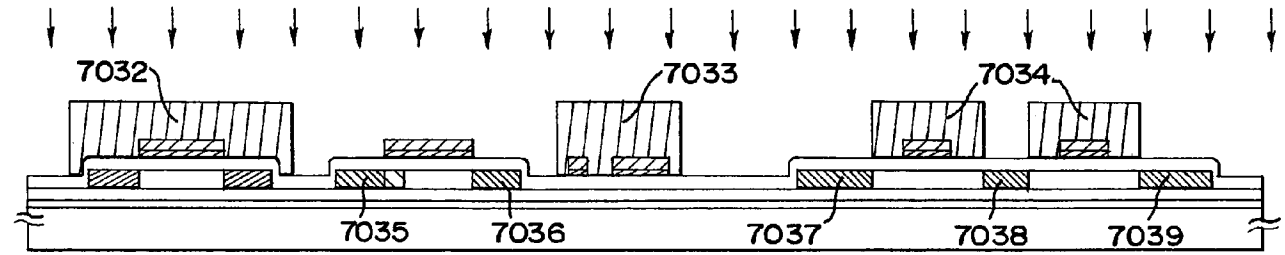

(Formation of $N^+$ Region: FIG. 18C)

The resist masks 7026 to 7029 are then removed and resist masks 7032 to 7034 are newly formed. Subsequently, a step of forming an impurity region functioning as a source region or a drain region in the N channel type TFT will be carried out. The resist mask 7034 is formed so as to cover the gate electrode 7031 of the N channel type TFT. This is for forming in later step an LDD region so as not to overlap with the gate electrode in the N channel type TFT of a pixel region.

An impurity element for imparting n type is added thereto to form impurity regions 7035 to 7039. Here, ion doping (of course ion implantation also will do) using phosphine ($PH_3$) is again employed, and the phosphorus concentration in these regions is set to $1\times10^{20}$ to $1\times10^{21}$ atoms/$cm^3$. The concentration of the impurity element for imparting n type contained in the impurity regions 7037 to 7039 formed here is expressed as ($n^+$). Accordingly, the impurity regions 7037 to 7039 may be referred to as $n^+$ regions in this specification. The impurity regions 7035, 7036 have $n^-$ regions which have already been formed, so that, strictly speaking, they contain a slightly higher concentration of phosphorus than the impurity regions 7037 to 7039 do.

This step has the alternative in which the resist masks 7032 to 7034 and the gate electrode 7030 are used as masks to etch the gate insulating film 7007 partially exposing the island-like semiconductor films 7005, 7006, so that the parts are doped with an impurity element for imparting n type. In this case, a low acceleration voltage is sufficient for the doping, causing less damage on the island-like semiconductor films and improving the throughput.

Figures 19A, 19B, 19C:
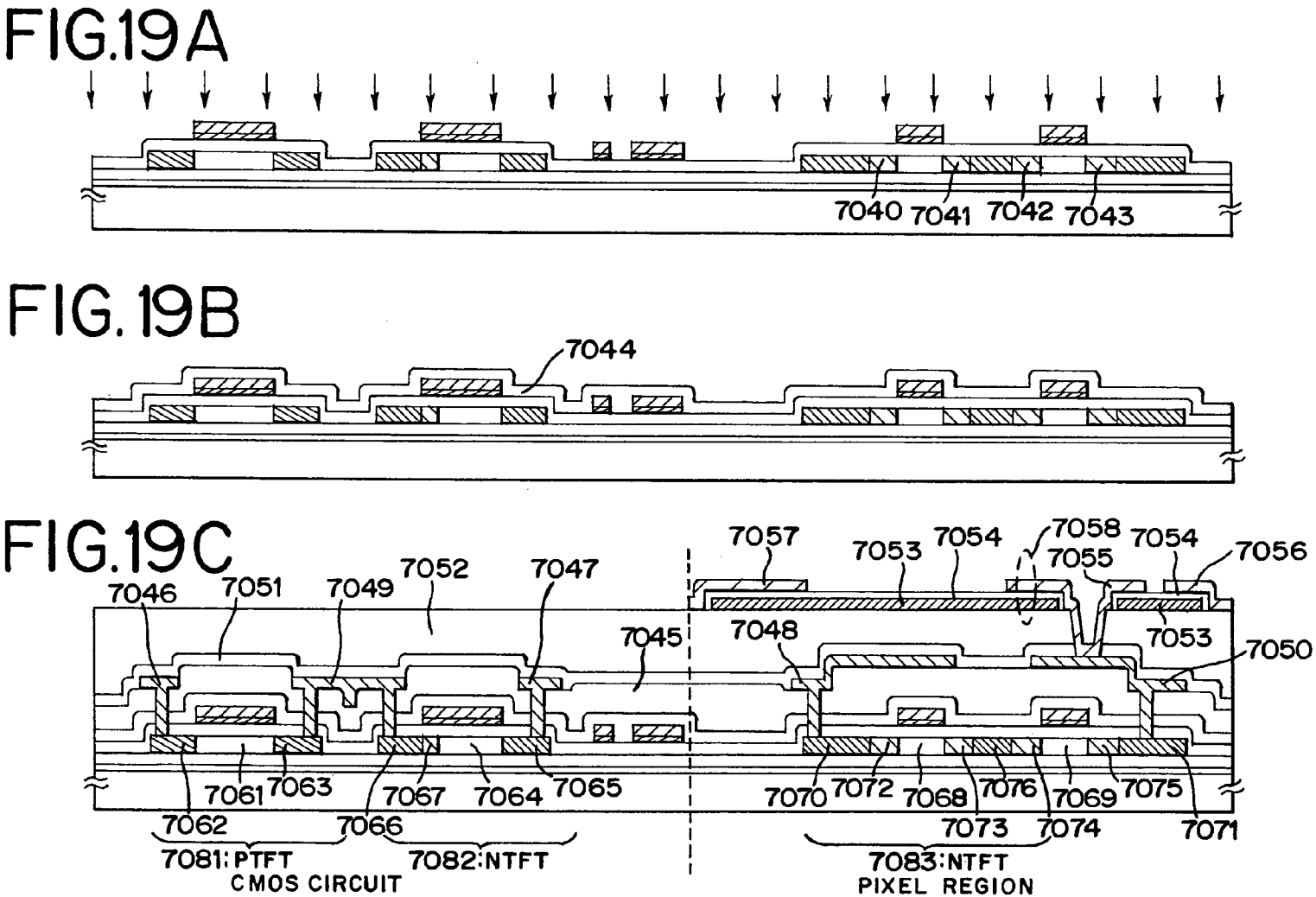
FIGS. 19A to 19C are diagrams showing an example of a manufacturing process of a liquid crystal display device according to Embodiment 5.

(Formation of $N^-$ Region: FIG. 19A)

Next, the resist masks 7032 to 7034 are removed and the island-like semiconductor layer 7006 where the N channel type TFT of the pixel region is to be formed is doped with an impurity element for imparting n type. The thus formed impurity regions 7040 to 7043 are doped with phosphorus in the same concentration as in the above $n^-$ regions or a less concentration (specifically, $5\times10^{16}$ to $1\times10^{18}$ atoms/$cm^3$). The concentration of the impurity element for imparting n type contained in the impurity regions 7040 to 7043 formed here is expressed as ($n^{--}$). Accordingly, the impurity regions 7040 to 7043 may be referred to as $n^{--}$ regions in this specification. Incidentally, every impurity region except for an impurity region 7067 that is hidden under the gate electrode is doped with phosphorus in a concentration of $n^?$ in this step. However, the phosphorus concentration is so low that the influence thereof may be ignored.

(Step of Thermal Activation: FIG. 19B)

Formed next is a protective insulating film 7044, which will later become a part of a first interlayer insulating film. The protective insulating film 7044 may comprise a silicon nitride film, a silicon oxide film, a silicon nitride oxide film or a lamination film with those films layered in combination. The film thickness thereof ranges from 100 nm to 400 nm.

Thereafter, a heat treatment step is carried out for activating the impurity elements added in the respective concentration for imparting n type or p type. This step may employ the furnace annealing method, the laser annealing method or the rapid thermal annealing method (RTA method). Here in this embodiment, the activation step is carried out by the furnace annealing method. The heat treatment is conducted in a nitrogen atmosphere at 300 to 650° C., preferably 400 to 550° C., in here 450° C., for 2 hours.

Further heat treatment is performed in an atmosphere containing 3 to 100% of hydrogen at 300 to 450° C. for 1 to 12 hours, hydrogenating the island-like semiconductor layer. This step is to terminate the dangling bonds in the semiconductor layer with thermally excited hydrogen. Other hydrogenating means includes plasma hydrogenation (that uses hydrogen excited by plasma).

(Formation of Interlayer Insulating Film, Source/Drain Electrode, Light-Shielding Film, Pixel Electrode and Holding Capacitance: FIG. 19C)

Upon completion of the activation step, an interlayer insulating film 7045 with a thickness of 0.5 to 1.5 μm is formed on the protective insulating film 7044. A lamination film consisting of the protective insulating film 7044 and the interlayer insulating film 7045 serves as a first interlayer insulating film.

After that, contact holes reaching to the source regions or the drain regions of the respective TFTs are formed to form source electrodes 7046 to 7048 and drain electrodes 7049, 7050. Though not shown, these electrodes in this embodiment are each made of a lamination film having a three-layer structure in which a Ti film with a thickness of 100 nm, a Ti-containing aluminum film with a thickness of 300 nm and another Ti film with a thickness of 150 nm are sequentially formed by sputtering.

Then a passivation film 7051 is formed using a silicon nitride film, a silicon oxide film or a silicon nitride oxide film in a thickness of 50 to 500 nm (typically, 200 to 300 nm). Subsequent hydrogenation treatment performed in this state brings a favorable result in regard to the improvement of the TFT characteristics. For instance, it is sufficient if heat treatment is conducted in an atmosphere containing 3 to 100% hydrogen at 300 to 450° C. for 1 to 12 hours. Alternatively, the same result can also be obtained when the plasma hydrogenation method is used. An opening may be formed here in the passivation film 7051 at a position where a contact hole for connecting the pixel electrode and the drain electrode is to be formed.

Thereafter, a second interlayer insulating film 7052 comprising an organic resin is formed to have a thickness of about 1 μm. As the organic resin, polyimide, acryl, polyamide, polyimideamide, BCB (benzocyclobutene), etc. may be used. The advantages in the use of the organic resin film include simple film formation, readiness in thickening the film, reduced parasitic capacitance owing to low specific dielectric constant, excellent flatness, etc. Other organic resin films than the ones listed above and an organic-based SiO compound may also be used. Here in this embodiment, polyimide of the type being thermally polymerized after applied to the substrate is used and burnt at 300° C. to form the film 7052.

Subsequently, a light-shielding film 7053 is formed on the second interlayer insulating film 7052 in a region to be the pixel region. The light-shielding film 7053 comprises an element selected from aluminum (Al), titanium (Ti) and tantalum (Ta) or of a film containing one of those elements as its main material to have a thickness of 100 to 300 nm. On the surface of the light-shielding film 7053, an oxide film 7054 with a thickness of 30 to 150 nm (preferably 50 to 75 nm) is formed by anodic oxidation or plasma oxidation. Here in this embodiment, an aluminum film or a film mainly containing aluminum is used as the light-shielding film 7053, and an aluminum oxide film (alumina film) is used as the oxide film 7054.

The insulating film is provided only on the surface of the light-shielding film here in this embodiment. The insulating film may be formed by a vapor phase method such as plasma CVD, thermal CVD or sputtering. In that case also, the film thickness thereof is preferably 30 to 150 nm (preferably 50 to 75 nm). A silicon oxide film, a silicon nitride film, a silicon nitride oxide film a DLC (Diamond like carbon) film, or an organic resin film may be used for the insulating film. A lamination film with those films layered in combination may also be used.

Then a contact hole reaching the drain electrode 7050 is formed in the second interlayer insulating film 7052 to form a pixel electrode 7055. Incidentally, pixel electrodes 7056, 7057 are for adjacent but individual pixels, respectively. For the pixel electrodes 7055 to 7057, a transparent conductive film is used in the case of fabricating a transmission type liquid crystal display device and a metal film is used in the case of a reflection type liquid crystal display device. In the embodiment here, in order to manufacture a transmission type liquid crystal display device, an indium tin oxide film (ITO) with a thickness of 100 nm is formed by sputtering.

At this point, a storage capacitor is formed using a region 7058 where the pixel electrode 7055 overlaps with the light-shielding film 7053 through the oxide film 7054.

In this way, an active matrix substrate having the CMOS circuit serving as a driver circuit and the pixel region which are formed on the same substrate is completed. A P channel type TFT 7081 and an N channel type TFT 7082 are formed in the CMOS circuit serving as a driver circuit, and a pixel TFT 7083 is formed from an N channel type TFT in the pixel region.

The P channel type TFT 7081 of the CMOS circuit has a channel forming region 7061, a source region 7062 and a drain region 7063 which are formed respectively in the $p^+$ regions. The N channel type TFT 7082 has a channel forming region 7064, a source region 7065, a drain region 7066 and an LDD region (hereinafter referred to as Lov region, where 'ov' stands for 'overlap') 7067 which overlaps with the gate electrode through the gate insulating film. The source region 7065 and the drain region 7066 are formed respectively in ($n^-$ $n^+$) regions and the Lov region 7067 is formed in the $n^-$ region.

The pixel TFT 7083 has channel forming regions 7068, 7069, a source region 7070, a drain region 7071, LDD regions (hereinafter referred to as Loff regions, where 'off' stands for 'offset') 7072 to 7075 which do not overlap with the gate electrode through the gate insulating film, and an $n^+$ region 7076 in contact with the Loff regions 7073, 7074. The source region 7070 and the drain region 7071 are formed respectively in the $n^+$ regions and the Loff regions 7072 to 7075 are formed in the $n^-$ regions.

Here, the structure of the TFTs for forming the pixel region and for forming the driver circuit can be optimized in accordance with the circuit specification each circuit requires, improving operational performance and reliability of the semiconductor device. Specifically, varying the arrangement of the LDD region in the N channel type TFT and choosing either the Lov region or the Loff region in accordance with the circuit specification realize formation on the same substrate of the TFT structure that attaches importance to high speed operation or to countermeasures for hot carrier and the TFT structure that attaches importance to low OFF current operation.

For instance, in the case of the active matrix type liquid crystal display device, the N channel type TFT 7082 is suitable for a logic circuit where importance is attached to the high speed operation, such as a shift register circuit, a frequency divider circuit, a signal dividing circuit, a level shifter circuit and a buffer circuit. On the other hand, the N channel type TFT 7083 is suitable for a circuit where importance is attached to the low OFF current operation, such as a pixel region and a sampling circuit (sample hold circuit).

The length (width) of the Lov region is, with respect to the channel length of 3 to 7 μm, 0.5 to 3.0 μm, typically 1.0 to 1.5 μm. The length (width) of the Loff regions 7072 to 7075 arranged in the pixel TFT 7083 is 0.5 to 3.5 μm, typically 2.0 to 2.5 μm.

Embodiment 6

This embodiment gives an example on still another manufacturing method of a liquid crystal display device of the present invention. A description here in this embodiment deals with a method of manufacturing simultaneously TFTs for a pixel region and for a driver circuit arranged in the periphery of the pixel region.

Figure 20A:
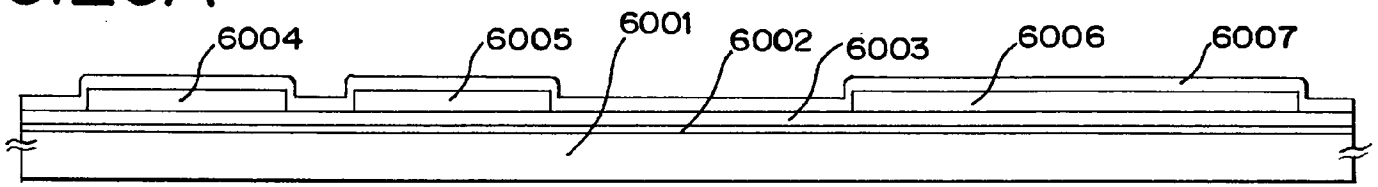
FIGS. 20A to 20C are diagrams showing an example of a manufacturing process of a liquid crystal display device according to Embodiment 6 of the invention.

(Formation of Island-Like Semiconductor Layer and Gate Insulating Film: FIG. 20A)

In FIG. 20A, a non-alkaline glass substrate or a quartz substrate is desirably used for a substrate 6001. A usable substrate other than those may be a silicon substrate or a metal substrate on the surface of which an insulating film is formed.

On one surface of the substrate 6001 on which the TFT is to be formed, a base film 6002 made of a silicon oxide film, a silicon nitride film, or a silicon nitride oxide film is formed by plasma CVD or sputtering to have a thickness of 100 to 400 nm. For instance, a preferable film for the base film 6002 is one with a two-layer structure in which a silicon nitride film 6002 having a thickness of 25 to 100 nm, in here 50 nm, and a silicon oxide film 6003 having a thickness of 50 to 300 nm, in here 150 nm, are layered. The base film 6002 is provided for preventing impurity contamination from the substrate, and is not always necessary if a quartz substrate is employed.

Next, an amorphous silicon film with a thickness of 20 to 100 nm is formed on the base film 6002 by a known film formation method. Though depending on its hydrogen content, the amorphous silicon film is preferably heated at 400 to 550° C. for several hours for dehydrogenation, reducing the hydrogen content to 5 atom % or less to carry out crystallization step. The amorphous silicon film may be formed by other formation methods such as sputtering or evaporation if impurity elements such as oxygen and nitrogen contained in the film are sufficiently reduced. The base film and the amorphous silicon film can be formed by the same film formation method here, so that the films may be formed continuously. In that case, the device is not exposed to the air after forming the base film, which makes it possible to prevent contamination of the surface reducing fluctuation in characteristics of the TFT to be manufactured.

A known laser crystallization technique or thermal crystallization technique may be used for a step of forming a crystalline silicon film from the amorphous silicon film. The crystalline silicon film may be formed by thermal crystallization using a catalytic element for promoting the crystallization of silicon. Other options include the use of a microcrystal silicon film and direct deposition of a crystalline silicon film. Further, the crystalline silicon film may be formed by employing a known technique of SOI (Silicon On Insulators) with which a monocrystal silicon is adhered to a substrate.

An unnecessary portion of the thus formed crystalline silicon film is etched and removed to form island-like semiconductor layers 6004 to 6006. A region in the crystalline silicon film where an N channel type TFT is to be formed may be doped in advance with boron (B) in a concentration of about $1\times10^{15}$ to $5\times10^{17}$ $cm^{-3}$ in order to control the threshold voltage.

Then the island-like semiconductor layers 6004 to 6006 are covered to form a gate insulating film 6007 containing mainly silicon oxide or silicon nitride. The thickness of the gate insulating film 6007 is 10 to 200 nm, preferably 50 to 150 nm. For example, a silicon nitride oxide film raw materials of which are $N_2O$ and $SiH_4$ is formed by plasma CVD to have a thickness of 75 nm, and then thermally oxidized in an oxygen atmosphere or a mixed atmosphere of oxygen and chlorine at 800 to 1000° C. to form the gate insulating film with a thickness of 115 nm (FIG. 20A).

Figure 20B:
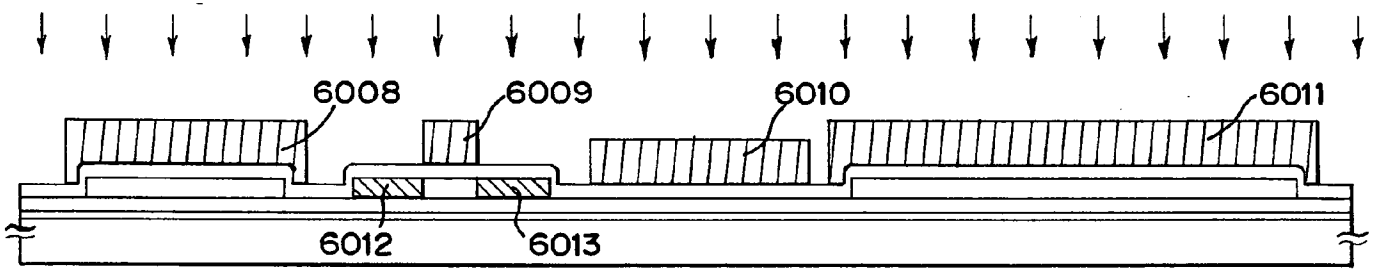

(Formation of $N^-$ Region: FIG. 20B)

Resist masks 6008 to 6011 are formed on the entire surfaces of the island-like semiconductor layers 6004, 6006 and a region where a wiring is to be formed, and on a part of the island-like semiconductor layer 6005 (including a region to be a channel forming region). Areas that are exposed are doped with an impurity element for imparting n type to form lightly doped regions 6012, 6013. These lightly doped regions 6012, 6013 are impurity regions for forming later LDD regions (called Lov regions in this specification, where 'ov' stands for 'overlap') that overlap with a gate electrode through the gate insulating film in the N channel type TFT of a CMOS circuit. The concentration of the impurity element for imparting n type contained in the lightly doped regions formed here is referred to as ($n^-$). Accordingly, the lightly doped regions 6012, 6013 may be called $n^-$ regions herein.

Phosphorus doping is conducted by ion doping with the use of plasma-excited phosphine ($PH_3$) without performing mass-separation on it. Needless to say, ion implantation involving mass-separation may be employed instead. In this step, a semiconductor layer beneath the gate insulating film 6007 is doped with phosphorus through the film 6007. The concentration of phosphorus to be used in the doping preferably ranges from $5\times10^{17}$ atoms/cm$^3$ to $5\times10^{18}$ atoms/cm$^3$, and the concentration here in this embodiment is set to $1\times10^{18}$ atoms/cm$^3$.

Thereafter, the resist masks 6008 to 6011 are removed and heat treatment is conducted in a nitrogen atmosphere at 400 to 900° C., preferably 550 to 800° C., for 1 to 12 hours, activating phosphorus added in this step.

Figure 20C:
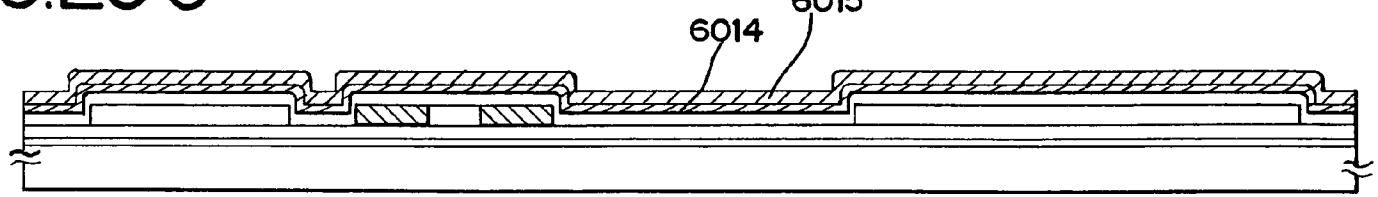

(Formation of Conductive Films for Gate Electrode and for Wiring: FIG. 20C)

A first conductive film 6014 with a thickness of 10 to 100 nm is formed from an element selected from tantalum (Ta), titanium (Ti), molybdenum (Mo) and tungsten (W) or from a conductive material containing one of those elements as its main materials. Tantalum nitride (TaN) or tungsten nitride (WN), for example, is desirably used for the first conductive film 6014. A second conductive film 6015 with a thickness of 100 to 400 nm is further formed on the first conductive film 6014 from an element selected from Ta, Ti, Mo and W or from a conductive material containing one of those elements as its main material. For instance, A Ta film is formed in a thickness of 200 nm. Though not shown, it is effective to form a silicon film with a thickness of about 2 to 20 nm under the first conductive film 6014 for the purpose of preventing oxidation of the conductive films 6014, 6015 (especially the conductive film 6015).

Figures 21A, 21B, 21C:
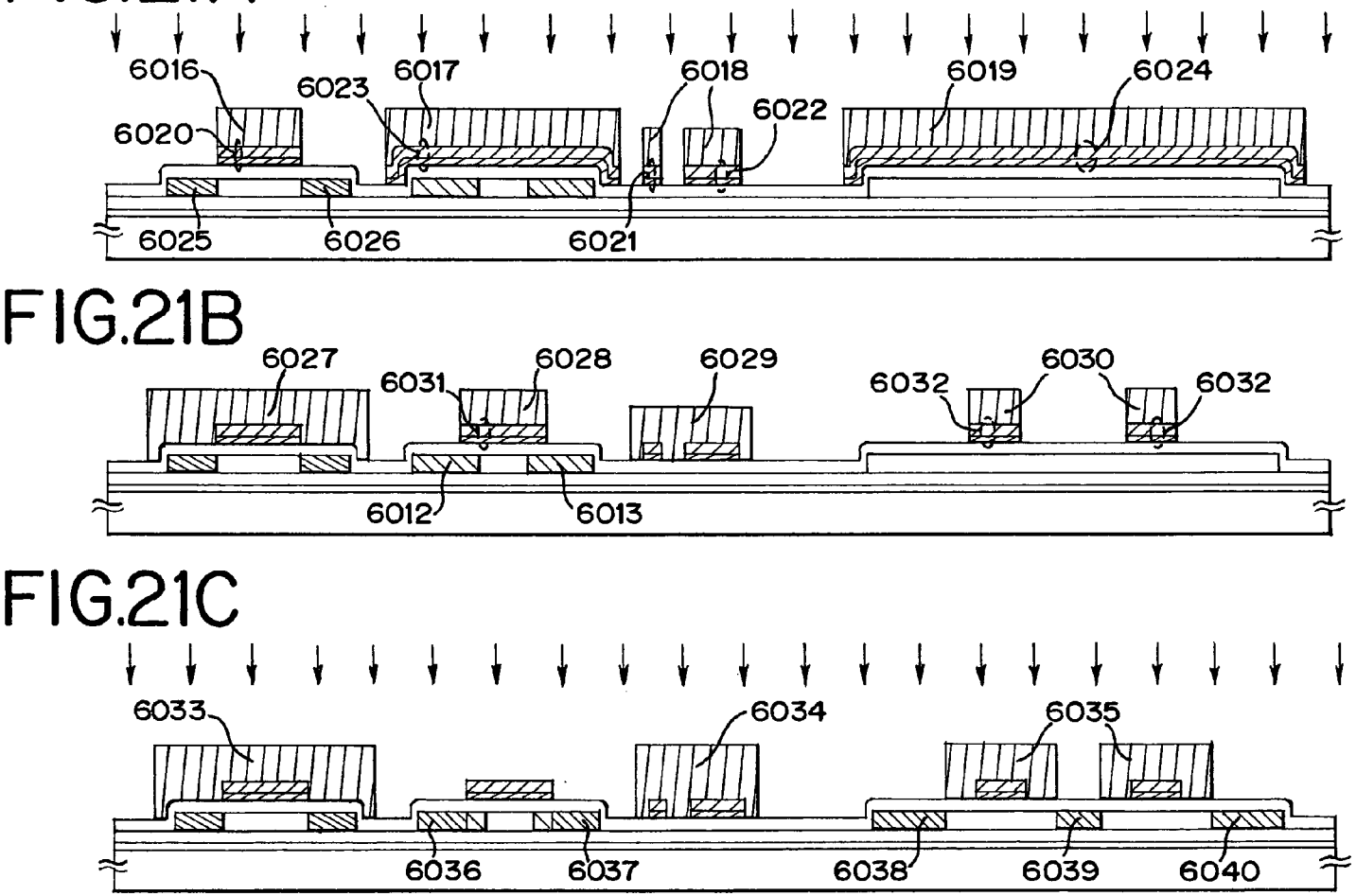
FIGS. 21A to 21C are diagrams showing an example of a manufacturing process of the liquid crystal display device according to Embodiment 6.

(Formation of P-Ch Gate Electrode and Wiring Electrode, and Formation of $P^+$ Region: FIG. 21A)

Resist masks 6016 to 6019 are formed and the first conductive film and the second conductive film (which are hereinafter treated as a lamination film) are etched to form a gate electrode 6020 and gate wirings 6021, 6022 of a P channel type TFT. As a result of the etching of the first and second conductive films (or the lamination film), conductive films 6023, 6024 are left to cover the entire surface of the regions to be N channel type TFTs.

Proceeding to the next step, the resist masks 6016 to 6019 are remained as they are to serve as masks, and a part of the semiconductor layer 6004 where the P channel type TFT is to be formed is doped with an impurity element for imparting p type. Boron is selected here in this embodiment as the impurity element and the ion doping (of course ion implantation also will do) is conducted using dibolane ($B_2H_6$). The concentration of boron used in the doping here is $5\times10^{20}$ to $3\times10^{21}$ atoms/cm$^3$.

The concentration of the impurity element for imparting p type contained in the impurity regions formed here is expressed as ($p^{++}$). Accordingly, impurity regions 6025, 6026 may be referred to as $p^{++}$ regions in this specification.

This step has the alternative in which the resist masks 6016 to 6019 are used to etch and remove the gate insulating film 6007 exposing a part of the island-like semiconductor layer 6004, so that the part is doped with an impurity element for imparting p type. In this case, a low acceleration voltage is sufficient for the doping, causing less damage on the island-like semiconductor film and improving the throughput.

(Formation of N-ch Gate Electrode: FIG. 21B)

Then the resist masks 6016 to 6019 are removed and resist masks 6027 to 6030 are newly formed to form gate electrodes 6031, 6032 of the N channel type TFT. At this point, the gate electrode 6031 is formed so as to overlap with the n regions 6012, 6013 through the gate insulating film.

(Formation of $N^+$ Region: FIG. 21C)

The resist masks 6027 to 6030 are then removed and resist masks 6033 to 6035 are newly formed. Subsequently, a step of forming an impurity region functioning as a source region or a drain region in the N channel type TFT will be carried out. The resist mask 6035 is formed so as to cover the gate electrode 6032 of the N channel type TFT. This is for forming in later step an LDD region so as not to overlap with the gate electrode in the N channel type TFT of a pixel region.

An impurity element for imparting n type is added thereto to form impurity regions 6036 to 6040. Here, ion doping (of course ion implantation also will do) using phosphine ($PH_3$) is again employed, and the phosphorus concentration in these regions is set to $1\times10^{20}$ to $1\times10^{21}$ atoms/cm$^3$. The concentration of the impurity element for imparting n type contained in the impurity regions 6038 to 6040 formed here is expressed as ($n^+$). Accordingly, the impurity regions 6038 to 6040 may be referred to as $n^+$ regions in this specification. The impurity regions 6036, 6037 have $n^-$ regions which have already been formed, so that, strictly speaking, they contains a slightly higher concentration of phosphorus than the impurity regions 6038 to 6040 do.

This step has the alternative in which the resist masks 6033 to 6035 and the gate electrode 6031 are used as masks to etch the gate insulating film 6007 partially exposing the island-like semiconductor films 6005, 6006, so that the parts are doped with an impurity element for imparting n type. In this case, a low acceleration voltage is sufficient for the doping, causing less damage on the island-like semiconductor films and improving the throughput.

Figures 22A, 22B, 22C:
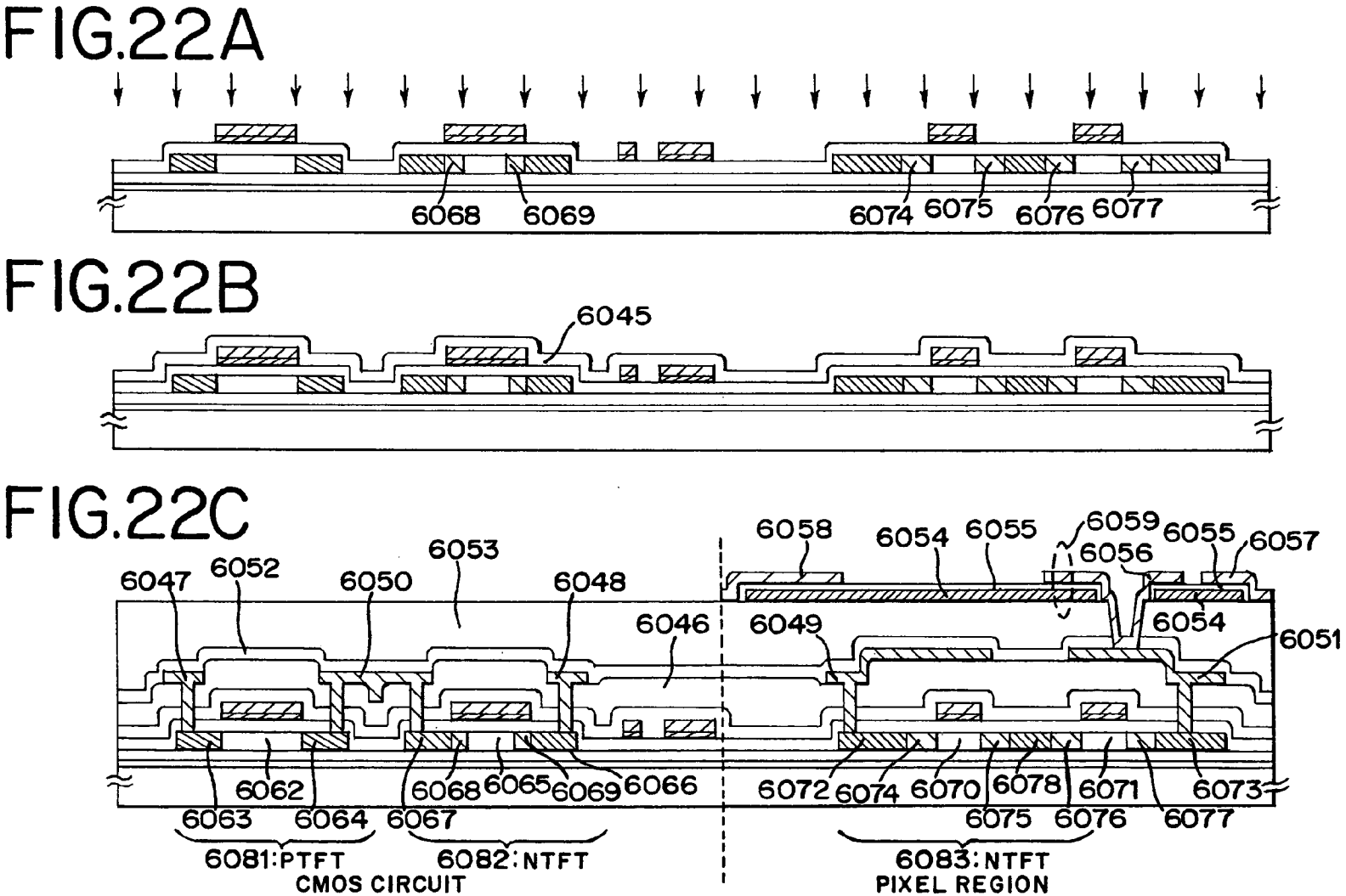
FIGS. 22A to 22C are diagrams showing an example of a manufacturing process of a liquid crystal display device according to Embodiment 6.

(Formation of $N^{--}$ Region: FIG. 22A)

Next, the resist masks 6033 to 6035 are removed and the island-like semiconductor layer 6006 where the N channel type TFT of the pixel region is to be formed is doped with an impurity element for imparting n type. The thus formed impurity regions 6074 to 6077 are doped with phosphorus in the same concentration as in the above $n^-$ regions or a less concentration (specifically, $5\times10^{16}$ to $1\times10^{18}$ atoms/cm$^3$). The concentration of the impurity element for imparting n type contained in the impurity regions 6074 to 6077 formed here is expressed as ($n^{--}$). Accordingly, the impurity regions 6074 to 6077 may be referred to as $n^{--}$ regions in this specification. Incidentally, every impurity region except for impurity regions 6068 and 6069 those are hidden under the gate electrode is doped with phosphorus in a concentration in this step. However, the phosphorus concentration is so low that the influence thereof may be ignored.

(Step of Thermal Activation: FIG. 22B)

Formed next is a protective insulating film 6045, which will later become a part of a first interlayer insulating film. The protective insulating film 6045 may be made of a silicon nitride film, a silicon oxide film, a silicon nitride oxide film or a lamination film with those films layered in combination. The film thickness thereof ranges from 100 nm to 400 nm.

Thereafter, a heat treatment step is carried out for activating the impurity elements added in the respective concentration for imparting n type or p type. This step may employ the furnace annealing method, the laser annealing method or the rapid thermal annealing method (RTA method). Here in this embodiment, the activation step is carried out by the furnace annealing method. The heat treatment is conducted in a nitrogen atmosphere at 300 to 650° C., preferably 400 to 550° C., in here 450° C. for 2 hours.

Further heat treatment is performed in an atmosphere containing 3 to 100% of hydrogen at 300 to 450° C. for 1 to 12 hours, hydrogenating the island-like semiconductor layer. This step is to terminate the dangling bonds in the semiconductor layer with thermally excited hydrogen. Other hydrogenating means includes plasma hydrogenation (that uses hydrogen excited by plasma).

(Formation of Interlayer Insulating Film, Source/Drain Electrode, Light-Shielding Film, Pixel Electrode and Holding Capacitance: FIG. 22C)

Upon completion of the activation step, an interlayer insulating film 6046 with a thickness of 0.5 to 1.5 μm is formed on the protective insulating film 6045. A lamination film consisting of the protective insulating film 6045 and the interlayer insulating film 6046 serves as a first interlayer insulating film.

After that, contact holes reaching to the source regions or the drain regions of the respective TFTs are formed to form source electrodes 6047 to 6049 and drain electrodes 6050, 6051. Though not shown, these electrodes in this embodiment are each made of a lamination film having a three-layer structure in which a Ti film with a thickness of 100 nm, a Ti-containing aluminum film with a thickness of 300 nm and another Ti film with a thickness of 150 nm are sequentially formed by sputtering.

Then a passivation film 6052 is formed using a silicon nitride film, a silicon oxide film or a silicon nitride oxide film in a thickness of 50 to 500 nm (typically, 200 to 300 nm). Subsequent hydrogenation treatment performed in this state brines a favorable result in regard to the improvement of the TFT characteristics. For instance, it is sufficient if heat treatment is conducted in an atmosphere containing 3 to 100% hydrogen at 300 to 450° C. for 1 to 12 hours. Alternatively, the same result can also be obtained when the plasma hydrogenation method is used. An opening may be formed here in the passivation film 6052 at a position where a contact hole for connecting the pixel electrode and the drain electrode is to be formed.

Thereafter, a second interlayer insulating film 6053 comprising an organic resin is formed to have a thickness of about 1 μm. As the organic resin, polyimide, acryl, polyamide, polyimideamide, BCB (benzocyclobutene), etc. may be used. The advantages in the use of the organic resin film include simple film formation, readiness in thickening the film, reduced parasitic capacitance owing to low specific dielectric constant, excellent flatness, etc. Other organic resin films than the ones listed above and an organic-based SiO compound may also be used. Here in this embodiment, polyimide of the type being thermally polymerized after applied to the substrate is used and burnt at 300° C. to form the film 6053.

Subsequently, a light-shielding film 6054 is formed on the second interlayer insulating film 6053 in a region to be the pixel region. The light-shielding film 6054 comprises an element selected from aluminum (Al), titanium (Ti) and tantalum (Ta) or of a film containing one of those elements as its main material to have a thickness of 100 to 300 nm. On the surface of the light-shielding film 6054, an oxide film 6055 with a thickness of 30 to 150 nm (preferably 50 to 75 nm) is formed by anodic oxidation or plasma oxidation. Here in this embodiment, an aluminum film or a film mainly containing aluminum is used as the light-shielding film 6054, and an aluminum oxide film (alumina film) is used as the oxide film 6055.

The insulating film is provided only on the surface of the light-shielding film here in this embodiment. The insulating film may be formed by a vapor phase method such as plasma CVD, thermal CVD or sputtering. In that case also, the film thickness thereof is preferably 30 to 150 nm (preferably 50 to 75 nm). A silicon oxide film, a silicon nitride film, a silicon nitride oxide film, a DLC (Diamond like carbon) film or an organic resin film may be used for the insulating film. A lamination film with those films layered in combination may also be used.

Then a contact hole reaching the drain electrode 6051 is formed in the second interlayer insulating film 6053 to form a pixel electrode 6056. Incidentally, pixel electrodes 6057, 6058 are for adjacent but individual pixels, respectively. For the pixel electrodes 6056 to 6058, a transparent conductive film is used in the case of fabricating a transmission type liquid crystal display device and a metal film is used in the case of a reflection type liquid crystal display device. In the embodiment here, in order to manufacture a transmission type liquid crystal display device, an indium tin oxide (ITO) film with a thickness of 100 nm is formed by sputtering.

At this point, a storage capacitor is formed using a region 6059 where the pixel electrode 6056 overlaps with the light-shielding film 6054 through the oxide film 6055.

In this way, an active matrix substrate having the CMOS circuit serving as a driver circuit and the pixel region which are formed on the same substrate is completed. A P channel type TFT 6081 and an N channel type TFT 6082 are formed in the CMOS circuit serving as a driver circuit, and a pixel TFT 6083 is formed from an N channel type TFT in the pixel region.

The P channel type TFT 6081 of the CMOS circuit has a channel forming region 6062, a source region 6063 and a drain region 6064 which are formed respectively in the $p^+$ regions. The N channel type TFT 6082 has a channel forming region 6065, a source region 6066, a drain region 6067 and LDD regions (hereinafter referred to as Lov region, where 'ov' stands for 'overlap') 6068 and 6069 which respectively overlap with the gate electrode through the gate insulating film. The source region 6066 and the drain region 6067 are formed respectively in ($n^-$ $n^+$) regions and the Lov regions 6068 and 6069 are formed in the $n^-$ regions.

The pixel TFT 6083 has channel forming regions 6070, 6071, a source region 6072, a drain region 6073, LDD regions (hereinafter referred to as Loff regions, where 'off' stands for 'offset') 6074 to 6077 which do not overlap with the gate electrode through the gate insulating film, and an $n^+$ region 6078 in contact with the Loff regions 6074, 6075. The source region 6072 and the drain region 6073 are formed respectively in the $n^+$ regions and the Loff regions 6074 to 6077 are formed in the $n^{--}$ regions.

Here, the structure of the TFTs for forming the pixel region and for forming the driver circuit can be optimized in accordance with the circuit specification each circuit requires, improving operational performance and reliability of the semiconductor device. Specifically, varying the arrangement of the LDD region in the N channel type TFT and choosing either the Lov region or the Loff region in accordance with the circuit specification realize formation on the same substrate of the TFT structure that attaches importance to high speed operation or to countermeasures for hot carrier and the TFT structure that attaches importance to low OFF current operation.

For instance, in the case of the active matrix liquid crystal display device, the N channel type TFT 6082 is suitable for a logic circuit where importance is attached to the high speed operation, such as a shift register circuit, a frequency divider circuit, a signal dividing circuit, a level shifter circuit and a buffer circuit. On the other hand, the N channel type TFT

6083 is suitable for a circuit where importance is attached to the low OFF current operation, such as a pixel region and a sampling circuit (sample hold circuit).

The length (width) of the Lov region is, with respect to the channel length of 3 to 7 μm, 0.5 to 3.0 μm, typically 1.0 to 1.5 μm. The length (width) of the Loff regions 6074 to 6077 arranged in the pixel TFT 6083 is 0.5 to 3.5 μm, typically 2.0 to 2.5 μm.

Embodiment 7

In the liquid crystal display devices manufactured in accordance with Embodiments 4 to 6 described above, various kinds of liquid crystal material may be used other than TN liquid crystal. For example, usable liquid crystal material includes ones disclosed in: 1998, SID, "Characteristics and Driving Scheme of Polymer-Stabilized Monostable FLCD Exhibiting Fast Response Time and High Contrast Ratio with Gray-Scale Capability" by H. Furue et al.; 1997, SID DIGEST, 841, "A Full-Color Thresholdless Antiferroelectric LCD Exhibiting Wide Viewing Angle with Fast Response Time" by T. Yoshida et al.; or U.S. Pat. No. 5,594,569. An entire disclosure U.S. Pat. No. 5,594,569 is incorporated herein by reference.

In particular, there has been found ones the driving voltage of which is about ±2.5 V among thresholdless antiferroelectric liquid crystal materials and thresholdless antiferroelectric mixed liquid crystal materials that are mixed liquid crystal materials of ferroelectric liquid crystal materials and antiferroelectric liquid crystal materials. Using such thresholdless antiferroelectric mixed liquid crystal of low-voltage driving, supply voltage of a sampling circuit for an image signal may be suppressed to about 5V to 8V. Therefore, this is an effective way also when employing a TFT having an LDD region (lightly doped region) of which width is relatively small (for example, 0 nm to 500 nm, or 0 nm to 200 nm).

Figure 23:
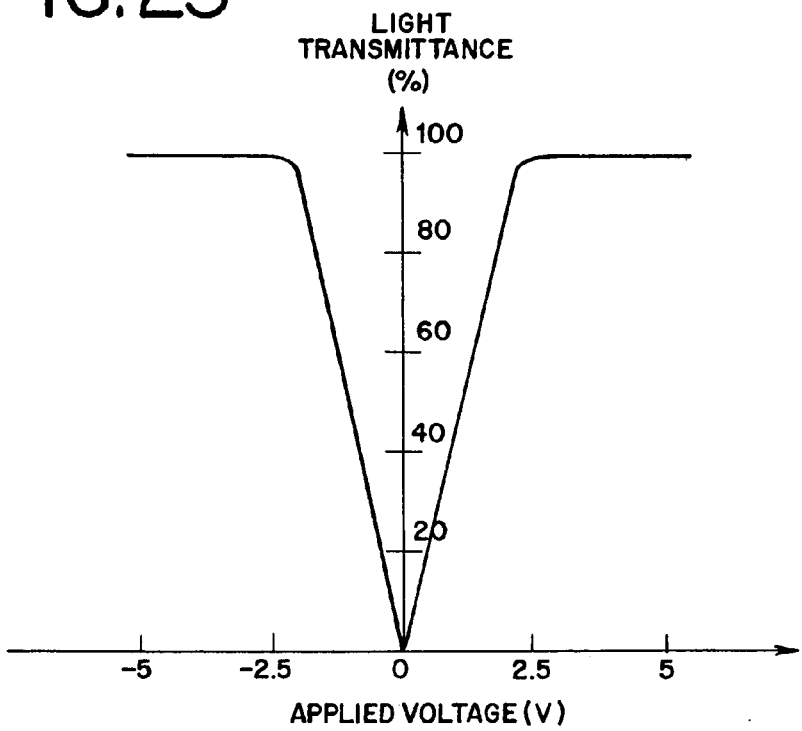
FIG. 23 is a graph showing an applied voltage-transmittance characteristic of thresholdless antiferroelectric mixed liquid crystal according to Embodiment 7 of the invention.

Here, a graph is found in FIG. 23 which shows characteristics of the thresholdless antiferroelectric mixed liquid crystal in terms of its light transmittance with respect to the applied voltage (FIG. 23). A transmission axis of a polarizing plate on the incident side of a liquid crystal display device is set substantially in parallel with the normal line direction of a smectic layer of the thresholdless-antiferroelectric mixed liquid crystal which substantially coincides with the rubbing direction of the liquid crystal display device. On the other hand, a transmission axis of the polarizing plate on the emission side is set to be substantially perpendicular to the polarization axis of the polarizing plate on the incident side (cross Nicol). Thus it can be understood that to use such thresholdless-antiferroelectric mixed liquid crystal makes possible the gradation display exhibiting the applied voltage transmittance characteristics as shown in the drawing.

In general, thresholdless-antiferroelectric mixed liquid crystal is large in spontaneous polarization and dielectric constant of liquid crystal itself is high. For that reason, relatively large storage capacitor is required for a pixel when using for a liquid crystal display device the thresholdless antiferroelectric mixed liquid crystal. Thus, preferably used is thresholdless antiferroelectric mixed liquid crystal that is small in spontaneous polarization. Alternatively, with employment of the line sequential driving as a driving method of the liquid crystal display device, writing period of gradation voltage into a pixel (pixel feed period) is prolonged so that a small storage capacitor may be supplemented.

The use of thresholdless antiferroelectric mixed liquid crystal realizes the low-voltage driving, to thereby realize a liquid crystal display device of lowered power consumption.

Embodiment 8

Figure 24:
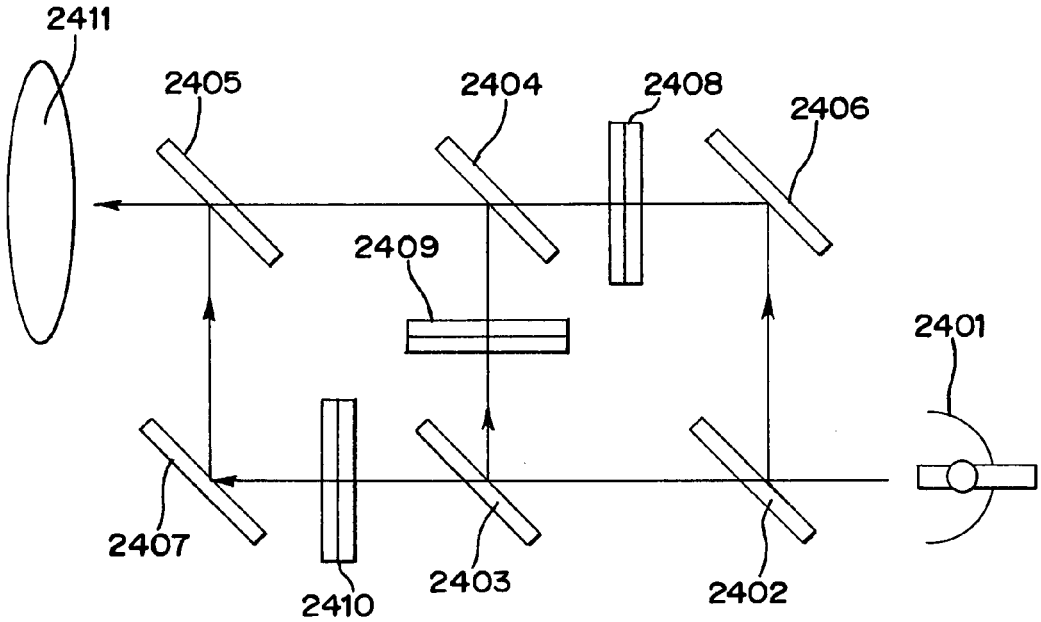
FIG. 24 is a structural diagram showing a three panel type projector using display devices according to Embodiment 8 of the invention.

The liquid crystal display device of the present invention described in the above Embodiments 1 to 3 may be used for a three panel type projector as shown in FIG. 24.

In FIG. 24, reference numeral 2401 denotes a white light source; 2402 to 2405, dichroic mirrors; 2406, 2407, total reflection mirrors; 2408 to 2410, liquid crystal display devices of the present invention; and 2411, a projection lens.

Embodiment 9

Figure 25:
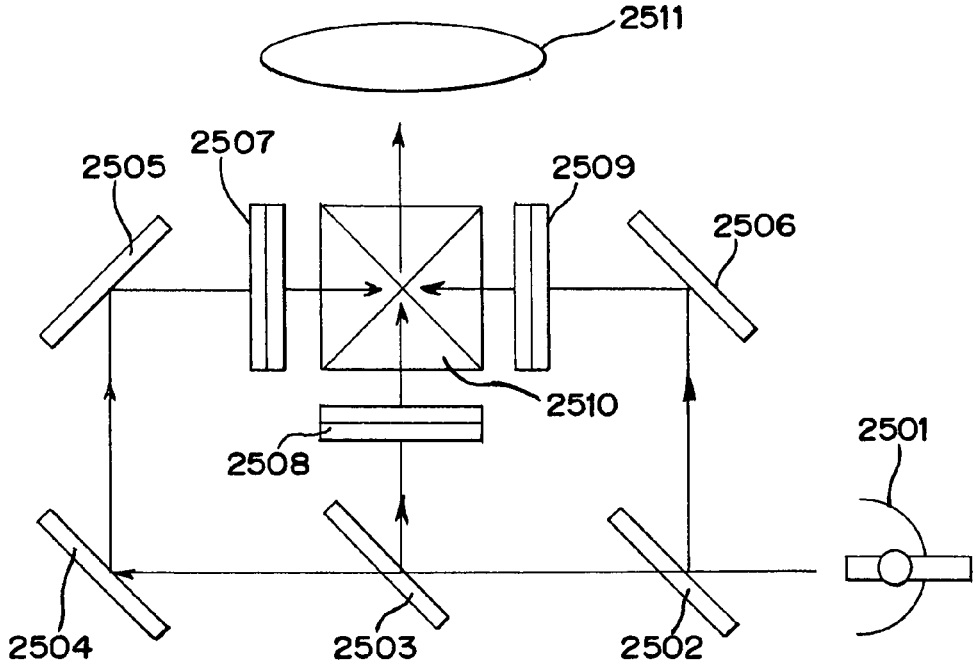
FIG. 25 is a structural diagram showing a three panel type projector using display devices according to Embodiment 9 of the invention.

The liquid crystal display device of the present invention described in the above Embodiments 1 to 3 may be used also for a three panel type projector as shown in FIG. 25.

In FIG. 25, reference numeral 2501 denotes a white light source; 2502, 2503, dichroic mirrors; 2504 to 2506, total reflection mirrors; 2507 to 2509, liquid crystal display devices of the present invention; 2510, a dichroic prism; and 2511, a projection lens.

Embodiment 10

Figure 26:
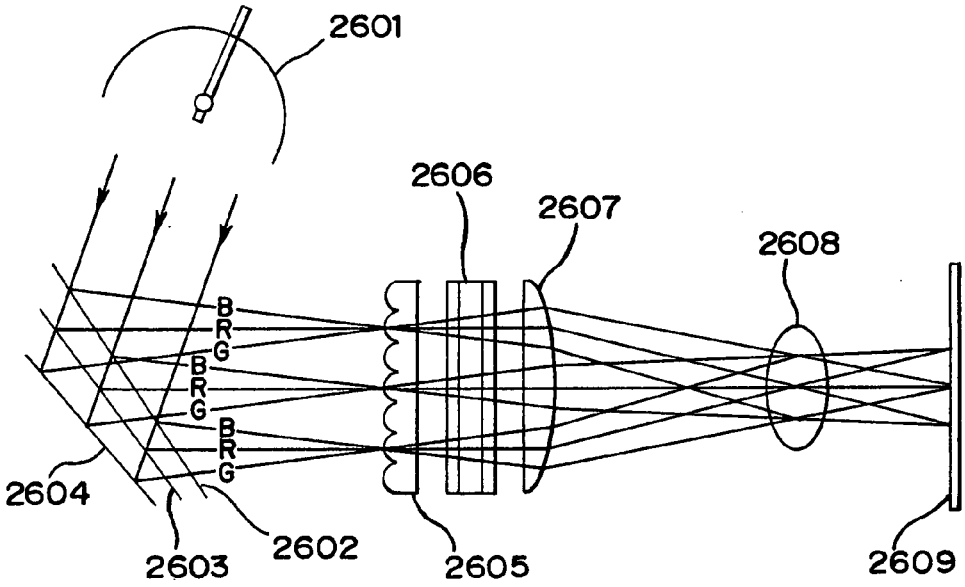
FIG. 26 is a structural diagram showing a single panel type projector using a display device according to Embodiment 10 of the invention.

The liquid crystal display device of the present invention described in the above Embodiments 1 to 3 may be used also for a single panel type projector as shown in FIG. 26.

In FIG. 26, reference numeral 2601 denotes a white light source comprising a lamp and a reflector, and 2602, 2603, 2604 denote dichroic mirrors which selectively reflect light in wavelength regions of blue, red and green, respectively. Denoted by 2605 is a microlens array consisting of a plurality of microlenses. Reference numeral 2606 denotes a liquid crystal display panel of the present invention; 2607, a field lens; 2608, a projection lens; and 2609, a screen.

Embodiment 11

The projectors are classified into rear projectors and front projectors depending on their manner of projection.

Figure 27A:
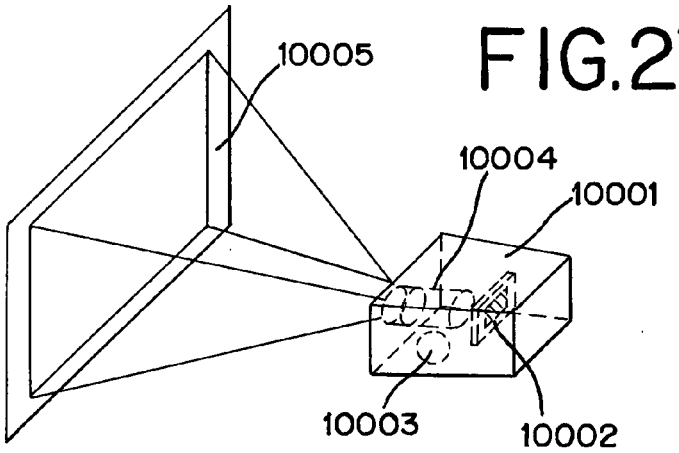
FIGS. 27A and 27B are structural views showing a front projector and a rear projector, respectively, each using a display device according to Embodiment 11 of the invention.

FIG. 27A shows a front projector comprised of a main body 10001, a display device 10002 of the present invention, a light source 10003, an optical system 10004, and a screen 10005. Though shown in FIG. 27A is the front projector incorporating one display device, it may incorporate three display devices (corresponding to the light R, G and B, respectively) to realize a front projector of higher resolution and higher definition.

Figure 27B:
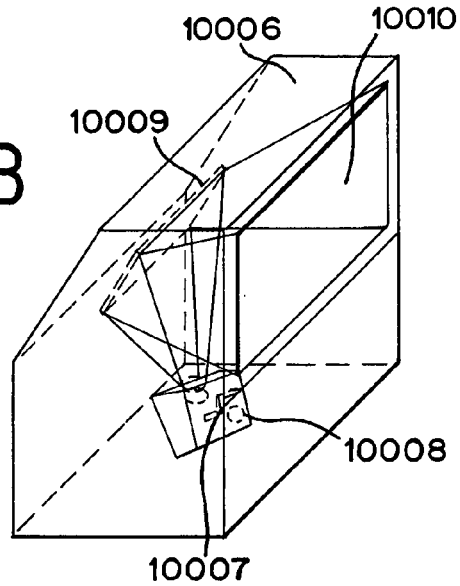

FIG. 27B shows a rear projector comprised of a main body 10006, a display device 10007, a light source 10008, a reflector 10009, and a screen 10010. Shown in FIG. 27B is a rear projector incorporating three active matrix semiconductor display devices (corresponding to the light R, G and B, respectively).

Embodiment 12

Figure 28:
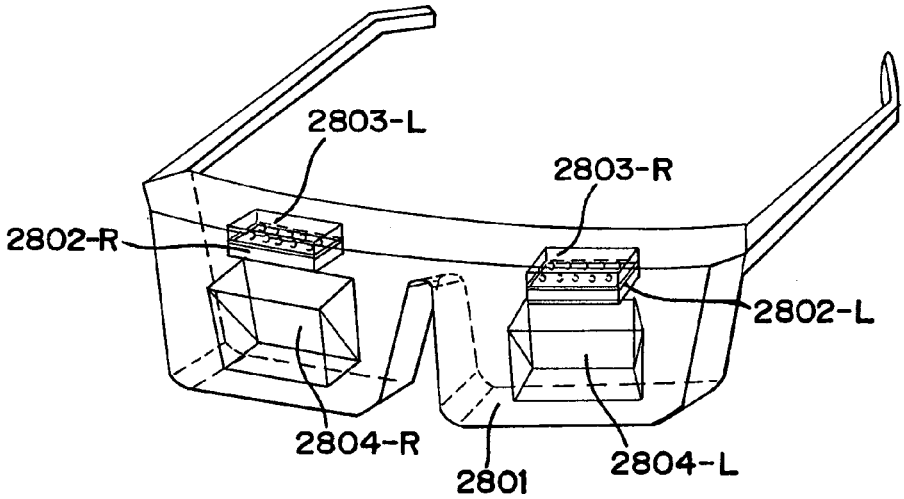
FIG. 28 is a structural view showing a goggle type display using display devices according to Embodiment 12 of the invention.

This embodiment shows an example in which a display device of the present invention is applied to a goggle type display as shown in FIG. 28.

Denoted by 2801 is the main body of a goggle type display; 2802-R, 2802-L, display devices of the present invention; 2803-R, 2803-L, LED backlights; and 2804-R, 2804-L, optical elements.

Embodiment 13

In this embodiment, LEDs are used for a backlight of a display device of the present invention to perform a field sequential operation.

Figure 29:
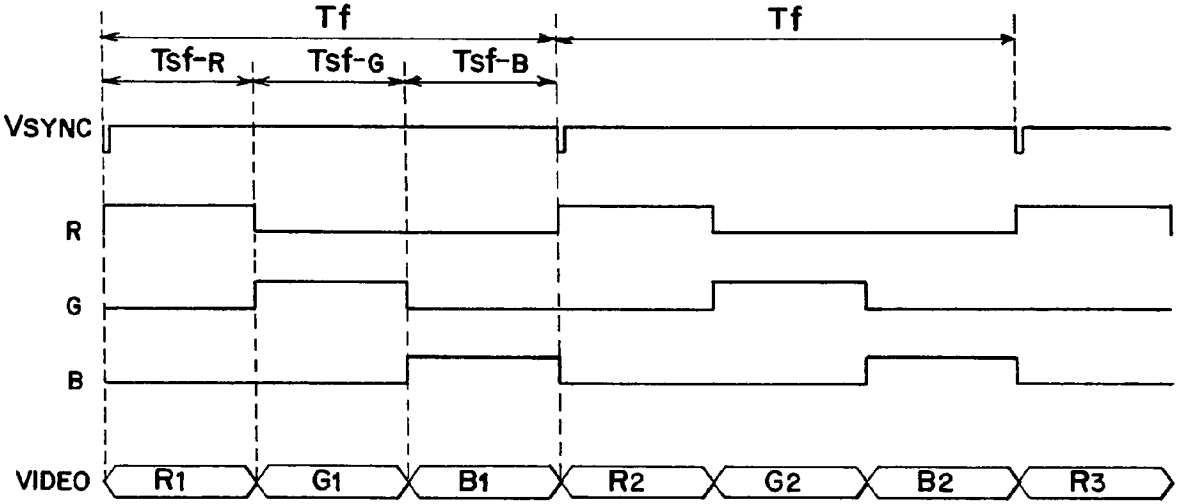
FIG. 29 is a timing chart for field sequential driving according to Embodiment 13 of the invention.

The timing chart of the field sequential driving method in FIG. 29 shows a start signal for writing a video signal (Vsync signal), lighting timing signals (R. G and B) for red (R), green (G) and blue (B) LEDs, and a video signal (VIDEO). Tf indicates a frame period. TR, TG, TB designate lit-up periods for red (R), green (G) and blue (B) LEDs, respectively.

A video signal sent to the display device, for example, R1, is a signal obtained by compressing along the time-base the video data, that is inputted from the external and corresponds to red, to have the size one third the original data size. Another video signal sent to the display panel, G1, is a signal obtained by compressing along the time-base the video data, that is inputted from the external and corresponds to green, to have the size one third the original data size. Still another video signal sent to the display panel, B1, is a signal obtained by compressing along the time-base the video data, that is inputted from the external and corresponds to blue, to have the size one third the original data size.

In the field sequential driving method, R, G and B LEDs are lit respectively and sequentially during the LED lit-up periods: TR period. TG period and TB period. A video signal (R1) corresponding to red is sent to a display panel during the lit-up period for the red LED (TR), to write one screen of red image into the display panel. A video signal (data) (G1) corresponding to green is sent to the display panel during the lit-up period for the green LED (TG), to write one screen of green image into the display panel. A video signal (data) (B1) corresponding to blue is sent to the display panel during the lit-up period for the blue LED (TB), to write one screen of blue image into the display panel. These three times operations of writing images complete one frame of image.

Embodiment 14

Figure 30:
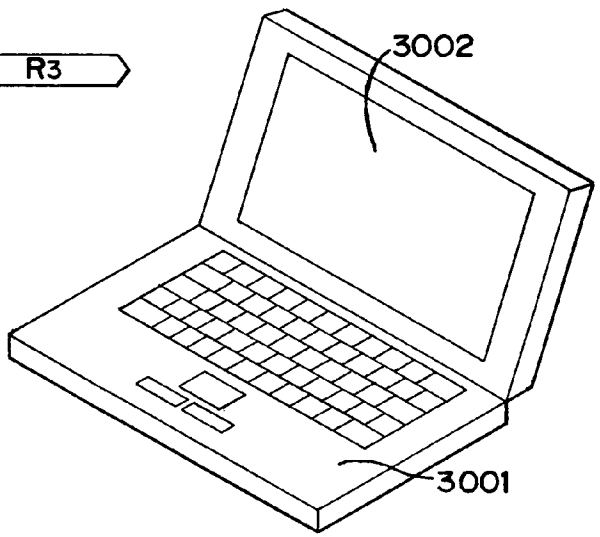
FIG. 30 is a structural view showing a notebook type computer using a display device according to Embodiment 14 of the invention.

This embodiment shows, with reference to FIG. 30, an example in which a display device of the present invention is applied to a notebook computer.

Reference numeral 3001 denotes the main body of a notebook computer, and 3002 denotes a display device of the present invention. LEDs are used for a backlight. Note that the backlight may instead employ a cathode ray tube as in the prior art.

Embodiment 15

The display device of the present invention has various other applications. In this embodiment, a description will be given on a semiconductor device incorporating an active matrix type display device.

As such a semiconductor device, a portable information terminal (an electronic book, a mobile computer or a cellular phone), a video camera, a still-image camera, a personal computer, TV etc. may be enumerated. An example of those is shown in FIG. 31.

Figure 31A:
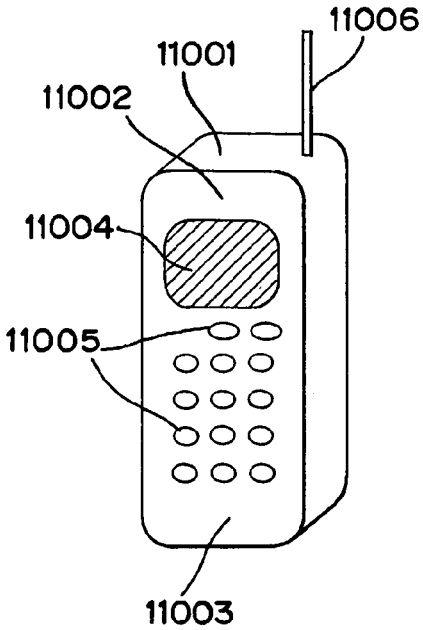
FIGS. 31A to 31D are views showing examples of electronic equipment using one or more display devices according to Embodiment 15 of the invention.

FIG. 31A is a cellular phone that is composed of a main body 11001, a sound output section 11002, a sound input section 11003, a display device of the present invention 11004, operation switches 11005, and an antenna 11006.

Figure 31B:
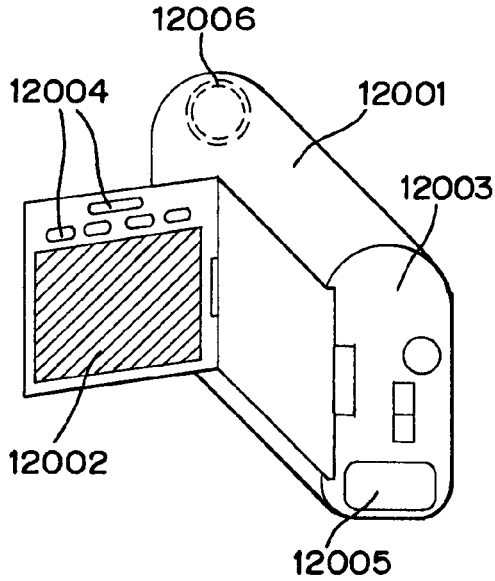

FIG. 31B shows a video camera that is comprised of a main body 12101, a display device of the present invention 12102, a voice input unit 12103, operation switches 12104, a battery 12105, and an image receiving unit 12106.

Figure 31C:
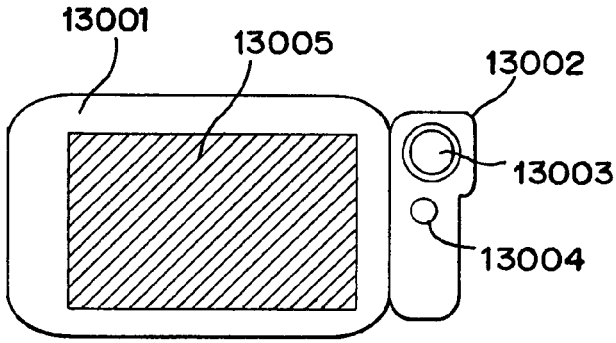

FIG. 31C shows a mobile computer that is comprised of a main body 13001, a camera unit 13002, an image receiving unit 13003, operation-switches 13004, and a display device of the present invention 13005.

Figure 31D:
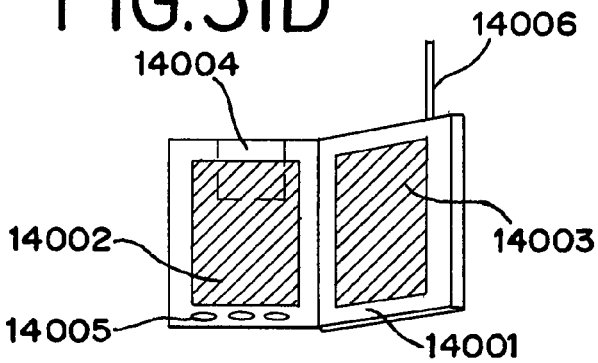

FIG. 31D shows a portable electronic book that is comprised of a main body 14001, display devices of the present invention 14002, 14003, a memory medium 14004, an operation switch 14005 and an antenna 14006.

Embodiment 16

This embodiment gives a description on an example where the driving method used to drive a liquid crystal display device of the present invention is applied to an EL (electroluminescence) display device.

Figure 32A:
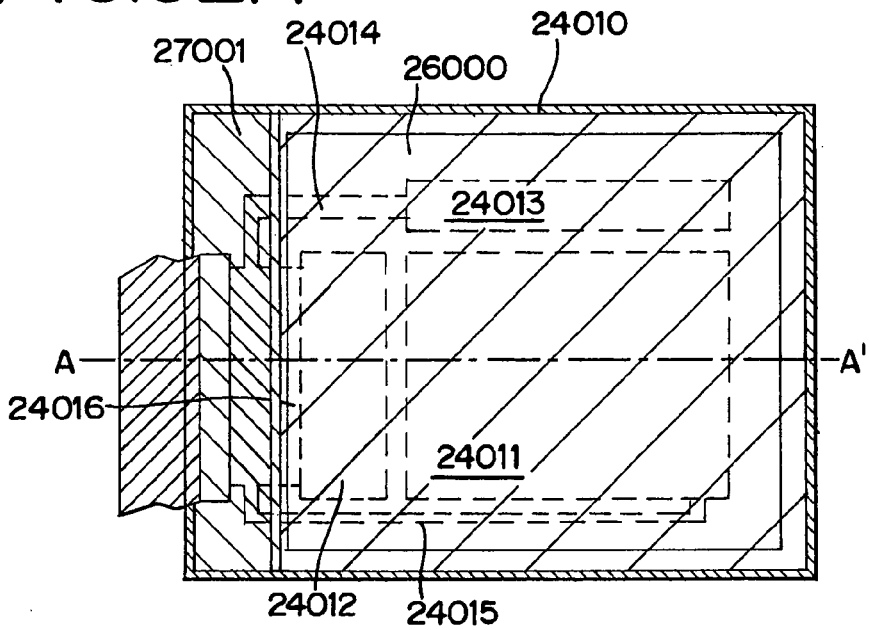
FIGS. 32A and 32B are diagrams showing the structure of an EL display device according to Embodiment 16 of the invention.
Figure 32B:
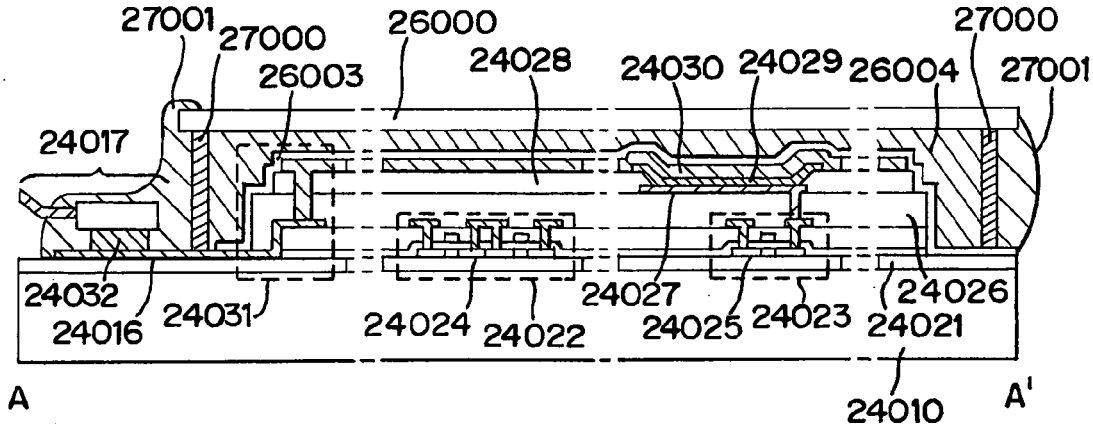

FIG. 32A is a top view of an EL display device according to this embodiment. FIG. 32B shows the sectional structure of the EL display device according to this embodiment. Reference numeral 24010 denotes a substrate; 24011, a pixel region; 24012, a source side driver circuit; and 24013, a gate side driver circuit. Each of the driver circuits is connected to an FPC 24017 through wirings 24014 to 24016, and further connected to external equipment.

A cover member 26000, a sealing material 27000 and a sealant (second sealing material) 27001 are arranged so as to enclose, at least, the pixel region, preferably the driver circuits and the pixel region.

A TFT (note that a CMOS circuit having a combination of an N channel type TFT and a P channel type TFT is shown here) 24022 for driver circuit and a TFT (note that only a TFT for controlling the current flowing to an EL element is shown here) 24023 for pixel region are formed on the substrate 24010 and a base film 24021.

Upon completion of the TFT 24022 for driver circuit and the TFT 24023 for pixel region, a pixel electrode 24027 made of a transparent conductive film and electrically connected to a drain of the TFT 24023 for pixel region is formed on an interlayer insulating film (flattening film) 24026 comprising a resin material. Usable transparent conductive film is a compound of indium oxide and tin oxide (called ITO) or a compound of indium oxide and zinc oxide. After forming the pixel electrode 24027, an insulating film 24028 is formed and an opening is formed on the pixel electrode 24027.

An EL layer 24029 is next formed. The EL layer 24029 may have a laminate structure in which known EL materials (hole injection layer, hole carrying layer, light emitting layer, electron carrying layer, or electron injection layer) are freely combined, or may have a single layer structure. Known techniques may be used in forming either structure. EL materials are divided into low molecular materials and macromolecular (polymer) materials. The evaporation method is used for the low molecular materials while a simple method such as spin coating, printing method and ink jet method may be used for the polymer materials.

In this embodiment, the evaporation method is employed with the use of a shadow mask to form the EL layer. The shadow mask is used to form a light emitting layer capable of emitting light different in wavelength for each pixel (red-colored light emitting layer, green-colored light emitting layer and blue-colored light emitting layer), obtaining color display. There are other color display systems, one of which is a system using in combination a color conversion layer (CCM) and a color filter, and the other is a system using in combination a white-light emitting layer and a color filter. Any of these systems may be employed. The EL display device may of course be of single-colored light emission.

After forming the EL layer 24029, a cathode 24030 is formed thereon. It is desirable to remove as much as possible the moisture and oxygen present in the interface between the cathode 24030 and the EL layer 24029. Some contrivance is thus needed, so the EL layer 24029 and the cathode 24030 are sequentially formed in vacuum, or the EL layer 24029 is formed in an inert atmosphere to form the cathode 24030 avoiding exposure to the air. Such film formation is realized in this embodiment by employing a film formation device of multi-chamber system (cluster tool system).

This embodiment uses as the cathode 24030 a lamination structure consisting of a LiF (litium fluoride) film and an Al (aluminum) film. Specifically, a LiF (litium fluoride) film with a thickness of 1 nm is formed on the EL layer 24029 by the evaporation method and an aluminum film with a thickness of 300 nm is formed thereon. A MgAg electrode, which is a known cathode material, may of course be used. The cathode 24030 is then connected to the wiring 24016 in a region denoted by 24031. The wiring 24016 is a power supply line for providing the cathode 24030 with a given voltage, and is connected to the FPC 24017 through a conductive paste material 24032.

In order to electrically connect the cathode 24030 to the wiring 24016 in the region denoted by 24031, contact holes have to be formed in the interlayer insulating film 24026 and the insulating film 24028. These holes may be formed in etching the interlayer insulating film 24026 (in forming a contact hole for pixel electrode) and in etching the insulating film 24028 (in forming the opening prior to the formation of the EL layer). Alternatively, the contact holes may be formed by etching at once through the interlayer insulating film 24026 when the insulating film 24028 is etched. In this case, an excellent shape may be obtained for the contact holes if the interlayer insulating film 24026 and the insulating film 24028 comprise the same resin material.

A passivation film 26003, a filling material 26004 and the cover member 26000 are formed to cover the surface of the thus formed EL element.

The sealing material 27000 is arranged inside the cover member 26000 and the substrate 24010 and the sealant (second sealing material) 27001 is formed outside the sealing material 27000 so that the EL element portion is enclosed.

At this point, the filling material 26004 serves also as an adhesive for adhering the cover member 26000. A material usable as the filling material 26004 is PVC (polyvinyl chloride), epoxy resin, silicone resin, PVB (polyvinyl butyral) or EVA (ethylene vinyl acetate). Providing an drying agent inside the filling material 26004 is preferable, so that moisture-absorbing effect can be maintained.

The filling material 26004 may contain a spacer therein. The spacer may be made of a granular substance such as BaO, giving the spacer itself moisture-absorbing property.

When the spacer is arranged, the passivation film 26003 can release the spacer pressure. Also, a resin film or the like for releasing the spacer pressure may be formed separately from the passivaton film.

Examples of the usable cover member 26000 include a glass plate, an aluminum plate, a stainless steel plate, an FRP (Fiberglass-Reinforced Plastics) plate, a PVF (polyvinyl fluoride) film, a Mylar™ film, a polyester film and an acrylic film. If PVB or EVA is used for the filling material 26004, preferable cover member is a sheet having a structure in which an aluminum foil several tens um in thickness is sandwiched with PVF films or Mylar™ films.

Depending on the direction of light emitted from the EL element (light emission direction), light-transmitting property is required for the cover member 26000.

The wiring 24016 is electrically connected to the FPC 24017 passing through the clearance defined by the substrate 24010 and by the sealing material 27000 and the sealant 27001. Though explanation here is made on the wiring 24016, the rest of the wirings, namely, wirings 24014, 24015 similarly pass under the sealing material 27000 and the sealant 27001 to be electrically connected to the FPC 24017.

Embodiment 17

Figure 33A:
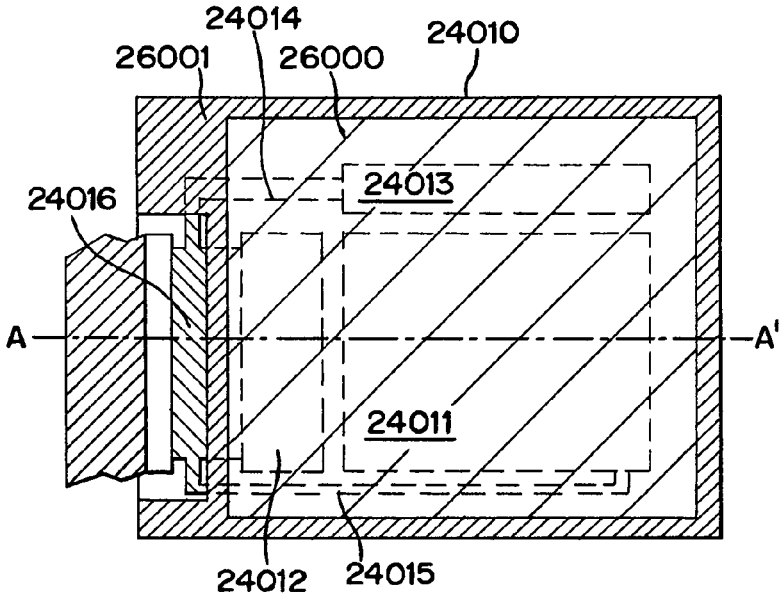
FIGS. 33A and 33B are diagrams showing the structure of an EL display device according to Embodiment 17 of the invention.
Figure 33B:
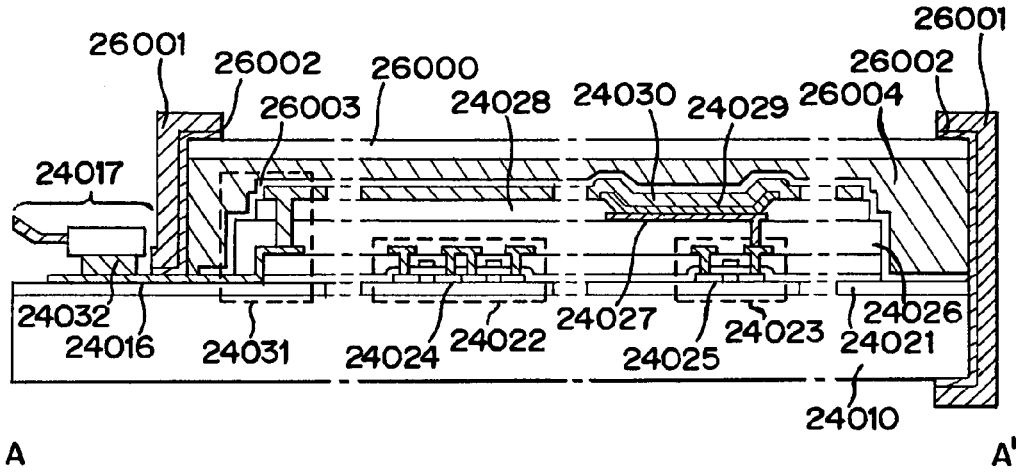

A description given in this embodiment with reference to FIGS. 33A and 33B is about an example of manufacturing an EL display device different in configuration from the one in Embodiment 16. Parts denoted by identical reference numerals as in FIGS. 32A and 32B are the same parts, so that explanation thereof is omitted.

FIG. 33A is a top view of an EL display device according to this embodiment, and FIG. 33B shows a sectional view taken along the line A–A' in FIG. 33A.

The procedure here follows the description in Embodiment 16 up through the formation of the passivation film 26003 covering the surface of the EL element.

The filling material 26004 is arranged so as to cover the EL element. This filling material 26004 serves also as an adhesive for adhering the cover member 26000. A material usable as the filling material 26004 is PVC (polyvinyl chloride), epoxy resin, silicone resin, PVB (polyvinyl butyral) or EVA (ethylene vinyl acetate). Providing an drying agent inside the filling material 26004 is preferable, so that moisture-absorbing effect can be maintained.

The filling material 26004 may contain a spacer therein. The spacer may be made of a granular substance such as BaO, giving the spacer itself moisture-absorbing property.

When the spacer is arranged, the passivation film 26003 can release the spacer pressure. A resin film for releasing the spacer pressure may be formed separately from the passivaton film.

Example of the usable cover member 26000 include a glass plate, an aluminum plate, a stainless steel plate, an FRP (Fiberglass-Reinforced Plastics) plate, a PVF (polyvinyl fluoride) film, a Mylar™ film, a polyester film and an acrylic film. If PVB or EVA is used for the filling material 26004, preferable cover member is a sheet having a structure in which an aluminum foil several tens μm in thickness is sandwiched with PVF films or Mylar™ films.

Depending on the direction of light emitted from the EL element (light emission direction), light-transmitting property is required for the cover member 26000.

After adhering the cover member 26000 utilizing the filling material 26004, a frame member 26001 is attached so as to cover the side faces (exposed faces) of the filling material 26004. The frame member 26001 is adhered with a sealing material (functioning as an adhesive) 26002. At this point, though preferably employed sealing material 26002 is an optically curable resin, a thermally curable resin may be used instead if the heat resistance of the EL layer allows. The sealing material 26002 is desirably a material that transmits moisture and oxygen as little as possible. The sealing material 26002 may additionally contains a drying agent.

The wiring 24016 is electrically connected to the FPC 24017 passing through the clearance between the sealing material 26002 and the substrate 24010. Though explanation here is made on the wiring 24016, the rest of the wirings, namely, wirings 24014, 24015 similarly pass under the sealing material 26002 to be electrically connected to the FPC 24017.

Embodiment 18

Figure 34:
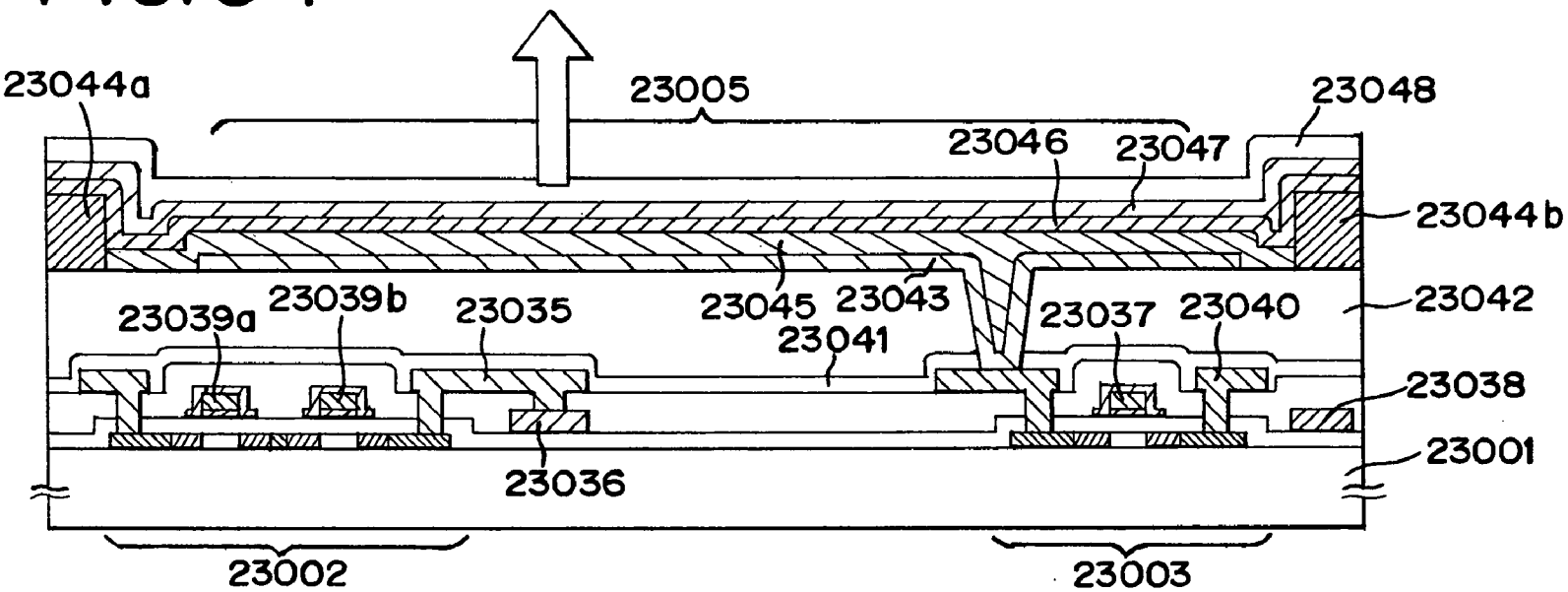
FIG. 34 is a sectional view showing the structure of a pixel region in an EL display device according to Embodiment 18 of the invention.
Figure 35A:
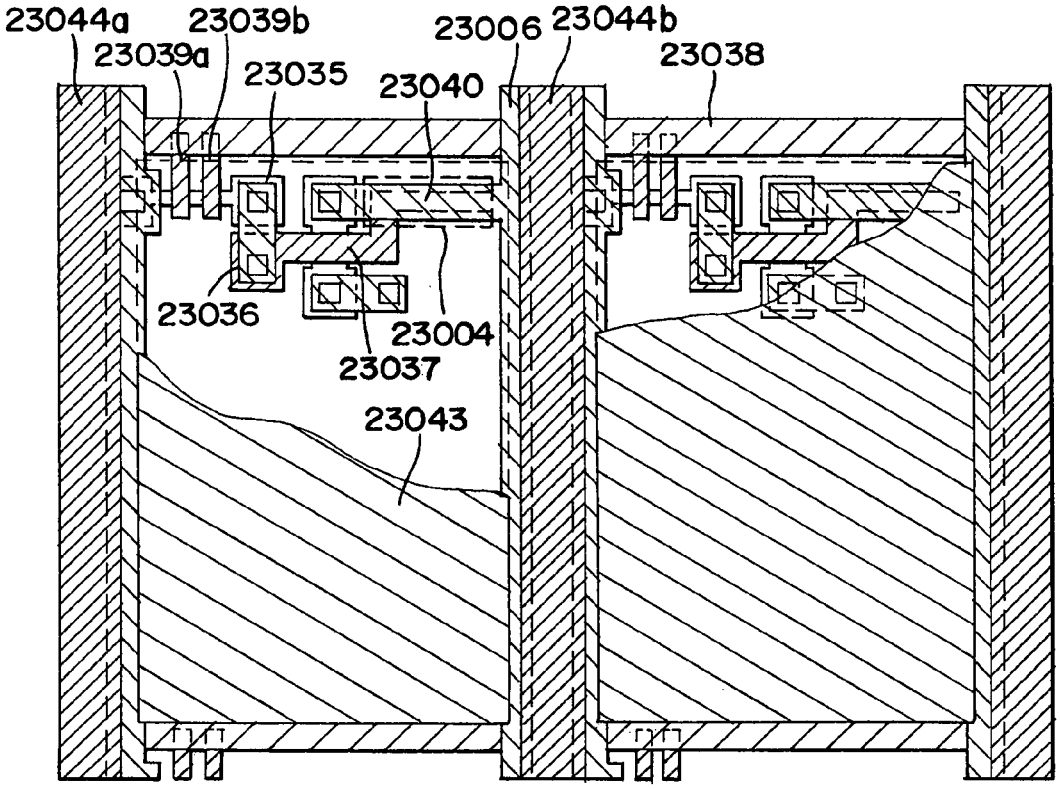
Figure 35B:
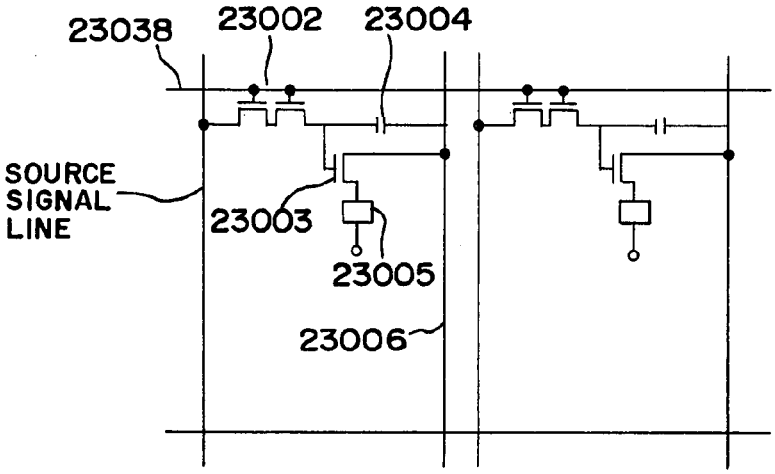

This embodiment will be described with reference to FIG. 34 showing more detailed sectional structure of a pixel region in an EL display panel, FIG. 35A showing the top structure thereof and FIG. 35B showing a circuit diagram thereof. Common reference numerals are used in FIG. 34, FIG. 35A and FIG. 35B, so that each drawing may find references in the others.

In FIG. 34, a switching TFT 23002 arranged on a substrate 23001 may either take the TFT structure described in Embodiment 4 or a known TFT structure. This embodiment employs the double gate structure, which does not make much difference in the structure and the manufacturing process, and accordingly the explanation thereof is omitted. It nevertheless is worth noting that the double gate structure has an advantage of reducing OFF current value owing to two TFTs substantially arranged in series. The TFT may take the single gate structure, the triple gate structure, or the multi-gate structure having more than three gates, regardless of employment of the double gate structure in this embodiment.

A current controlling TFT 23003 is formed using an NTFT. At this point, a drain wiring 23035 of the switching TFT 23002 is electrically connected through a wiring 23036 to a gate electrode 23037 of the current controlling TFT. A wiring denoted by 23038 is a gate wiring for electrically connecting gate electrodes 23039*a*. 23039*b* of the switching TFT 23002.

The current controlling TFT which is an element for controlling the amount of current flowing in an EL element has a high risk of degradation by heat and by hot carrier due to a large current that flows therein. Therefore the structure of the present invention, in which an LDD region is arranged on the drain side of the current controlling TFT so as to overlap with the gate electrode through a gate insulating film, is very effective.

Although the current controlling TFT 23003 in this embodiment is shown as a TFT having the single gate structure, it may take the multi-gate structure in which a plurality of TFTs are connected in series. The TFT 23003 may instead assume the structure in which a plurality of TFTs are connected in parallel to one another to practically divide a channel forming region into plural sections, achieving highly efficient heat radiation. Such structure is effective as countermeasures against degradation by heat.

As shown in FIG. 35A, a wiring to be the gate electrode 23037 of the current controlling TFT 23003 overlaps with a drain wiring 23040 of the current controlling TFT 23003 through the insulating film in a region denoted by 23004. At this point, a capacitor is formed in the region denoted by 23004. The capacitor 23004 functions as a capacitor for holding the voltage applied to the gate of the current controlling TFT 23003. The drain wiring 23040 is connected to a current supply line (power source line) 23006, and a constant voltage is applied thereto.

A first passivation film 23041 is formed on the switching TFT 23002 and the current controlling TFT 23003, and a flattening film 23042 comprising a resin insulating film is formed thereon. It is very important to flatten the level difference due to the TFTs using the flattening film 23042. An EL layer to be formed later is so thin that the presence of the level difference may sometimes cause trouble in emitting light. Therefore flattening is desirably carried out before forming a pixel electrode in order to form the EL layer on the surface as flat as possible.

Denoted by 23043 is a pixel electrode (cathode of the EL element) made of a conductive film with high reflectivity, which is electrically connected to the drain of the current controlling TFT 23003. Preferable material for the pixel electrode 23043 is a low resistance conductive film such as an aluminum alloy film, a copper alloy film or a silver alloy film, or a lamination film of those films. Of course, those films may be used to form a lamination structure with other conductive films.

Banks 23044*a*, 23044*b* made of an insulating film (preferably resin) form a groove (corresponding to a pixel) therebetween to form a light emitting layer 23045 in the groove. Though only one pixel is shown here, light emitting layers corresponding to the colors R (red), G (green) and B (blue), respectively, may be formed. As an organic EL material for forming the light emitting layer, π conjugate polymer material is used. Representative polymer materials include a polyparaphenylene vinylene (PPV)-, polyvinyl carbazole (PVK)- and polyfluorene-based materials, etc.

Among PPV-based organic EL materials of various forms, usable material is one disclosed in, for example, H. Shenk, H. Becker, O. Gelsen, E. Kluge, W. Kreuder, and H. Spreitzer, "Polymers for Light Emitting Diodes", Euro Display, Proceedings, 1999, pp. 33–37, or in Japanese Patent Application Laid-Open No. Hei 10-92576.

Specifically, cyanopolyphenylene vinylene is used for the light emitting layer for emitting red light, polyphenylene is used for the light emitting layer for emitting green light, and polyphenylene or polyalkylphenylene is used for the light emitting layer for emitting blue light. Appropriate film thickness thereof is 30 to 150 nm (preferably 40 to 100 nm).

However, the description above is an example of an organic EL material usable as the light emitting layer and there is no need to limit the present invention thereto. The EL layer (a layer for emitting light and for moving carriers to emit light) may be formed by freely combining the light emitting layer, an electric charge transport layer and an electric charge injection layer.

Instead of the polymer material which is used as the light emitting layer in the example shown in this embodiment, for instance, a low molecular organic EL material may be used. It is also possible to use an inorganic material such as silicon carbide for the electric charge transport layer and the electric charge injection layer. Known materials may be used for these organic EL materials and inorganic materials.

The EL layer in this embodiment has a lamination structure in which a hole injection layer 23046 comprising PEDOT (polytiophene) or PAni (polyaniline) is layered on the light emitting layer 23045. On the hole injection layer 23046, an anode 23047 is formed from a transparent conductive film. In the case of this embodiment, light produced in the light emitting layer 23045 is emitted toward the top face (upwards beyond the TFTs), which requires an anode having light transmittancy. The transparent conductive film may be formed from a compound of indium oxide and tin oxide or a compound of indium oxide and zinc oxide, and preferred material is one that can be formed into a film at a temperature as low as possible because the transparent conductive film is formed after forming the light emitting layer and the hole injection layer which have low heat resistance.

An EL element 23005 is completed upon formation of the anode 23047. The EL element 23005 here refers to a capacitor consisting of the pixel electrode (cathode) 23043, the light emitting layer 23045, the hole injection layer 23046 and the anode 23047. As shown in FIG. 35A, the pixel electrode 23043 extends almost all over the area of the pixel, so that the entire pixel functions as the EL element. Therefore light emittance efficiency is very high, resulting in bright image display.

In this embodiment, a second passivation film 23048 is further formed on the anode 23047. Preferred second passivation film 23048 is a silicon nitride film or a silicon nitride oxide film. A purpose of this second passivation film is to shut the EL element from the external with the intention of preventing degradation of the organic EL material due to oxidation as well as suppressing discharge of gas from the organic EL material. This enhances reliability of the EL display device.

As described above, the EL display panel of this embodiment includes the pixel region composed of pixels which have the structure as shown in FIG. 34, the switching TFT sufficiently low in OFF current value, and the current controlling TFT strong against hot carrier injection. Thus obtained is the EL display panel that has high reliability and is capable of excellent image display.

Embodiment 19

Figure 36:
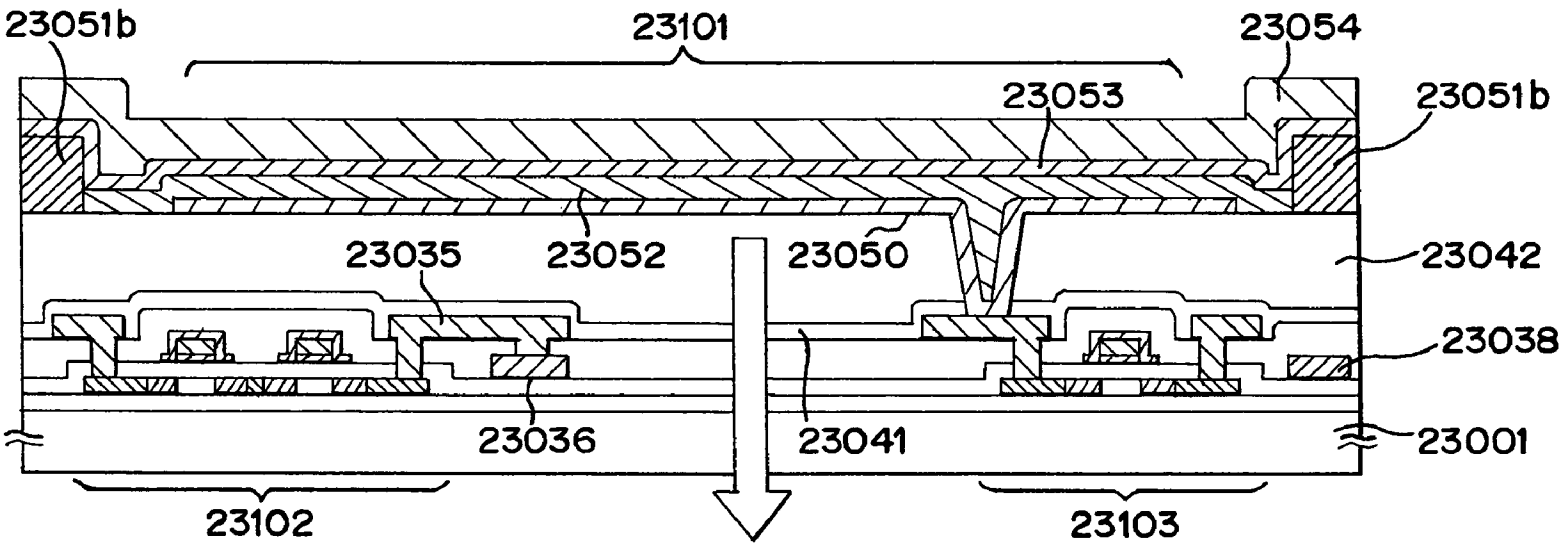
FIG. 36 is a sectional view showing the structure of a pixel region in an EL display device according to Embodiment 20 of the invention.

A description given in this embodiment is about the structure of the EL element 23005 in the pixel region shown in Embodiment 18, which is now inverted. FIG. 36 is used for explanation. The difference between this embodiment and the structure shown in FIG. 34 is limited to the EL element and the current controlling TFT, so that the explanation of others is omitted.

In FIG. 36, a current controlling TFT 23103 is formed using a PTFT.

A transparent conductive film is used for a pixel electrode (anode) 23050 in this embodiment. Specifically, a conductive film comprising a compound of indium oxide and zinc oxide is used. A conductive film comprising a compound of indium oxide and tin oxide may of course be used.

After forming banks 23051*a*, 23051*b* made of an insulating film, a light emitting layer 23052 comprising polyvinyl carbazole is formed by applying a solution. An electron injection layer 23053 comprising potassium acetylacetonate and a cathode 23054 comprising an aluminum alloy are formed thereon. In this case, the cathode 23054 functions also as a passivation film. An EL element 23101 is thus formed.

In this embodiment, light produced in the light emitting layer 23052 is emitted, as indicated by the arrow in the drawing, toward the substrate on which TFTs are formed.

Embodiment 20

Figure 37A:
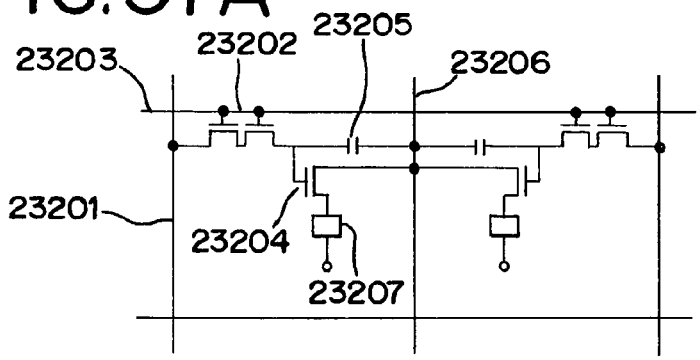
FIGS. 37A to 37C are circuit diagrams showing the structure of a pixel region in an EL display device according to Embodiment 21 of the invention.
Figure 37B:
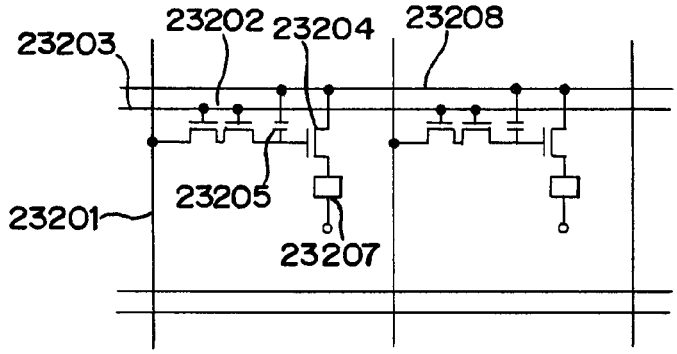
Figure 37C:
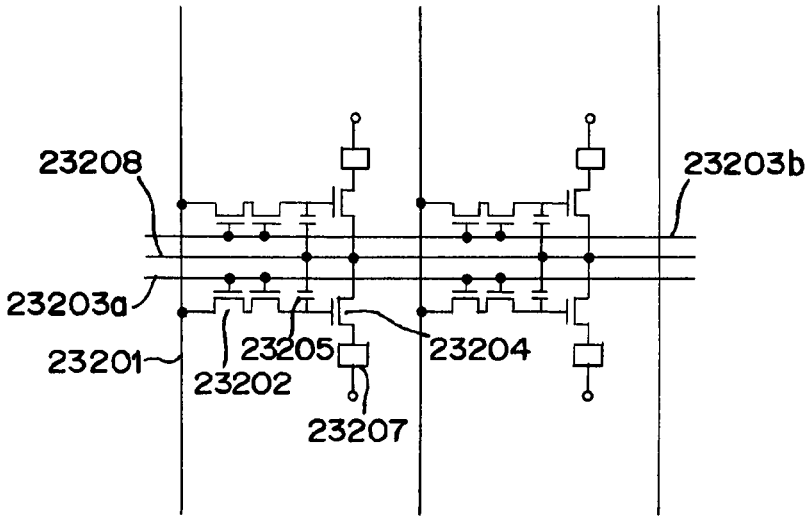

This embodiment deals with an example where a pixel has a different structure from the one shown in the circuit diagram of FIG. 35B, the example illustrated in FIGS. 37A to 37C. In this embodiment, reference numeral 23201 denotes a source wiring of a switching TFT 23202; 23203, gate wirings of the switching TFT 23202; 23204, a current controlling TFT; 23205, a capacitor; 23206, 23208, current supply lines; and 23207, an EL element.

FIG. 37A shows an example in which the current supply line 23206 is shared between two pixels. In other words, this example is characterized in that two pixels are formed so as to be axisymmetric with respect to the current supply line 23206. In this case, the number of power supply lines can be reduced, further enhancing the definition of the pixel region.

FIG. 37B shows an example in which the current supply line 23208 is arranged in parallel with the gate wirings 23203. Though the current supply line 23208 is arranged so as not to overlap with the gate wirings 23203 in FIG. 37B, the two may overlap with each other through an insulating film if the lines are formed in different layers. In this case, the current supply line 23208 and the gate wirings 23203 can share their occupied area, further enhancing the definition of the pixel region.

An example shown in FIG. 37C is characterized in that the current supply line 23208 is arranged, similar to the structure in FIG. 37B, in parallel with the gate wirings 23203 and, further, two pixels are formed to be axisymmetric with respect to the current supply line 23208. It is also effective to arrange the current supply line 23208 so as to overlap with one of the gate wirings 23203. In this case, the number of power supply lines can be reduced, further enhancing the definition of the pixel region.

The structure of this embodiment may be freely combined with the structure in Embodiments 1 to 9 and carried out. Also, it is effective to use an EL display panel having the pixel structure of this embodiment for a display portion of the electronic equipment shown in Embodiment 10.

Embodiment 21

In Embodiment 18 illustrated in FIGS. 35A and 35B, the capacitor 23004 for holding the voltage applied to the gate of the current controlling TFT 23003 is provided. However, the capacitor 23004 may be omitted. In the case of Embodiment 11, the TFT having the LDD region that is arranged to overlap with the gate electrode through the gate insulating film is used as the current controlling TFT 23003. A parasitic capacitance generally called a gate capacitance is formed in the overlapped region. This embodiment is characterized in that this parasitic capacitance is actively used as substitute for the capacitor 23004.

The capacitance of this parasitic capacitance varies depending on the area of the region where the gate electrode overlaps with the LDD region, and accordingly on the length of the LDD region contained in the overlapped region.

The capacitor 23205 may be omitted similarly in the structure of Embodiment 20 illustrated in FIGS. 37A to 37C.

According to the display device of the present invention, good multi-gradation display beyond the capacity of the D/A converter circuit can be obtained. Therefore a small-sized display device can be realized.

What is claimed is:

1. A display device comprising:

a pixel region having a plural number of pixel transistors arranged in a matrix shape; and a circuit for converting m-bit digital video data into $2^{m-n}$ pieces of n-bit digital video data (where m and n are both positive integers greater than or equal to 2, and m>n), wherein an image for one frame is formed by displaying $2^{m-n}$ pieces of subframes formed by the n-bit digital data.

2. A device according to claim 1, wherein a liquid crystal is used as a display medium.

3. A device according to claim 1, wherein an EL is used as a display medium.

4. A rear projector having three display devices according to claim 2.

5. A front projector having three display devices according to claim 2.

6. A single stage rear projector having one display device according to claim 2.

7. A goggle type display having two display devices according to claim 1.

8. A portable information terminal having a display device according to claim 1.

9. A notebook type personal computer having a display device according to claim 1.

10. A display device according to claim 1, wherein the display device performs voltage gradation display and time gradation display at the same time.

11. A display device according to claim 1, further comprising a source driver circuit and a gate driver circuit for driving the plural number of transistors.

12. A display device according to claim 11, wherein the n-bit digital video data is supplied to the source driver circuit.

13. A display device comprising:

a pixel region having a plural number of pixel transistors arranged in a matrix shape; and a circuit for converting m-bit digital video data into $2^{m-n}$ pieces of n-bit digital video data (where m and n are both positive integers greater than or equal to 2, and m>n), wherein an image for one frame is formed by displaying $2^{m-n}$ pieces of subframes formed by the n-bit digital data, and wherein $(2^m-(2^{m-n}-1))$ levels of display gradation can be obtained.

14. A device according to claim 13, wherein a liquid crystal is used as a display medium.

15. A device according to claim 13, wherein an EL is used as a display medium.

16. A rear projector having three display devices according to claim 14.

17. A front projector having three display devices according to claim 14.

18. A single stage rear projector having one display device according to claim 14.

19. A goggle type display having two display devices according to claim 13.

20. A portable information terminal having a display device according to claim 13.

21. A notebook type personal computer having a display device according to claim 13.

22. A display device according to claim 13, wherein the display device performs voltage gradation display and time gradation display at the same time.

23. A display device according to claim 13, further comprising a source driver circuit and a gate driver circuit for driving the plural number of transistors.

24. A display device according to claim 23, wherein the n-bit digital video data is supplied to the source driver circuit.

* * * * *